US012768367B2

(12) United States Patent
Zheng et al.

(10) Patent No.: US 12,768,367 B2
(45) Date of Patent: Oct. 20, 2026

(54) FAN BLADE AND FAN

(71) Applicant: SHENZHEN JISU TECHNOLOGY CO., LTD, Shenzhen (CN)

(72) Inventors: Guanzheng Zheng, Shenzhen (CN); Shuiyong Yuan, Shenzhen (CN); Weijie Zheng, Shenzhen (CN); Jiaqi Li, Shenzhen (CN); Cunfu Huang, Shenzhen (CN); Yinggai Yang, Shenzhen (CN); Jiahang Xie, Shenzhen (CN); Wenpeng Qi, Shenzhen (CN)

(73) Assignee: SHENZHEN JISU TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 19/333,734

(22) Filed: Sep. 19, 2025

(65) Prior Publication Data

US 2026/0016021 A1 Jan. 15, 2026

Related U.S. Application Data

(63) Continuation of application No. PCT/CN2024/102013, filed on Jun. 27, 2024.

(30) Foreign Application Priority Data

| | | |
|---|---|---|
| Jul. 25, 2023 | (CN) | 202321975661.7 |
| Oct. 11, 2023 | (CN) | 202322734995.1 |
| Oct. 11, 2023 | (CN) | 202322739528.8 |
| Oct. 11, 2023 | (CN) | 202322749487.0 |
| Jan. 22, 2024 | (CN) | 202410095173.X |
| Jan. 22, 2024 | (CN) | 202420157765.5 |

(Continued)

(51) Int. Cl.

| | |
|---|---|
| ***F04D 29/34*** | (2006.01) |
| ***F04D 29/02*** | (2006.01) |
| ***F04D 29/38*** | (2006.01) |

(52) U.S. Cl.

CPC ..... *F04D 29/34* (2013.01); *F04D 29/023* (2013.01); *F04D 29/384* (2013.01)

(58) Field of Classification Search

CPC ..... F04D 29/34; F04D 29/38; F04D 29/384; F04D 29/329

See application file for complete search history.

(56) References Cited

FOREIGN PATENT DOCUMENTS

| | | |
|---|---|---|
| CN | 204267319 U | 4/2015 |
| CN | 205937218 U | 2/2017 |
| CN | 207229428 U | 4/2018 |

(Continued)

*Primary Examiner* — Sabbir Hasan

(74) *Attorney, Agent, or Firm* — HOWARD M COHN and Associates, LLC

(57) ABSTRACT

A fan blade and a fan are provided. The fan blade includes a hub and a plurality of blades. Each blade includes a blade root and a blade tail. The blade tail is twisted relative to the blade root. The blade roots of the plurality of blades are connected to the hub. By twisting the blade tail relative to the blade root, a twisted part plays a role in converging incoming air, so that air blown out of the fan blade is more concentrated, an air blowing effect is enhanced, and a user experience is enhanced. The twisted part plays the role in converging the incoming air, so that the air blown out of the fan blade is more concentrated, which increases an axial pressure, forms an air flow, improves air flowing efficiency of the blades, and improves a wind effect.

20 Claims, 36 Drawing Sheets

(30) Foreign Application Priority Data

Jan. 22, 2024 (CN) ..... 202420158059.2
Mar. 27, 2024 (CN) ..... 202420628859.6

(56) References Cited

FOREIGN PATENT DOCUMENTS

| | | | | | |
|---|---|---|---|---|---|
| CN | 108180169 | A | * | 6/2018 | ..... F04D 29/666 |
| CN | 214366805 | U | | 10/2021 | |
| CN | 217421663 | U | | 9/2022 | |
| CN | 219492641 | U | | 8/2023 | |
| CN | 219492642 | U | | 8/2023 | |

* cited by examiner

C

FAN BLADE AND FAN

CROSS-REFERENCE TO RELATED APPLICATIONS

No. This application is a continuation of International Application PCT/CN2024/102013, filed on Jun. 27, 2024, which claims priorities to Chinese Patent Application No. CN 202321975661.7, filed on Jul. 25, 2023, Chinese Patent Application No. CN 202322749487.0, filed on Oct. 11, 2023, Chinese Patent Application No. CN 202322739528.8, filed on Oct. 11, 2023, Chinese Patent Application No. CN 202322734995.1, filed on Oct. 11, 2023, Chinese Patent Application No. CN 202420157765.5, filed on Jan. 22, 2024, Chinese Patent Application No. CN 202410095173.X, filed on Jan. 22, 2024, Chinese Patent Application No. CN 202420158059.2, filed on Jan. 22, 2024, and Chinese Patent Application No. CN 202420628859.6, filed on Mar. 27, 2024, the entire contents of which are incorporated herein by reference.

TECHNICAL FIELD

The present disclosure relates to the technical field of fans, and in particular to, a fan blade and a fan.

BACKGROUND

In recent years, people have increasingly pursued a more convenient life. In order to meet a demand for practical fans in outdoor activities or other living scenes, various types of fans have appeared on the market. A fan generally includes a fan blade. However, the fan blade is inclined at an angle of 10 degrees to a horizontal plane. During use, when rotating, the inclined fan blade drives air to flow, thereby outputting air. However, the air outputting effect of the fan is limited. This will to an extent affect the air blowing effect of the fan, thus limiting the practicality.

SUMMARY

The present disclosure mainly aims to provide a fan blade and a fan, to solve a problem of how to improve an air blowing effect of the fan. Compared with the existing art, the fan blade provided by the present disclosure has the advantages that the tail is twisted relative to the root, and a twisted part plays a role in converging incoming air, so that air blown out of the fan blade is more concentrated, and an air blowing effect is enhanced. An air flow is formed at the twisted part, and air flowing efficiency of the blades is improved, thus improving a wind effect and enhancing a user experience.

BRIEF DESCRIPTION OF THE DRAWINGS

Implementations will be explained in the present disclosure with reference to the accompanying drawings. The accompanying drawings of the present disclosure are only used to describe the embodiments and are for showing purposes. Without deviating from the principles of the present disclosure, a person skilled in the art can easily make other embodiments according to the steps through the following descriptions.

DETAILED DESCRIPTION OF THE EMBODIMENTS

Figure 1:
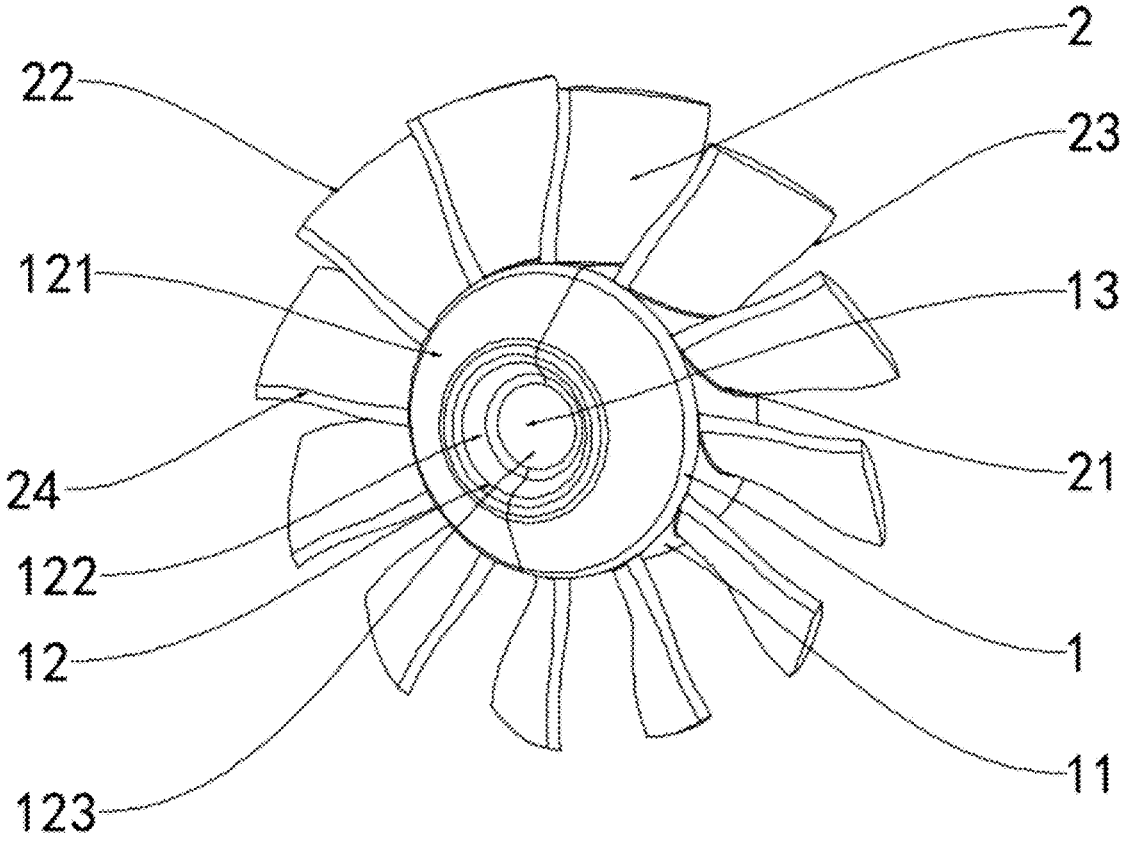
FIG. 1 is a three-dimensional diagram of a fan blade provided by an embodiment of the present disclosure.

The following describes the technical solutions in the embodiments of the present disclosure clearly and completely with reference to the accompanying drawings in the embodiments of the present disclosure. It is to be understood that the specific embodiments described herein are merely illustrative of the disclosure and are not to be construed as limiting the disclosure. It should also be noted that, for convenience of description, only the structures relevant to the present disclosure, rather than all structures, are shown in the drawings. All other embodiments obtained by a person of ordinary skill in the art based on the embodiments of the present disclosure without making creative efforts shall fall within the protection scope of the present disclosure.

The terms "first," "second," etc. in this disclosure are used to distinguish between different objects, rather than to describe a specific order. Furthermore, the terms "comprising" and "having" and any variations thereof are intended to cover a non-exclusive inclusion. For example, a process, method, system, product, or device that comprises a series of steps or units is not limited to the listed steps or units, but may optionally also include steps or units not listed, or may optionally also include other steps or units inherent to such process, method, product, or device.

Reference to "an embodiment" or "one embodiment" herein means that a particular feature, structure, or characteristic described in connection with the embodiment may be included in at least one embodiment of the present disclosure. The appearance of the phrase in various places in the specification does not necessarily refer to the same embodiment, nor is it an independent or alternative embodiment mutually exclusive with other embodiments. Those skilled in the art will understand explicitly and implicitly that the embodiments described herein may be combined with other embodiments.

Solution I

Referring to FIG. 1 to FIG. 4, the present disclosure provides a fan blade and a fan, to solve a problem of how to improve air flowing efficiency of a blade, enhance a wind effect, and improve practicability of the fan.

Embodiment 1

Figure 2:
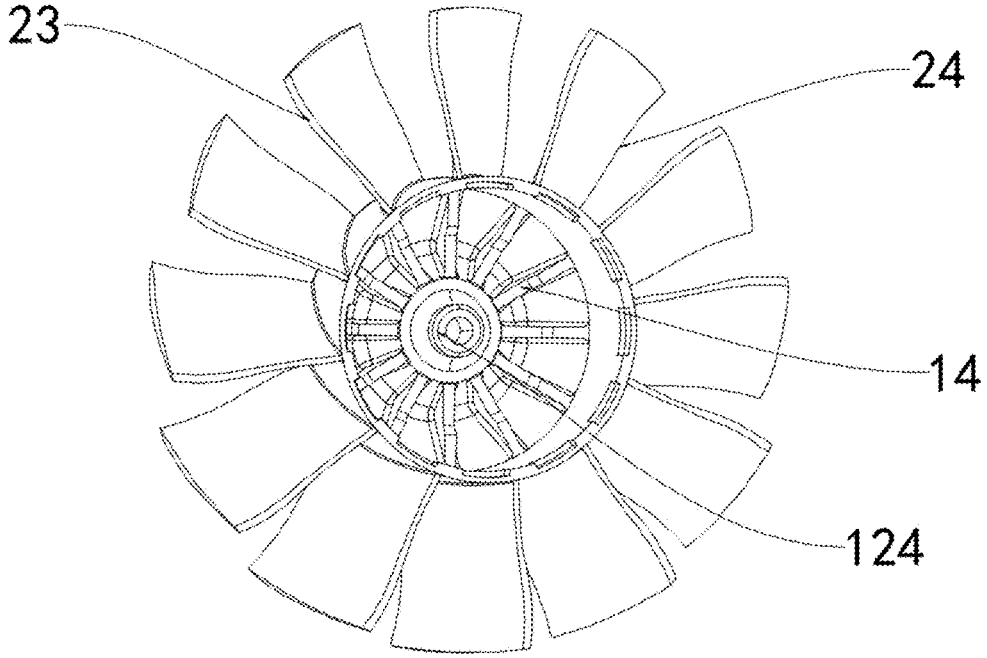
FIG. 2 is a three-dimensional diagram of a fan blade in another view, which is provided by an embodiment of the present disclosure.

A fan blade includes a hub 1 and a plurality of blades 2 uniformly distributed in a circumferential direction of the hub 1. As shown in FIG. 1 and FIG. 2, each blade 2 includes a blade root 21 and a blade tail 22. The blade tail 22 is twisted relative to the blade root 21. The blade roots 21 of the plurality of blades are connected to the hub 1. During use, the blade tail 22 is twisted relative to the root 21, and a twisted part plays a role in converging incoming air, so that air blown out of the fan blade is more concentrated, an air blowing effect is enhanced, and a user experience is enhanced. The twisted part plays the role in converging the incoming air, so that the air blown out of the fan blade is more concentrated, which increases an axial pressure, forms an air flow, improves air flowing efficiency of the blades, and improves a wind effect. By the connection between the blade roots 21 of the blades and the hub 1, stability of the blades 2 during rotation of a fan is improved, and stability of the fan blade is improved.

Further, each blade 2 further includes a first side 23 and a second side 24. A thickness of the first side 23 of the blade 2 is greater than a thickness of the second side 24 of the blade 2. A distance from the first side 23 of the blade root 21 to the second side 24 of the blade root 21 is a first width. A range of the first width is greater than or equal to 16.0 mm and less than or equal to 16.5 mm. A distance from the first side 23 of the blade tail 22 to the second side 24 of the blade tail 22 is a second width. A range of the second width is greater than or equal to 15.0 mm to less than or equal to 15.5 mm. Preferably, the first width is 16 mm and the second width is 15.2 mm. During use, the first side 23 faces an air inlet side, and the second side 24 faces an air outlet side. The thickness of the first side 23 of the blade 2 is greater than the thickness of the second side 24 of the blade 2. This increases a speed of the air entering the blade 2 from the first side 23 and flowing towards the second side 24, enhances an air guide effect, and enhances an air exhaust effect. The distance from the first side 23 of the blade root 21 to the second side 24 of the blade root 21 is greater than the distance from the first side 23 of the blade tail 22 to the second side 24 of the blade tail 22, so the blade tail 22 has a smaller volume and a lighter weight than the blade root 21. This reduces resistance to the blade 2 during rotation of the fan blade, reduces energy consumption, and increases a rotation rate of the fan blade, thereby improving an air supply rate.

An angle between a connection line from the first side 23 of the blade root 21 to the second side 24 of the blade root 21 and a radial plane direction of the hub 1 is a first angle. A range of the first angle is greater than or equal to 25 degrees and less than or equal to 75 degrees. An angle between a connection line from the first side 23 of the blade tail 22 to the second side 24 of the blade tail 22 and the connection line from the first side 23 of the blade root 21 to the second side 24 of the blade root 21 is a second angle. A range of the second angle is greater than or equal to 5 degrees and less than or equal to 10 degrees. Preferably, the first angle is 75 degrees. During use, the second angle is a twisting angle towards a user. The first angle is a mounting angle of the blade 2 on the hub 1. By the setting of a mounting inclination angle towards the user, an area of the blade 2 is enlarged in a case that the size of the hub 1 is the same, thereby increasing an air inlet volume. The second angle is a twisting angle of the blade tail 22 relative to the blade root 21. By the setting of the twisting towards the user, the axial pressure is increased at the twisted part, so that air flowing between the blades 2 can flow out at a higher rate, thereby increasing the air supply rate of the fan blade, enhancing the wind effect, and enhancing the user experience.

Specifically, a quantity of the blades is 9 to 15. Preferably, in this embodiment, the quantity of the blades is 12. A specific arrangement quantity can be adjusted by those skilled in the art based on an actual working environment.

Further, the hub 1 includes an annular main body 11 and an air guide cone 12 connected to the annular main body 11. The annular main body 11 is connected to the air guide cone 12 to form a cavity. By the arrangement of the annular main body 11, the blades 2 can be more stable. By the arrangement of the air guide cone 12 connected to the annular main body 11, resistance to incoming air when the fan blade is used is reduced. The air guide cone 12 plays a guiding role, thereby enhancing the air supply effect and enhancing the user experience. The cavity formed by the connection between the annular main body 11 and the air guide cone 12 can accommodate and mount components such as a motor during mounting of the fan blade.

Specifically, a circular recessed platform 13 is arranged at a center of the air guide cone 12. The recessed platform 13 includes a bottom plate 123 and an inner conical wall 122 connected to the bottom plate 123. The inner conical wall 122 is connected to the annular main body 11 through an outer conical wall 121. By the arrangement of the outer conical wall 121 connected to the annular main body 11, a conical air guide surface is provided for the air inlet side, so that the incoming air can enter positions between the blades 2 along the outer conical wall 121, thereby enhancing the wind effect.

Further, the bottom plate 123 is provided with an annular protrusion 124 on one side facing the cavity, and a diameter of the annular protrusion 124 is less than a diameter of the bottom plate 123. By the arrangement of the annular protrusion 124, axial positioning can be provided for the rotation of the fan blade. A rotating shaft is sleeved inside the annular protrusion 124 to improve the stability of the axial rotation of the fan blade. Meanwhile, a joint of the annular protrusion 124 and the bottom plate 123 is a smooth curved surface. Therefore, the annular protrusion 124 can alleviate the impact of the air of the air inlet side on the overall stability of the bottom plate 123, making the entire fan blade more stable.

Specifically, a plurality of connection plates 14 are arranged on one side of the inner conical call 122 that faces the cavity. The connection plates 14 are connected to the outer conical wall 121. By the arrangement of the connection plates 14 to connect the inner conical wall 122 to the outer conical wall 121, stability of the connection between the outer conical wall 121 and the inner conical wall 122 is improved, and the stability of the entire fan blade is improved. A joint of the outer conical wall 121 and the inner conical wall 122 and a joint of the inner conical wall 122 and the bottom plate 123 are both arc-shaped chamfers. By arranging the joint of the outer conical wall 121 and the inner conical wall 122 and the joint of the inner conical wall 122 and the bottom plate 123 to be the arc-shaped chamfers, it can be easier for demolding during production and manufacturing, and it is hard to scratch opposite right-angle sides during later mounting and use. During air incoming, the resistance to the air is reduced, thus enhancing the wind effect. A width of a joint of each connection plate 14 and the outer conical wall 121 and a width of a joint of the connection plate 14 and the inner conical wall 122 are both greater than a width of the center of the connection plate 14; and the joint of the connection plate 14 and the inner conical wall 122 and the joint of the connection plate 14 and the outer conical wall 121 are both arc-shaped chamfers. Since the width of the joint of each connection plate 14 and the outer conical wall 121 and the width of the joint of the connection plate 14 and the inner conical wall 122 are both greater than the width of the center of the connection plate 14, the joint of the connection plate 14 has a higher capability to bear an external force. Due to the arc-shaped chamfers in the joints of the connection plate 14 and the outer conical wall 121, as well as the inner conical wall 122, it can be easier for demolding during production and manufacturing, and wind strength on the inner conical wall 122 and the outer conical wall 121 can also be dispersed, thus improving the reliability of connection to the inner conical wall 122 and the outer conical wall 121 and improving the stability of the fan blade.

In some embodiments, the fan blade further includes a fixed ring that is connected to the blade tails 22 of the blades 2 and is annularly arranged on outer sides of the blades 2. By the arrangement of the fixed ring, on the one hand, the blade tails 22 of the plurality of blades 2 cannot collide to cause a safety hazard when the fan blade rotates at a high speed, which improves the stability of the blades 2. On the other hand, it also avoids circumferential outflow of the air when the fan blade rotates, thus playing a role in gathering wind and enhancing the user experience.

Embodiment 2

Figure 3:
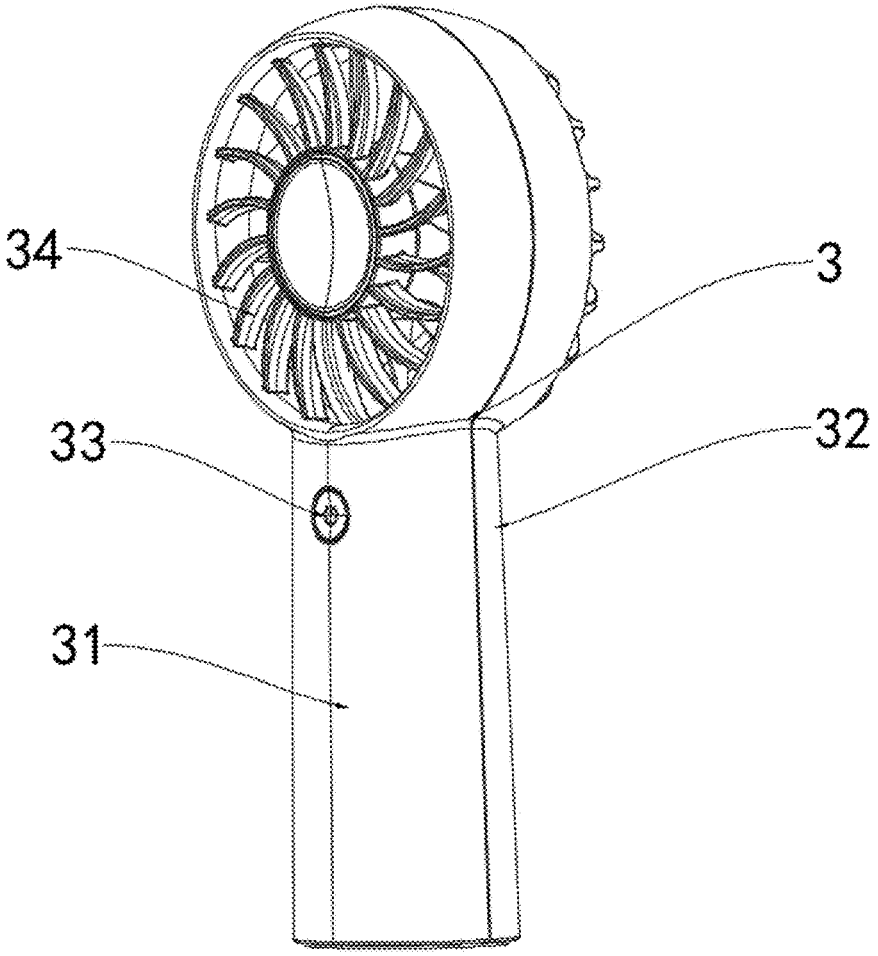
FIG. 3 is a three-dimensional exploded diagram of a fan provided by an embodiment of the present disclosure.
Figure 4:
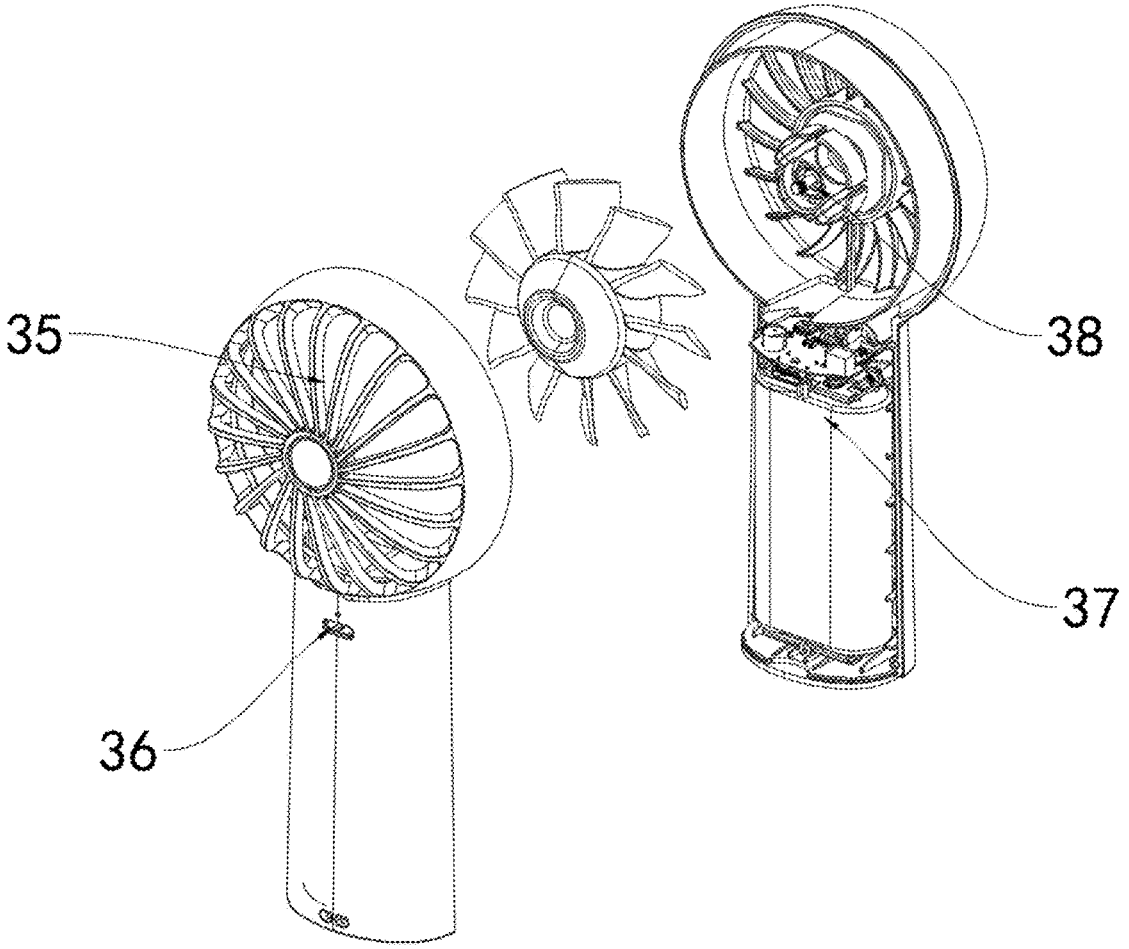
FIG. 4 is a three-dimensional diagram of a fan provided by an embodiment of the present disclosure.

This embodiment discloses a fan including the fan blade of Embodiment 1. As shown in FIG. 3 and FIG. 4, the fan further includes a housing 3 connected to the hub 1. The housing 3 includes a front cover 31 and a rear cover 32. A switch button 33 is arranged on the front cover 31, and a charging port 36 is provided in the rear cover 32. A power source 37 is arranged in one side of the housing 3 that is away from the hub 1. The housing is provided with an air outlet 34 and an air inlet 35. The air guide cone 12 faces the air inlet 35. A driving motor 38 is arranged between the air outlet 34 and the hub 1. The switch button 33, the charging port 36, and the driving motor 38 are respectively electrically connected to the power source 37. The charging port 36 is configured to charge the power source 37. The switch button 33 is configured to control the driving motor 38 to be electrically connected to the power source 37. During use, the switch button 33 is pressed to electrically connect the driving motor 38 with the power source 37. Under the driving of the driving motor 38, the blades 2 rotate with the hub 1, thereby driving air to flow from the air inlet 35 to the air outlet 34 to achieve an air outlet effect and enhancing a user experience. Preferably, in this embodiment, the switch button 33 is arranged on one surface of the housing 3 of the fan that faces a user to facilitate user operation. The charging port 36 is provided in one surface of the housing 3 of the fan that faces away from the user. In some embodiments, a dust cover can be further arranged on the charging port 36 to prevent dust, water, and the like from entering the charging port.

According to the fan blade and the fan that are provided by the present disclosure, the resistance to the air flow flowing through the fan blade is reduced by twisting the blade tails 22 of the fan blade relative to the blade roots 21. The air flow formed at the twisted part improves the air flowing efficiency of the blades 2, thus enhancing the wind effect and the user experience. Furthermore, the thickness of the first side 23 of each blade 2 is greater than the thickness of the second side 24 of each blade, so that this further reduces the resistance to the air entering the blades, increases the axial pressure of the twisted part, and causes the air flowing into the positions between the blades 2 can flow out at a higher rate, thereby increasing the air supply rate of the fan blade. The distance from the first side 23 of each blade root 21 to the second side 24 of each blade root 21 is greater than the distance from the first side 23 of each blade tail 22 to the second side 24 of each blade tail 22, so that the width of the blade tail 22 is less than the width of the blade root 21, thus lowering the energy consumption of rotation of the fan while reducing the weight of the entire fan. By arranging the air guide cone 12 on the hub 1, the air outlet effect is enhanced. Since the joint of the outer conical wall 121 and the inner conical wall 122 and the joint of the inner conical wall 122 and the bottom plate 123 are set to be arc-shaped chamfers, it is convenient for demolding during processing, and this also reduces the resistance to wind and enhances the user experience.

All the technical features of the above embodiments can be combined randomly. For the sake of brevity, all possible combinations of all the technical features in the above embodiments are not described. However, these technical features shall all be considered to fall within the scope of this specification as long as there is no contradiction in their combinations.

Solution II

Figure 5:
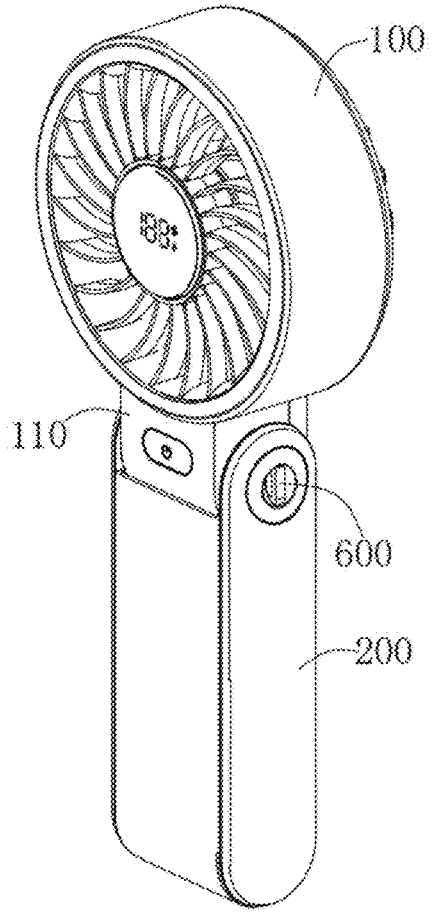
FIG. 5 is a schematic diagram of an entire structure according to this embodiment.

Referring to FIG. 5, this embodiment relates to a handheld fan with a rotatable handle, including a fan main body 100 and a handheld handle 200.

Figure 6:
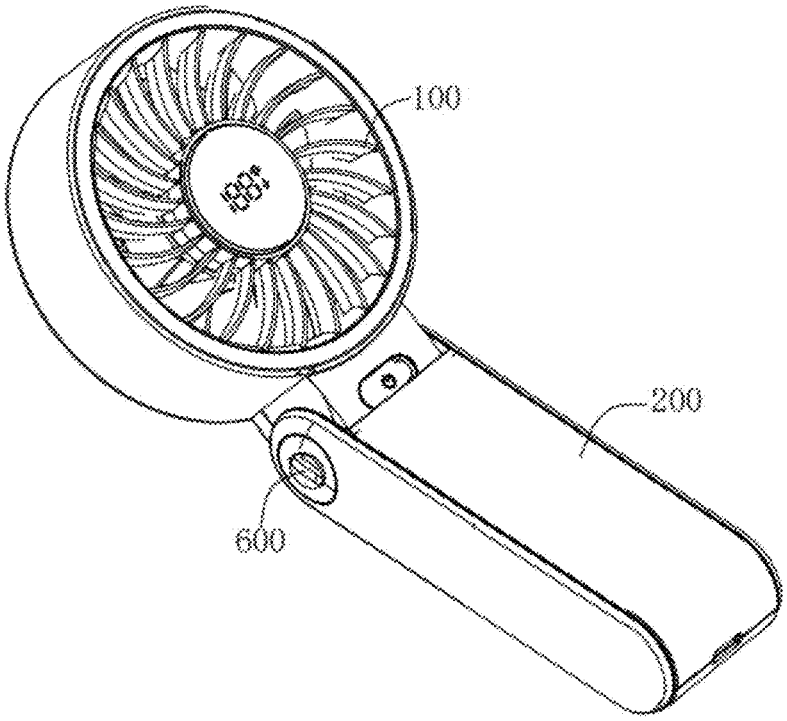
FIG. 6 is a first schematic structural diagram after a fan main body rotates in this embodiment.
Figure 7:
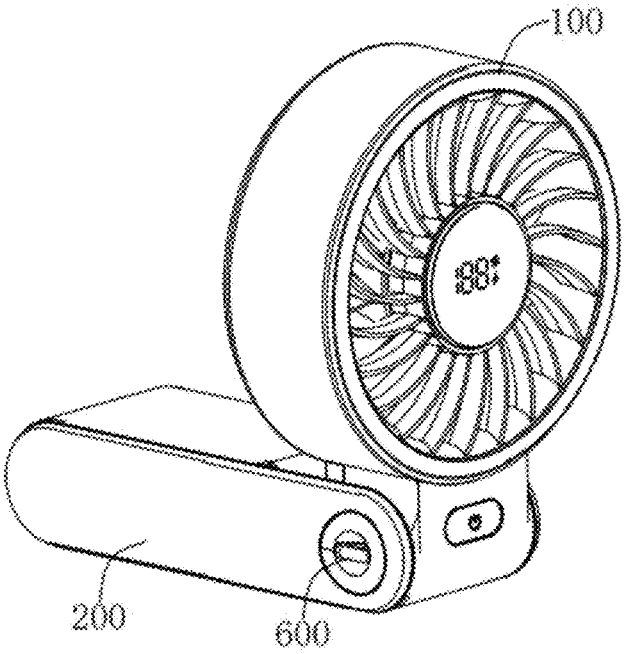
FIG. 7 is a second schematic structural diagram after a fan main body rotates in this embodiment.
Figure 8:
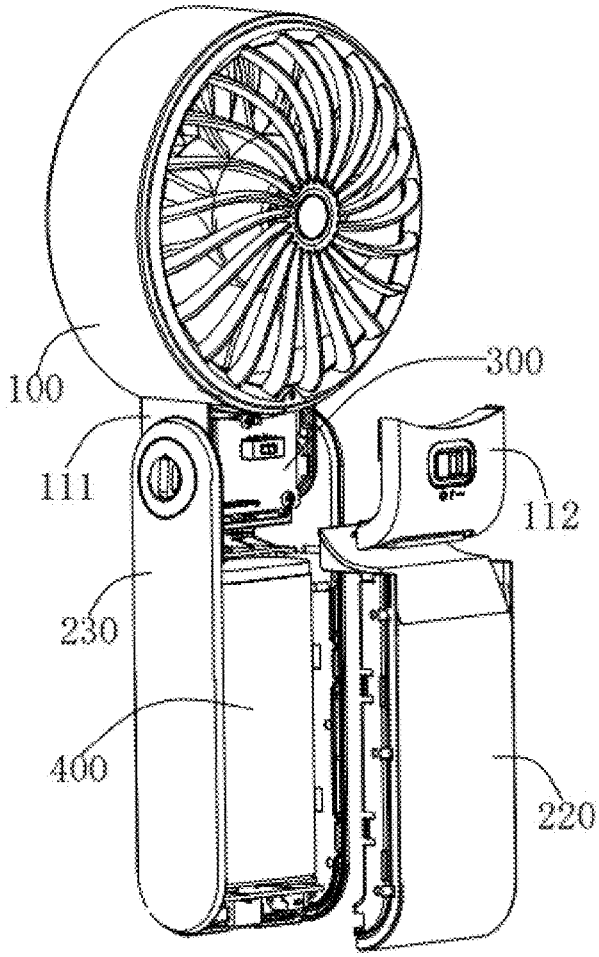
FIG. 8 is a first exploded diagram of an entire structure according to this embodiment.
Figure 9:
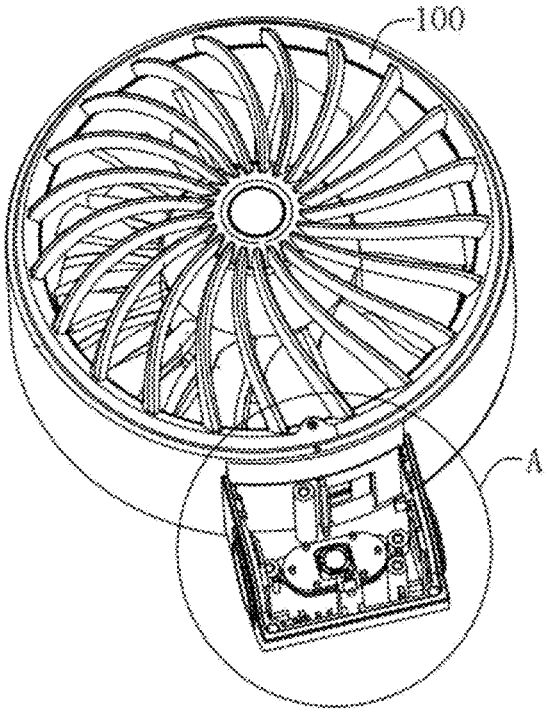
FIG. 9 is a schematic structural diagram of a fan main body from which a cover body is removed in this embodiment.
Figure 10:
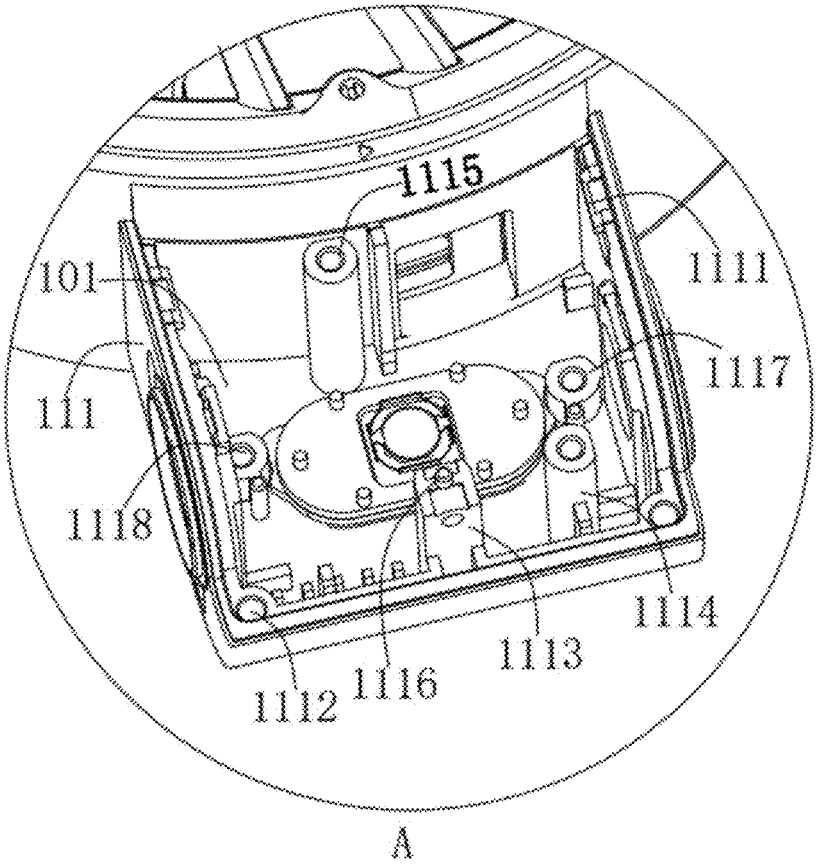
FIG. 10 is an enlarged view of corresponding part A in FIG. 9.
Figure 11:
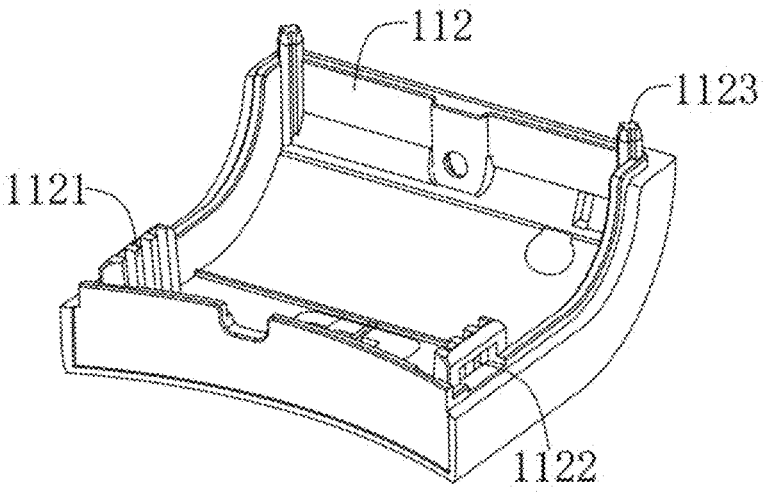
FIG. 11 is a schematic structural diagram of a cover body in this embodiment.
Figure 12:
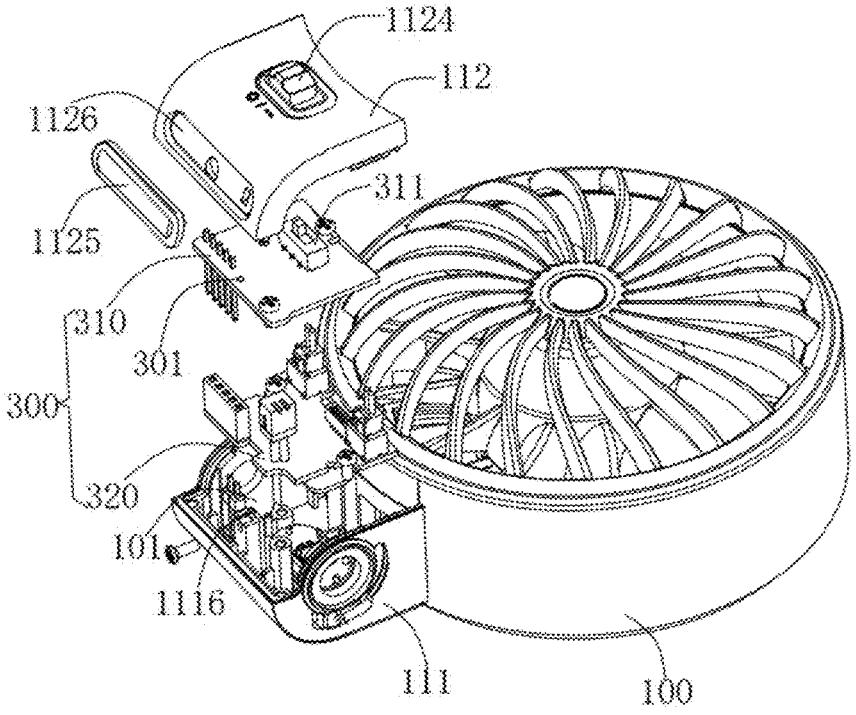
FIG. 12 is an exploded diagram of a control circuit board and a connection portion on a fan main body in this embodiment.

Specifically, the fan main body 100 is rotatably assembled with the handheld handle 200, so that a user can independently adjust an air supply direction of the fan main body 100. It should be noted that the fan main body 100 can rotate clockwise or counterclockwise relative to the handheld handle 200. Referring to FIG. 6, the fan main body 100 rotates clockwise relative to the handheld handle 200 to allow the user to adjust an air supply angle of the fan main body 100 when the fan is used on the neck. Referring to FIG. 7, after the fan main body 100 rotates counterclockwise relative to the handheld handle 200, the handheld handle 200 can be used as a base of the fan main body 100, so that the handheld fan can be placed on a desktop or another tabletop for use, thus achieving diversified use of the handheld fan.

Referring to FIG. 8 to FIG. 12, in one embodiment, a connection part 110 is arranged on one side of the fan main body 100 that is close to the handheld handle 200. The connection part 110 includes a connection body 111 and a cover body 112. One end of the connection body 111 is connected to the fan main body 100, and another end extends towards one side of the handheld handle 200. A first mounting cavity 101 is provided in the connection body 111. The cover body 112 is connected to the connection body 111, thereby sealing the first mounting cavity 101.

In one embodiment, the connection body 111 is integrally formed with the fan main body 100. In other embodiments, a connection way for the connection body 111 and the fan main body 100 can also be adhered fixing, screw fixing, snap connection, or the like.

Referring to FIG. 8 to FIG. 12, in one embodiment, a clamping part 1121 is arranged on one side of the cover body 112 that is close to the fan main body 100, and a clamping slot 1122 is provided in the clamping part 1121. A clamping head 1111 is arranged in a manner of protruding out of an inner side wall of the connection body 111 that is close to the fan main body 100. The clamping head 1111 is configured to adapt to the clamping slot 1122, thereby implementing fixed assembling between the cover body 112 and the connection body 111.

Referring to FIG. 8 to FIG. 12, in this embodiment, there are two clamping parts 1121 and two clamping slots 1122. Correspondingly, two clamping heads 1111 are also provided. In other embodiments, the clamping slot 1122 can also be provided in the connection body 111, and the clamping head 1111 can be arranged on the cover body.

Referring to FIG. 8 to FIG. 12, in one embodiment, an insertion column 1123 is arranged on one side of the cover body 112 that is away from the fan main body 100. An insertion port 1112 is correspondingly provided in one side of the connection body 111 that is away from the fan main body 100. The insertion port 1112 adapts to the insertion column 1123, so that positioning and pre-fixing functions are provided for the assembling between the cover body 112 and the connection body 111, to perform clamping assembling on the clamping slot 1122 and the clamping head 1111.

Referring to FIG. 8 to FIG. 12, in one embodiment, a first long fixing column 1113 is arranged in a manner of protruding out of one side, away from the fan main body 100, of a bottom of the first mounting cavity 101. The side of the cover body 112 that is away from the fan main body 100 is further fixedly assembled with the first long fixing column 1113 through a fastening screw.

It should be noted that to assemble the cover body 112 with the connection body 111, the cover body 112 and the connection body 111 are fixed at mounting positions first through insertion assembling of the insertion port 1112 and the insertion column 1123. Then, the cover body 112 is pressed to move towards one side of the connection body 111, and the clamping head 1111 cooperates with the clamping slot 1112, thereby fixedly assembling the side of the cover body 112 that is close to the fan main body 100. Finally, the cover body 112 and the connection body 111 are finally fixedly assembled by making the fastening screw pass through a threaded hole in the cover body 112 and a threaded hole in the first long fixing column 1113. In this way, the cover body 112 and the connection body 111 can effectively improve firmness of the assembling between the cover body 112 and the connection body 111.

Referring to FIG. 8 to FIG. 12, in one embodiment, an over-rotation prevention component 1125 is assembled on the cover body 112, and an assembling column (not shown in the figure) is arranged on the side of the over-rotation prevention component 1125 that is close to the cover body 112. The assembling column penetrates into the cover body 112 and is in interference fit with the cover body 112.

In this embodiment, the over-rotation prevention component 1125 is a rubber component, and the cover body 112 is provided with a strip-shaped slot 1126 for accommodating the over-rotation prevention component 1125. A head portion of the fastening screw for fastening the cover body 112 and the connection body 111 is located in the strip-shaped slot 1126. The arrangement of the over-rotation prevention component 1125 can cover the fastening screw to ensure an aesthetic appearance of the fan main body 100.

Referring to FIG. 8 to FIG. 12, in one embodiment, a control circuit board 300 is mounted inside the mounting cavity 101. The control circuit board 300 includes a first circuit board 301 and a second circuit board 302.

Specifically, the second circuit board 302 is located at a bottom of the first mounting cavity 101 and is fixed to a bottom wall of the first mounting cavity 101 by a fastening screw. The first circuit board 301 is supported on a second long fixing column 1114 and a third long fixing column 1115, and is fixedly assembled with the second long fixing column 1114 and the third long fixing column 1115 through a fastening screw (not shown in the figure).

Referring to FIG. 8 to FIG. 12, in one embodiment, a positioning protrusion 1116 is arranged at a top of the first long fixing column 1113, and a positioning hole 301 adapting to the positioning protrusion 1116 is provided in the first circuit board 310. During assembling of the first circuit board 310, the positioning protrusion 1116 and the positioning hole 301 are used for positioning, to facilitate the assembling of the fastening screw with the second long fixing column 1114 and the third long fixing column 1115.

Referring to FIG. 8 to FIG. 12, in another embodiment, a first short fixing column 1117 and a second short fixing column 1118 are further arranged at the bottom of the first mounting cavity 101. The second circuit board 320 is fixedly assembled with the first short fixing column 1117 and the second short fixing column 1118 through a fastening screw (not shown in the figure).

Referring to FIG. 8 to FIG. 12, in one embodiment, a gear switch 311 is arranged on the first circuit board 310. A gear button 1124 is arranged on the cover body 112. The gear button 1124 is sleeved with the gear switch 311 through the cover body 112. The second circuit board 320 is provided with a power switch (not shown in the figure). The connection body 111 is provided with a power button 1119 (refer to FIG. 20). The power button 1119 is sleeved with the power switch through the connection body 111.

Figure 13:
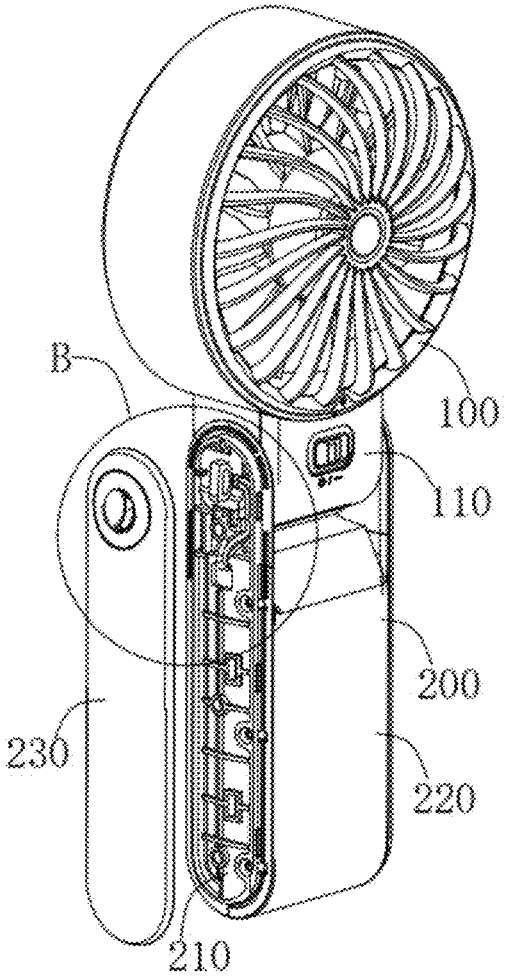
FIG. 13 is a second exploded diagram of an entire structure according to this embodiment.
Figure 14:
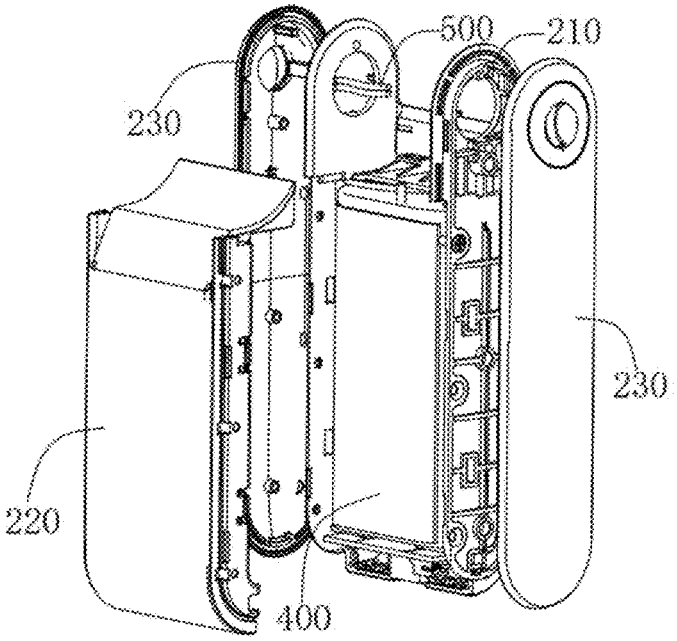
FIG. 14 is an exploded diagram of a handheld handle in this embodiment.
Figure 15:
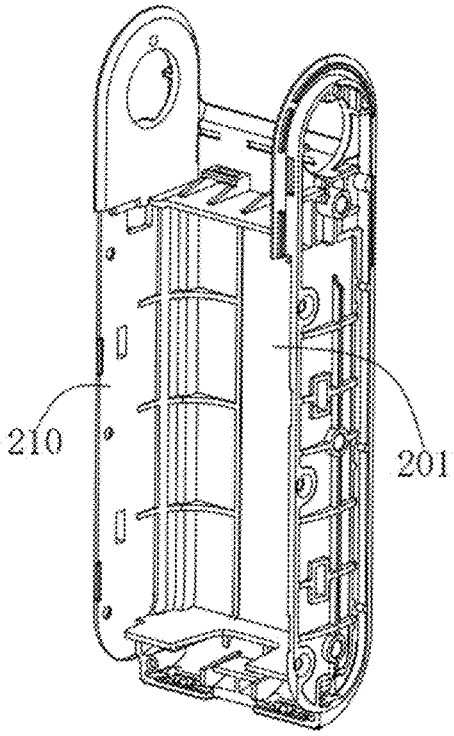
FIG. 15 is a schematic structural diagram of a bottom cover in a handheld handle in this embodiment.
Figure 16:
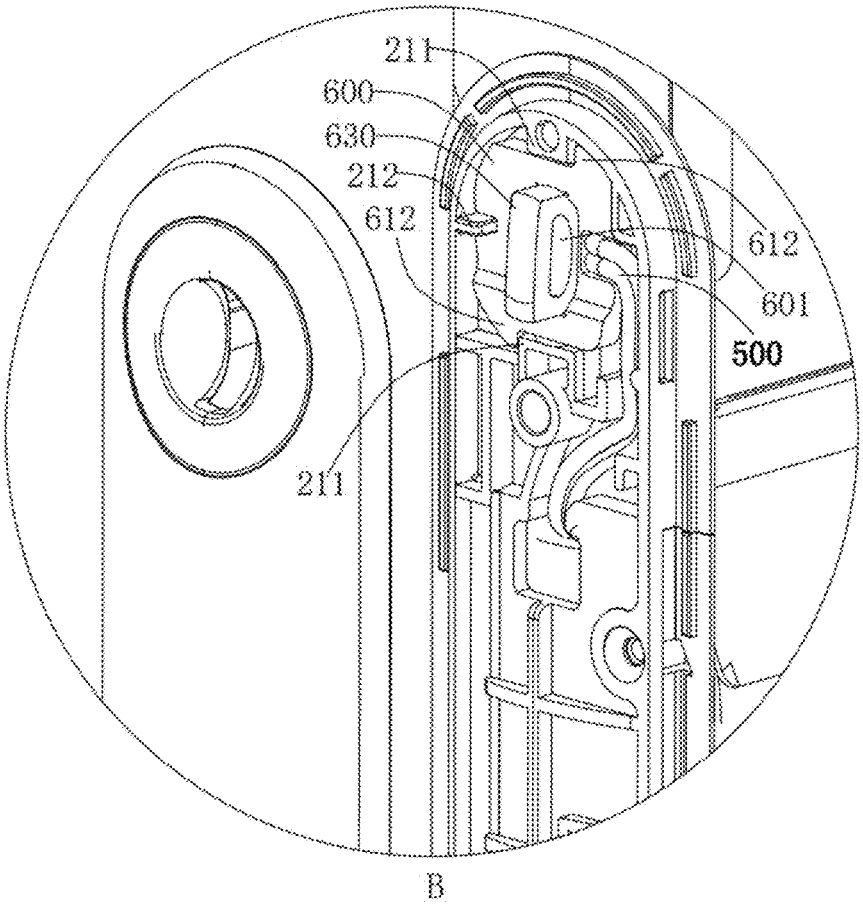
FIG. 16 is an enlarged view of corresponding part B in FIG. 13.

Referring to FIG. 13 to FIG. 14, in one embodiment, the handheld handle 200 includes a bottom cover 210, a top cover 220, and a side cover 230. Specifically, one side of the bottom cover 210 that is close to the fan main body 100 is rotatably assembled with the connection part 110, and a second mounting cavity 201 is provided in the bottom cover 210. The top cover 220 and the bottom cover 210 can be detachably assembled to seal the second mounting cavity 201. There are two side covers 230, both of which are in clamping fit with the bottom cover 210.

It should be noted that a power source 400 is arranged inside the second mounting cavity 201, and the power source 400 is electrically connected to the control circuit board 300 through a wire 500. The detachable assembling or clamping fit between the bottom cover 210, the top cover 222, and the side cover 230 is the prior art in this art and will not be elaborated in this embodiment.

Referring to FIG. 13, in one embodiment, the handheld fan further includes a rotary connection piece 600. One part of the rotary connection piece 600 is connected to the fan main body 100, and another part is connected to the handheld handle 200. The rotary connection piece 600 is configured to implement rotatable assembling between the fan main body 100 and the handheld handle 200. In other embodiments, an integrally formed rotating shaft structure can be arranged in a manner of protruding out of the handheld handle 200, or an integrally formed rotating shaft structure can be arranged in a manner of protruding out of the fan main body 100, to implement the rotatable assembling between the fan main body 100 and the handheld handle 200 through the rotating shaft structure.

Referring to FIG. 13, FIG. 16, FIG. 17, and FIG. 18, further, the rotary connection piece 600 includes a fixed part 610, a rotating shaft part 620, and a mounting lug 630. Specifically, the fixed part 610 is connected to the handheld handle 200, and the fixed part 610 is limited within a housing on one side of the handheld handle 200 that is close to the fan main body 100. It should be noted that when the fan main body 100 and the handheld handle 200 undergo relative motion, the fixed part 610 and the handheld handle 200 always remain relatively stationary. The rotating shaft part 620 is connected to one end of the fixed part 610, and the rotating shaft part 620 is rotatably assembled with the fan main body 100 through the handheld handle 200. The mounting lug 630 is connected to one side of the fixed part 610 that is away from the rotating shaft part 620, and the mounting lug 630 is provided with a rope hole 601. The rope hole 610 is used in conjunction with a hanging rope (not shown in the figure) to allow the handheld fan to be hung around a neck for use.

Referring to FIG. 13, FIG. 16, FIG. 17, and FIG. 18, in one embodiment, an avoidance slot 602 that extends axially is provided in the rotating shaft part 620. The avoidance slot 602 divides the rotating shaft part 620 radially into two parts. When the rotary connection piece 600 is assembled with the handheld handle 200 and the connection part 110, the two parts of the rotating shaft part 602 approach each other through elastic deformation, thereby reducing a size of the rotating shaft part 620. In this way, by the arrangement of the avoidance slot 602, an elastic deformation capability of the rotating shaft part 620 can be improved, thus facilitating the rotating shaft part 620 to be assembled with the connection part 110 through the handheld handle 200. In addition, by the arrangement of the avoidance slot 602, the wire 500 can be threaded, to facilitate the wire 500 to be connected to the control circuit board 300 and the power source 400.

Figure 17:
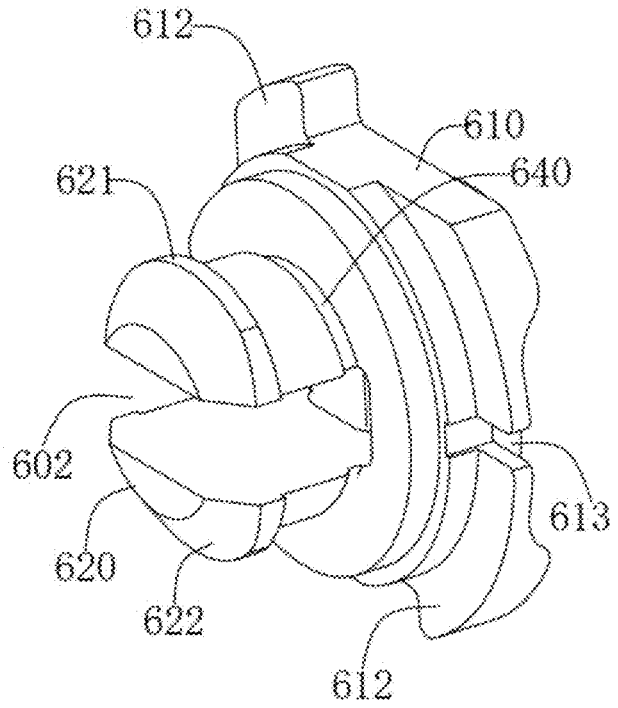
FIG. 17 is a first schematic structural diagram of a rotary connection piece in this embodiment.

Referring to FIG. 17, in one embodiment, an annular groove 640 is provided in a joint of the fixed part 610 and the rotating shaft part 620, and the annular groove 610 is also radially divided into two parts by the avoidance slot 602. The arrangement of the annular groove 604 can further improve the elastic deformation capability of the rotating shaft part 620, which is beneficial for mounting of the rotating shaft part 620.

Figure 18:
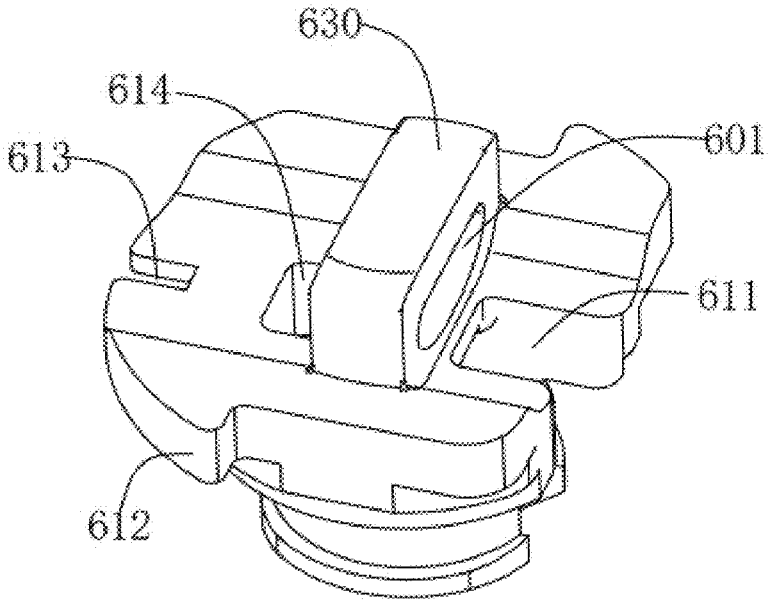
FIG. 18 is a second schematic structural diagram of a rotary connection piece in this embodiment.

Referring to FIG. 17 and FIG. 18, in one embodiment, a wire trough 611 is provided in the fixed part 610. The wire trough 611 extends radially from an edge of the fixed part 610 to a root of the mounting lug 630, and is communicated to the avoidance slot 604.

Referring to FIG. 17 and FIG. 18, in one embodiment, an end 621 is arranged on one side of the rotating shaft part 620 that is away from the fixed part 610, and a side wall of the end 621 is an inclined surface 622. A cross-sectional size of one side of the end 621 that is away from the fixed part 610 is less than a cross-sectional size of one side of the end 621 that is close to the fixed part 610, so that the rotating shaft part 620 can be inserted into the connection body 110 (refer to FIG. 13).

It should be noted that after the rotating shaft part 620 is threaded into the connection part 110, an end surface of the end 621 that is close to the fixed part 610 resists against an inner side wall of the connection part 110, thereby fixing the rotating shaft part 620 and the connection part 110.

Referring to FIG. 13, FIG. 16, FIG. 17, and FIG. 18, in one embodiment, a limiting end 612 is arranged on the fixed part 610, and a limiting part 211 is arranged on one side, close to the connection part 110, of the bottom cover 210 of the handheld handle 200. When the handheld handle 200 rotates relative to the fan main body 100, the fixed part 610 cooperates with the limiting part 211 through the limiting end 612, to keep the fixed part relatively stationary with the handheld handle 200. In this embodiment, there are two limiting ends 612. The two limiting ends 612 are arranged symmetrically around an axis center of the rotary connection piece 600. Correspondingly, the bottom cover 210 is also provided with two limiting parts 211.

Continuing to refer to FIG. 13, FIG. 16, FIG. 17, and FIG. 18, in one embodiment, a positioning block 212 is arranged on the bottom cover 210 of the handheld handle 200, and a positioning slot 613 adapting to the positioning block 212 is provided in the fixed part 610. During the assembling of the rotary connection piece 600, cooperation between the positioning block 212 and the positioning slot 613 can avoid a situation of reverse mounting of the two limiting ends 612.

Figure 19:
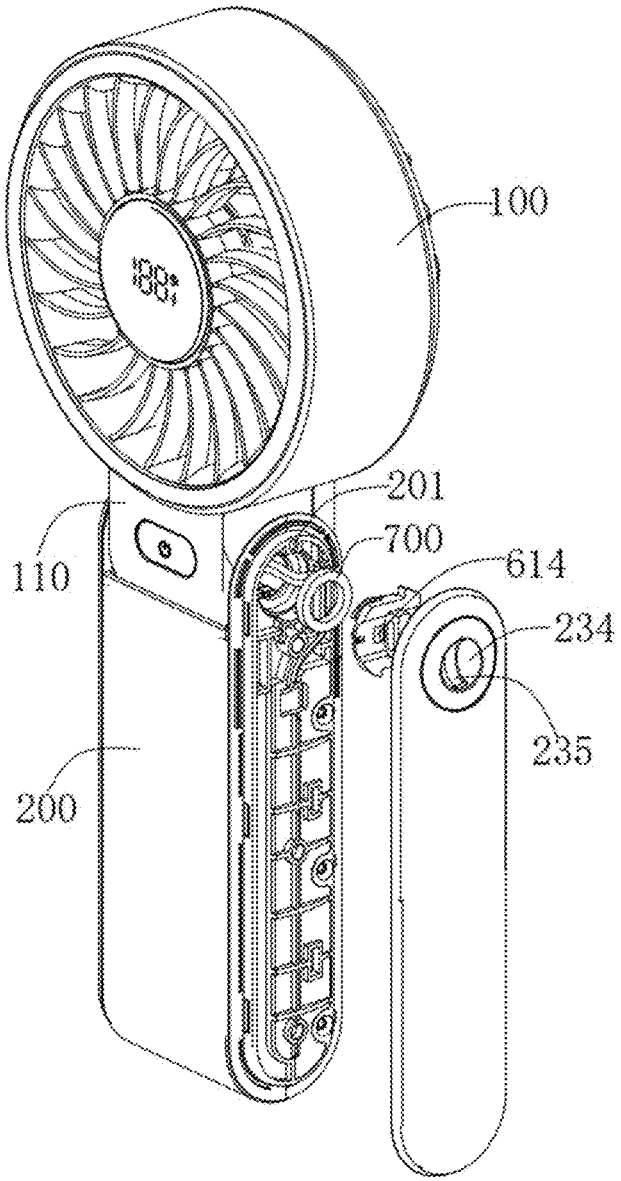
FIG. 19 is a third exploded diagram of an entire structure in this embodiment.

Referring to FIG. 19, in one embodiment, a damping rubber ring 700 is arranged between the rotating shaft part 620 and the connection part 110 to implement damping connection between the rotating shaft part 620 and the connection part 110. In this way, the fan main body 100 can be fixed at any position after rotation, which is beneficial for adjusting the air supply angle of the fan main body 100.

Figure 20:
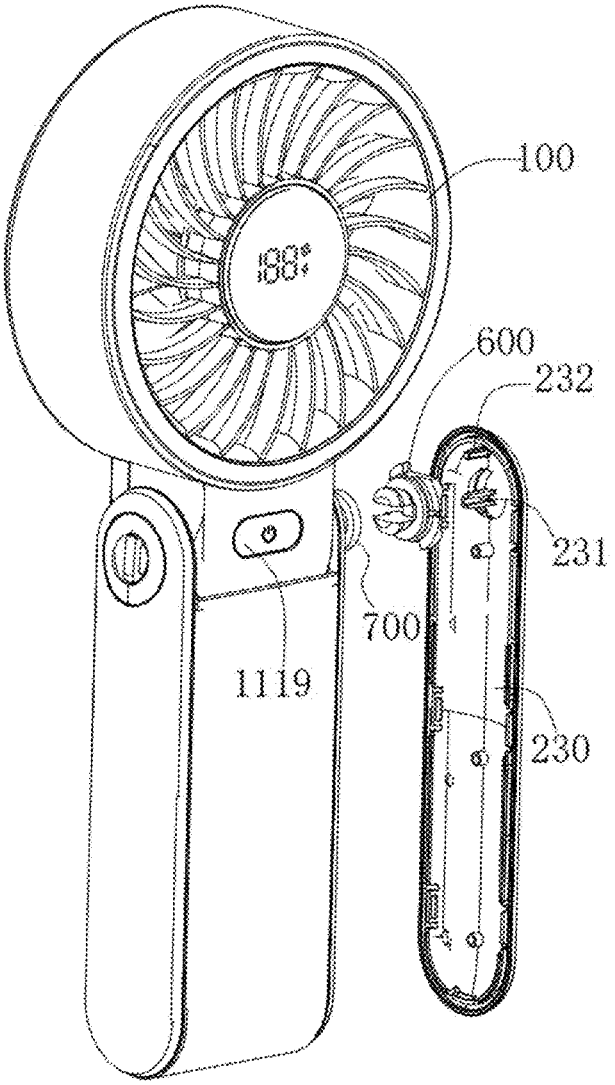
FIG. 20 is a fourth exploded diagram of an entire structure in this embodiment.

Referring to FIG. 19 and FIG. 20, in one embodiment, an insertion column 231 is arranged on an inner side wall of the side cover 230, and the insertion column 231 protrudes towards one side of the connection part 110. An insertion slot 614 is provided in the fixed part 610. During the assembling of the side cover 230 and the bottom cover 210, the insertion column 231 is inserted into the insertion slot 614 to further improve the firmness of connection between the rotary connection piece 600 and the handheld handle 200, as well as the fan main body 100, thereby preventing latching rebound of the rotary connection piece 600.

Referring to FIG. 19 and FIG. 20, in one embodiment, a spherical groove 234 is provided in one side of the side cover 230 that is close to the fan main body 211, and a through slot 235 is provided in a bottom of the spherical groove 234. The mounting lug 630 is accommodated in the spherical groove 234 through the through slot 235.

Figure 21:
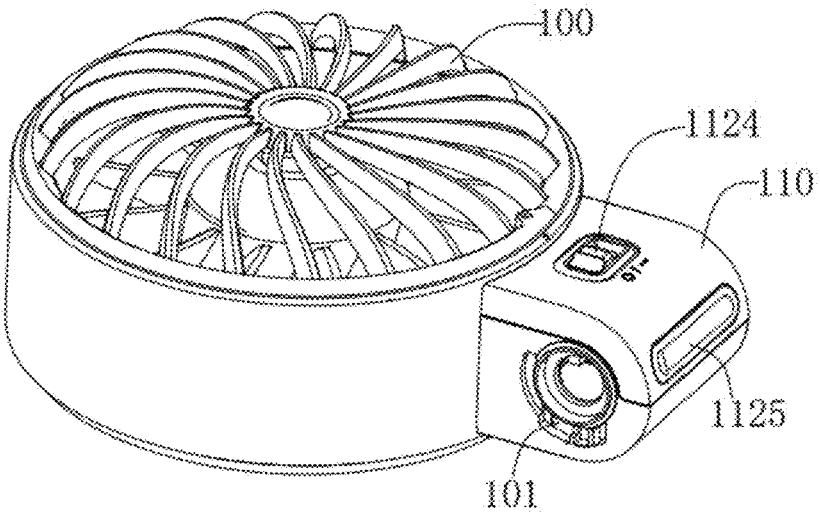
FIG. 21 is a schematic structural diagram of a fan main body in this embodiment.

Referring to FIG. 19 to FIG. 21, in one embodiment, a limiting slot 101 is provided in the connection part 110. A mounting hole 201 is provided in one side of the bottom cover 210 that is close to the fan main body 100, and a limiting column 233 is arranged on one side of the side cover 230 that is close to the bottom cover 210. The limiting column 233 is threaded into the mounting hole 201, and an end portion of the limiting column 233 that is away from the side cover 230 is accommodated in the limiting slot 101, to cooperate with the limiting slot 101 to limit a rotation angle between the fan main body 100 and the handheld handle 200.

Solution III

Figure 22:
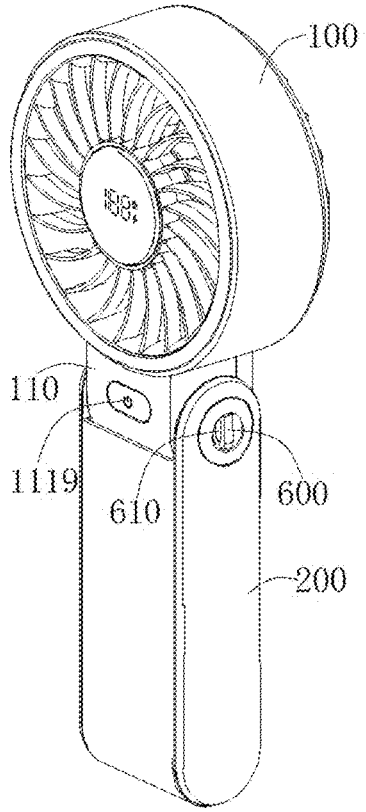
FIG. 22 is a schematic diagram of an entire structure according to this embodiment.
Figure 23:
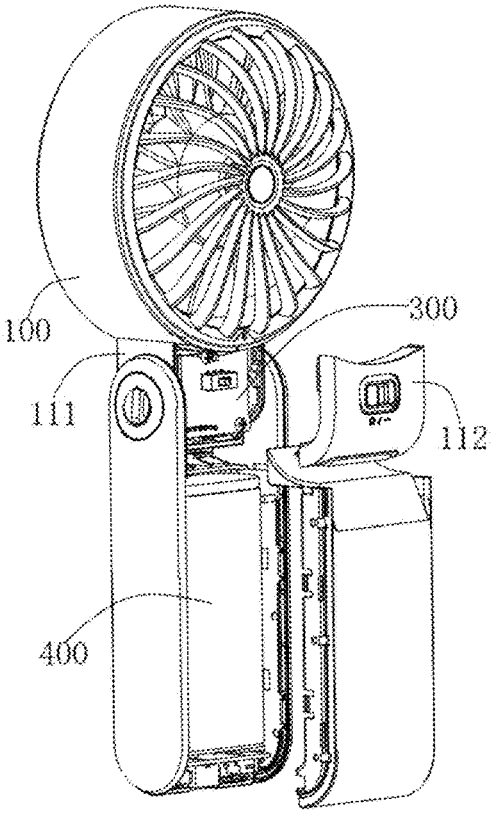
FIG. 23 is a first exploded diagram according to this embodiment.

This embodiment relates to a handheld fan which has a small volume, is rechargeable, and is convenient for a user to carry around. Referring to FIG. 22 and FIG. 23, the handheld fan includes a fan main body 100, a handheld handle 200, a control circuit board 300, and a power source 400.

Referring to FIG. 22 to FIG. 29, specifically, a connection part 110 is arranged on the fan main body 100. The connection part 110 has a first mounting cavity 101 inside. The handheld handle 200 is connected to the connection part 110, and a second mounting cavity 201 is provided inside the handheld handle 200. The control circuit board 300 is mounted inside the first mounting cavity 101, and is electrically connected to the fan main body 100 to control the fan main body 100. The power source 400 is mounted inside the second mounting cavity 201 and is electrically connected to the control circuit board 300 through a wire 500.

Figure 28:
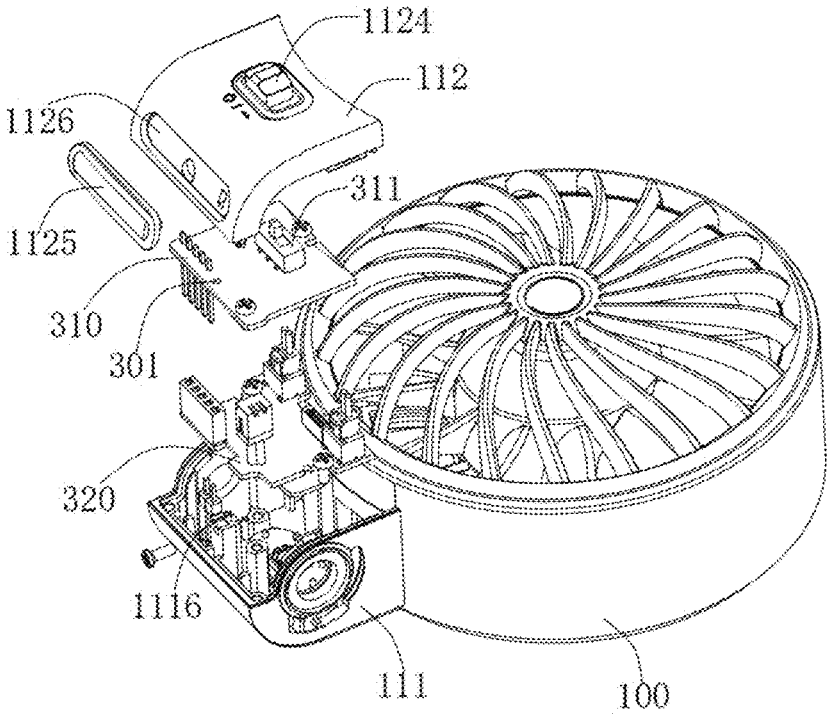
FIG. 28 is an exploded diagram of a fan main body and a control circuit board in this embodiment.
Figure 29:
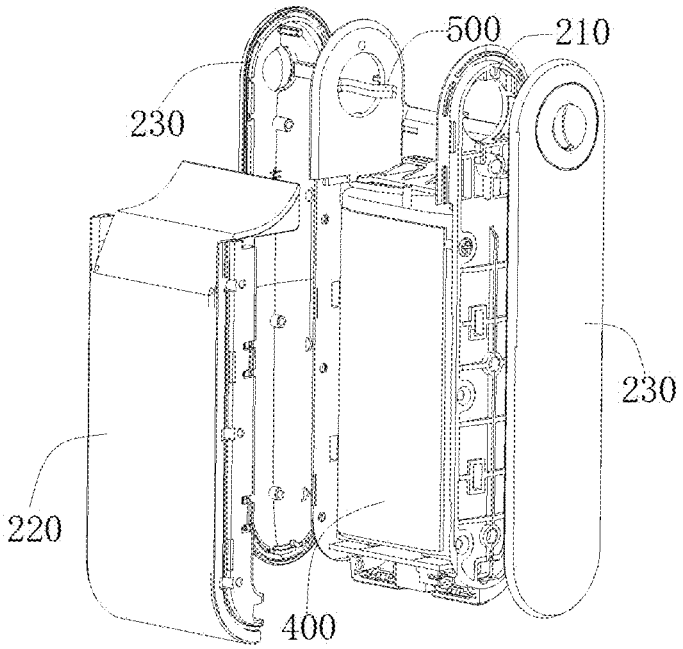
FIG. 29 is an exploded diagram of a handheld handle and a power source in this embodiment.

Referring to FIG. 28 and FIG. 29, it should be noted that the first mounting cavity 101 and the second mounting cavity 201 are both independent cavities. In this way, a problem of damage to elements on the control circuit board 300 because of electromagnetic interference caused by power supplying performed by the power source 400 on the control circuit board 300 can be effectively prevented. Furthermore, the power source 400 and the control circuit board 300 can generate heat during working, so that respectively arranging them in the different independent cavities can further enhance a cooling effect of the handheld fan.

Figure 24:
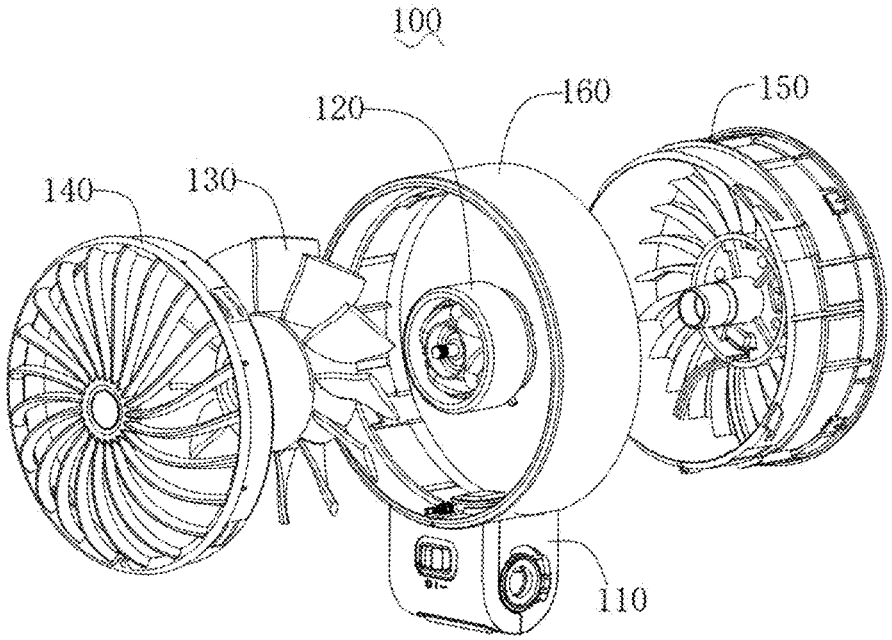
FIG. 24 is an exploded diagram of a fan main body in this embodiment.

Referring to FIG. 24, more specifically, the fan main body 100 includes a rotating motor 120, a fan blade 130, a front cover 140, a rear cover 150, and a shell 160. A stator (not shown in the figure) of the rotating motor 120 is fixedly assembled with the front cover 140. A rotor of the rotating motor 120 is fixedly assembled with the fan blade 130. The front cover 140 is detachably assembled with an inner side wall of the shell 160 through a clamping structure. The rear cover 150 is also detachably assembled with the inner side wall of the shell 160 through a clamping structure. It is worth noting that the detachable assembling between the front cover 140, as well as the rear cover 150, and the shell 160 is the prior art, and will not be elaborated here.

Figure 25:
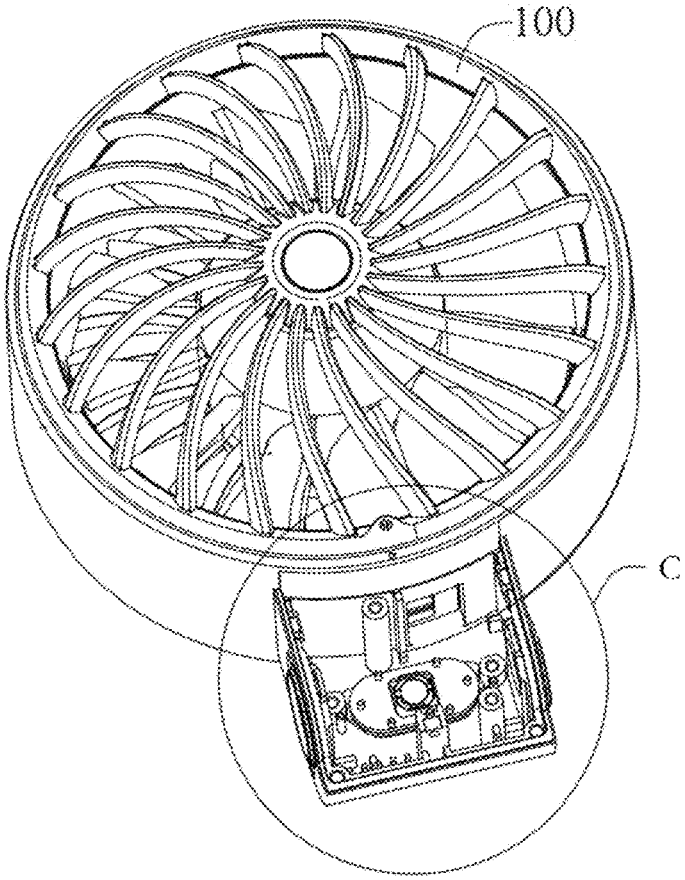
FIG. 25 is a schematic structural diagram after a cover body and a control circuit board are removed in this embodiment.
Figure 26:
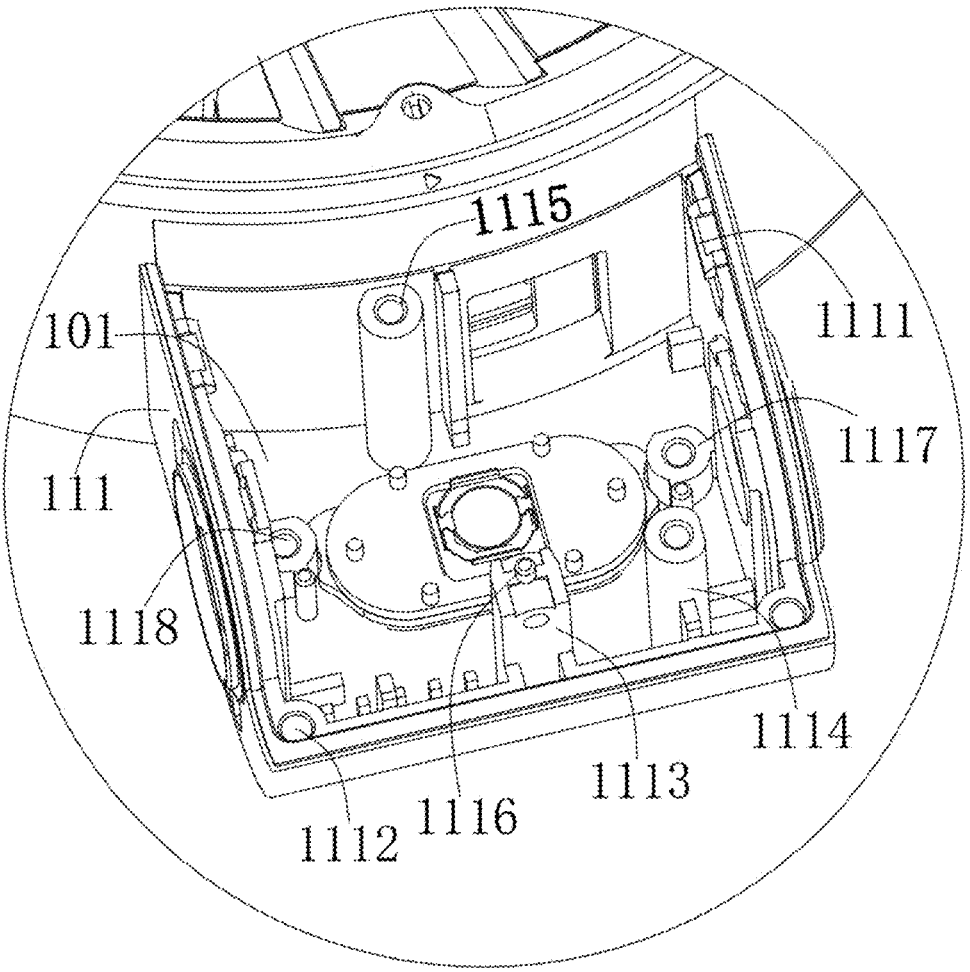
FIG. 26 is an enlarged view of corresponding part C in FIG. 25.
Figure 27:
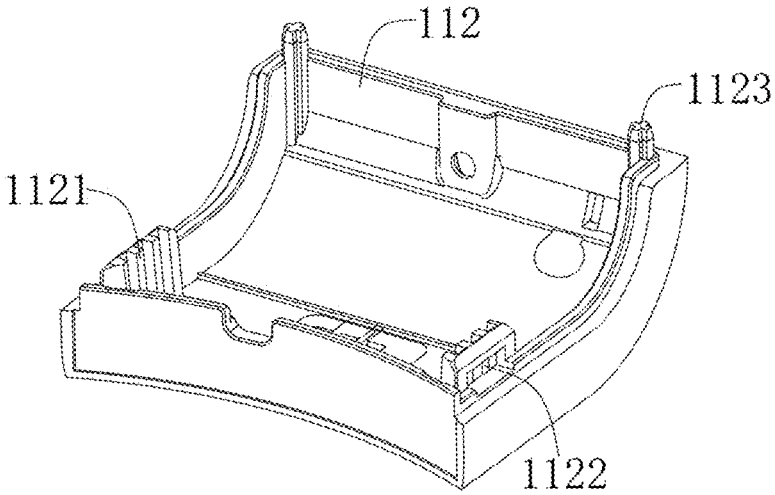
FIG. 27 is a schematic structural diagram of a cover body in this embodiment.

Referring to FIG. 25, FIG. 26, and FIG. 27, in one embodiment, the connection part 110 includes a connection body 111 and a cover body 112. One end of the connection body 111 is connected to the shell 160, and another end extends towards one side of the handheld handle 200. A first mounting cavity 101 is provided in the connection body 111. The cover body 112 is connected to the connection body 111, thereby sealing the first mounting cavity 101.

In one embodiment, the connection body 111 is integrally formed with the shell 160. In other embodiments, a connection way for the connection body 111 and the shell 160 can also be adhered fixing, screw fixing, snap connection, or the like.

Referring to FIG. 25, FIG. 26, and FIG. 27, in one embodiment, a clamping part 1121 is arranged on one side of the cover body 112 that is close to the fan main body 100, and a clamping slot 1122 is provided in the clamping part 1121. A clamping head 1111 is arranged in a manner of protruding out of an inner side wall of the connection body 111 that is close to the fan main body 100. The clamping head 1111 is configured to adapt to the clamping slot 1122, thereby implementing fixed assembling between the cover body 112 and the connection body 111.

Referring to FIG. 25, FIG. 26, and FIG. 27, in this embodiment, there are two clamping parts 1121 and two clamping slots 1122. Correspondingly, two clamping heads 1111 are also provided. In other embodiments, the clamping slot 1122 can also be provided in the connection body 111, and the clamping head 1111 can be arranged on the cover body.

Referring to FIG. 25, FIG. 26, and FIG. 27, in one embodiment, an insertion column 1123 is arranged on one side of the cover body 112 that is away from the fan main body 100. An insertion port 1112 is correspondingly provided in one side of the connection body 111 that is away from the fan main body 100. The insertion port 1112 adapts to the insertion column 1123, so that positioning and prefixing functions are provided for the assembling between the cover body 112 and the connection body 111, to perform clamping assembling on the clamping slot 1122 and the clamping head 1111.

Referring to FIG. 25, FIG. 26, and FIG. 27, in one embodiment, a first long fixing column 1113 is arranged in a manner of protruding out of one side, away from the fan main body 100, of a bottom of the first mounting cavity 101. The side of the cover body 112 that is away from the fan main body 100 is further fixedly assembled with the first long fixing column 1113 through a fastening screw.

It should be noted that to assemble the cover body 112 with the connection body 111, the cover body 112 and the connection body 111 are fixed at mounting positions first through insertion assembling of the insertion port 1112 and the insertion column 1123. Then, the cover body 112 is pressed to move towards one side of the connection body 111, and the clamping head 1111 cooperates with the clamping slot 1112, thereby fixedly assembling the side of the cover body 112 that is close to the fan main body 100. Finally, the cover body 112 and the connection body 111 are finally fixedly assembled by making the fastening screw pass through a threaded hole in the cover body 112 and a threaded hole in the first long fixing column 1113. In this way, the cover body 112 and the connection body 111 can effectively improve firmness of the assembling between the cover body 112 and the connection body 111.

Referring to FIG. 25 to FIG. 28, in one embodiment, a second long fixing column 1114 and a third long fixing column 1115 are further arranged at the bottom of the first mounting cavity 101. The control circuit board 300 includes a first circuit board 301 and a second circuit board 302.

Specifically, the second circuit board 302 is located at a bottom of the first mounting cavity 101 and is fixed to a bottom wall of the first mounting cavity 101 by a fastening screw. The first circuit board 301 is supported on a second long fixing column 1114 and a third long fixing column 1115, and is fixedly assembled with the second long fixing column 1114 and the third long fixing column 1115 through a fastening screw (not shown in the figure).

Referring to FIG. 25 to FIG. 28, in one embodiment, a positioning protrusion 1116 is arranged at a top of the first long fixing column 1113, and a positioning hole 301 adapting to the positioning protrusion 1116 is provided in the first circuit board 310. During assembling of the first circuit board 310, the positioning protrusion 1116 and the positioning hole 301 are used for positioning, to facilitate the assembling of the fastening screw with the second long fixing column 1114 and the third long fixing column 1115.

Referring to FIG. 25 to FIG. 28, in another embodiment, a first short fixing column 1117 and a second short fixing column 1118 are further arranged at the bottom of the first mounting cavity 101. The second circuit board 320 is fixedly assembled with the first short fixing column 1117 and the second short fixing column 1118 through a fastening screw (not shown in the figure).

Referring to FIG. 25 to FIG. 28, in one embodiment, a gear switch 311 is arranged on the first circuit board 310. A gear button 1124 is arranged on the cover body 112. The gear button 1124 is sleeved with the gear switch 311 through the cover body 112. The second circuit board 320 is provided with a power switch (not shown in the figure). The connection body 111 is provided with a power button 1119 (refer to FIG. 1). The power button 1119 is sleeved with the power switch through the connection body 111.

Referring to FIG. 22, FIG. 23, and FIG. 29, in one embodiment, the handheld handle 200 includes a bottom cover 210, a top cover 220, and a side cover 230. Specifically, one side of the bottom cover 210 that is close to the fan main body 100 is rotatably assembled with the connection part 110, and a second mounting cavity 201 is provided in the bottom cover 210. The top cover 220 and the bottom cover 210 can be detachably assembled to seal the second mounting cavity 201. There are two side covers 230, both of which are in clamping fit with the bottom cover 210. It should be noted that the power source 400 is mounted inside the second mounting cavity 201. The detachable assembling or clamping fit between the bottom cover 210, the top cover 222, and the side cover 230 is the prior art in this art and will not be elaborated in this embodiment.

Referring to FIG. 22, FIG. 23, and FIG. 29, it should be noted that the handheld handle 200 is connected to the fan main body 100 through a rotary member 600. The rotary member 600 is rotatably assembled with the connection body 111 through the handheld handle 200. A mounting lug 610 is arranged on one side of the rotary member 600 that is away from the handheld handle 200. A rope hole 601 is provided in the mounting lug 610 in a penetrating manner. A rope can pass through the mounting lug 610 and is fixed at its tail.

Referring to FIG. 23, FIG. 28, and FIG. 29, in one embodiment, an over-rotation prevention component 1125 is assembled on the cover body 112, and an assembling column (not shown in the figure) is arranged on the side of the over-rotation prevention component 1125 that is close to the cover body 112. The assembling column penetrates into the cover body 112 and is in interference fit with the cover body 112. In this embodiment, the over-rotation prevention component 1125 is a rubber component, and the cover body 112 is provided with a strip-shaped slot 1126 for accommodating the over-rotation prevention component 1125. A head portion of the fastening screw for fastening the cover body 112 and the connection body 111 is located in the strip-shaped slot 1126. The arrangement of the over-rotation prevention component 1125 can cover the fastening screw to ensure an aesthetic appearance of the fan main body 100.

Solution IV

Figure 30:
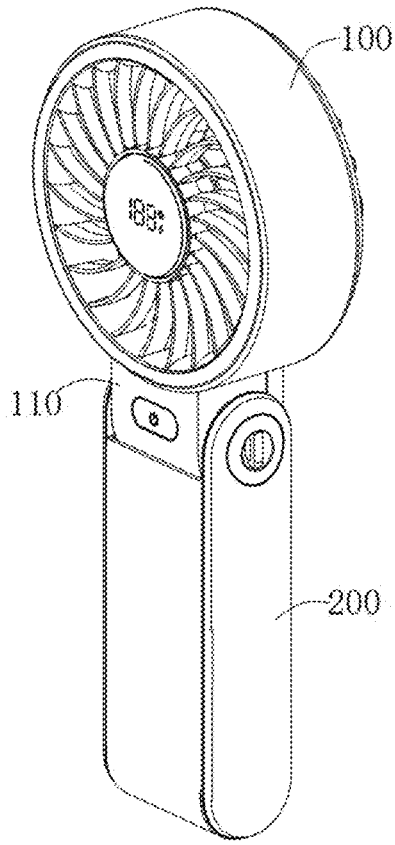
FIG. 30 is a schematic diagram of an entire structure according to this embodiment.

This embodiment relates to a handheld fan which has a small volume, is rechargeable, and is convenient for a user to carry around. Referring to FIG. 30, the handheld fan includes a fan main body 100 and a handheld handle 200.

Figure 31:
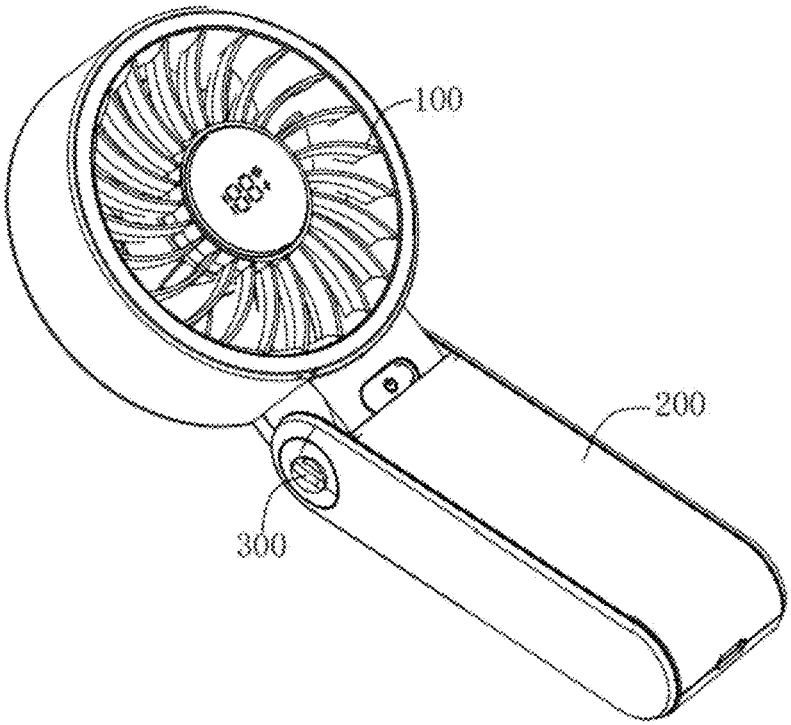
FIG. 31 is a first schematic structural diagram after a fan main body rotates in this embodiment.
Figure 32:
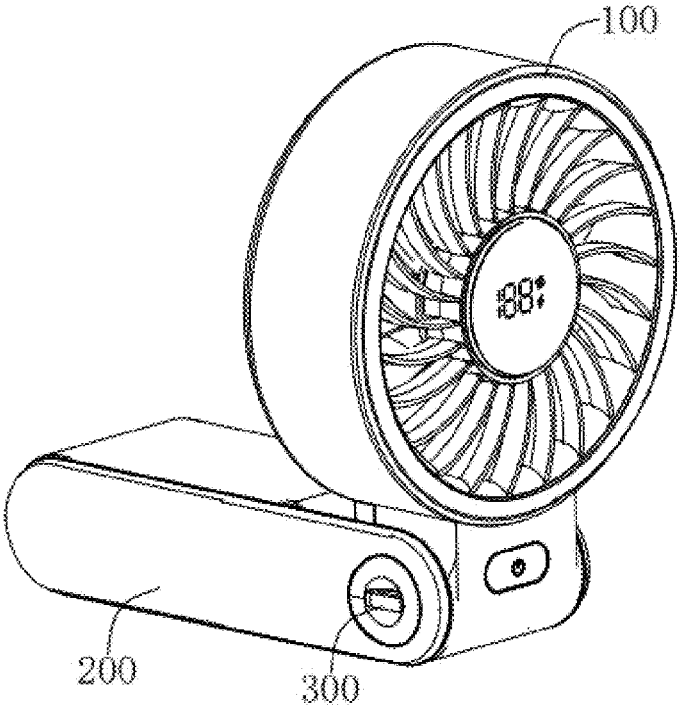
FIG. 32 is a second schematic structural diagram after a fan main body rotates in this embodiment.
Figure 33:
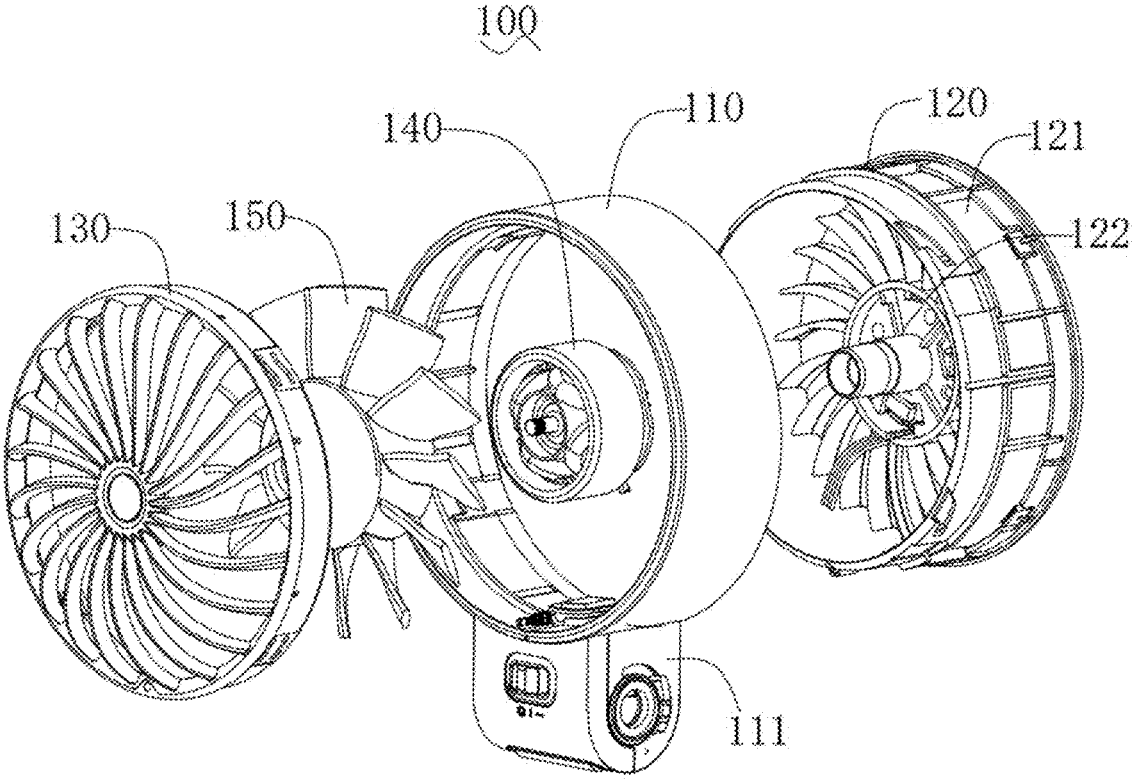
FIG. 33 is a first exploded diagram of a fan main body in this embodiment.

Specifically, the fan main body 100 is rotatably assembled with the handheld handle 200, so that a user can independently adjust an air supply direction of the fan main body 100. It should be noted that the fan main body 100 can rotate clockwise or counterclockwise relative to the handheld handle 200. Referring to FIG. 31, the fan main body 100 rotates clockwise relative to the handheld handle 200 to allow the user to adjust an air supply angle of the fan main body 100 when the fan is used on the neck. Referring to FIG. 32, after the fan main body 100 rotates counterclockwise relative to the handheld handle 200, the handheld handle 200 can be used as a base of the fan main body 100, so that the handheld fan can be placed on a desktop or another tabletop for use, thus achieving diversified use of the handheld fan.

Referring to FIG. 33 to FIG. 38, in one embodiment, the fan main body 100 includes an annular housing 110, a front guard 120, a rear guard 130, a driving motor 140, and a fan blade 150.

Specifically, a connection part 111 is arranged on one side of the annular housing 110 that is close to the handheld handle 200, and the connection part 111 is rotatably assembled with the handheld handle 200 through a rotating shaft component 300 (refer to FIG. 30). The rotating shaft component 300 is provided with a rope hole 310 for threading a hanging rope (not shown in the figure). One end of the front guard 120 is inserted from one end of the annular housing 110 and is detachably assembled with the annular housing 110. The rear guard 130 is inserted into a gap between the annular housing 110 and the front guard 120 from another end of the annular housing 110, and the rear guard 130 is detachably assembled with the part of the front guard 120 that is inserted into the annular housing 110. A fixed part of the driving motor 140 is fixedly assembled with the front guard 120, and a rotating part is assembled with the fan blade 150. The fan blade 150 can rotate synchronously with the rotating part.

It should be noted that in this embodiment, the hanging rope is the prior art. The detachable assembling between the annular housing 110 and the front guard 120 is also the prior art, such as clamped assembling, screw fixing, and rivet fixing, which will not be elaborated here.

Referring to FIG. 33 to FIG. 38, in one embodiment, the front guard 120 includes an outer frame 121, a center connection piece 122, and a plurality of air guide bars 123. The entire outer frame 121 is annular and is assembled with the annular housing 110. The center connection piece 122 is located at a center position of the outer frame 121 and is coaxial with the outer frame 121. One end of each of the plurality of air guide bars 123 is connected to an outer side wall of the center connection piece 122, and another end is connected to an inner side wall of the outer frame 121.

It should be noted that in this embodiment, among the plurality of air guide bars 123, a gap between adjacent air guide bars 123 close to the center connection piece 122 is less than a gap between adjacent air guide bars 123 close to the outer frame 121, and the outer frame 121, the center connection piece 122, and the air guide bars 123 are integrally formed.

Referring to FIG. 33 to FIG. 38, in one embodiment, a mounting hole 121*a* is provided in a manner of protruding out of an outer side wall of the outer frame 121, and an internal thread column 1211 is embedded in the mounting hole 121*a*. One side of the rear guard 130 that is close to the front guard 120 is inserted into a gap formed between the front guard 120 and an inner wall of the annular housing 110. The rear guard 130 is provided with a fixed part 131 corresponding to the internal thread column 1211, and the fixed part 131 is connected to the internal thread column 1211 through a fastener 131.

Referring to FIG. 33 to FIG. 39, in one embodiment, the center connection piece 122 includes a mounting part 1221 and a mounting column 1222. Specifically, a mounting slot 122*a* is provided in one side of the mounting part 1221 that is away from the mounting column. A first circuit board 160 is detachably assembled in the mounting slot 122*a*. A display screen 161 is arranged on one side of the first circuit board 160 that is away from the mounting column. The display screen 161 is configured to display a gear position of the handheld fan.

It should be noted that in this embodiment, the handheld fan has five gear positions. The first circuit board 160 and the display screen 161 are arranged on the center connection piece 122, so that the handheld fan can display gear position information during adjustment of the gear positions, making it convenient for a user to adjust a wind speed. In addition, the display screen 161 is arranged on the center connection piece 122, so that content displayed on the display screen 161 is arranged in a center position of the fan main body 100, which can facilitate the user to view a specific gear position during the adjustment of the wind speed.

Referring to FIG. 33 to FIG. 38, in one embodiment, a clamping column 122*b* and a fixing column 122*c* are arranged in a manner of protruding out of a bottom of the mounting slot 122*a*. One end of the first circuit board 160 resists against the clamping column 122*b*, and another end of the first circuit board 160 cooperates with the fixing column 122*c* for fixing through a fastening screw (not shown in the figure).

It should be noted that a top of the clamping column 122*b* has a protruding portion 122*d*, and the protruding portion 122*d* extends towards the first circuit board 160, while the first circuit board 160 is clamped in a gap between the protruding portion 122*d* and a slot bottom of the mounting slot 122*a*. The first circuit board 160 is provided with an arc-shaped notch 161. The fastening screw is in threaded fixation with the fixing column 122*c* after passing through the arc-shaped notch 161, thereby fixedly assembling another end of the first circuit board 160 (refer to FIG. 39) to the fixing column 122*c*.

Continuing to refer to FIG. 33 to FIG. 38, in one embodiment, a first limiting column 122*e*, a second limiting column 122*f*, and a third limiting column 122*g* are also arranged in the mounting slot 122*a*. The first circuit board 160 is provided with a first limiting notch 162 and a second limiting notch 163 that respectively adapt to the first limiting column 122*e* and the second limiting column 122*f*. The third limiting column 122*g* resists against an edge of the first circuit board 160 that is close to the third limiting column 122*g*.

Referring to FIG. 33 to FIG. 38, in one embodiment, the handheld fan further includes a transparent plate 170. A clamping part 171 is arranged on one side of the transparent plate 170 that is close to the mounting slot 122*a*. The clamping part 171 is provided with a clamping slot (not shown in the figure), and a clamping block 122*h* is arranged in a manner of protruding out of an inner side wall of the mounting slot 122*a*, and the clamping block 122*h* adapts to the clamping slot.

In this embodiment, there are three clamping parts 171, and the three clamping parts 171 are integrally formed with the transparent plate 170. Correspondingly, there are three clamping blocks 122*h*.

In one embodiment, a positioning block 122*i* is arranged in a manner of protruding out the inner side wall of the mounting slot 122*a*. A positioning slot 172 adapting to the positioning block 122*i* is provided in one side of the transparent plate 170 that is close to the mounting slot 122*a*. It is worth noting that during assembling of the transparent plate 170 and the mounting part 1221, the transparent plate 170 and the mounting part 1221 are first positioned through the cooperation of the positioning block 122*i* and the positioning slot 172, so that the position of the clamping part 171 and position of the clamping block 122*h* are aligned. In this way, the assembling of the transparent plate 170 and the mounting part 1221 can be completed by simply pressing the transparent plate 170.

Figure 38:
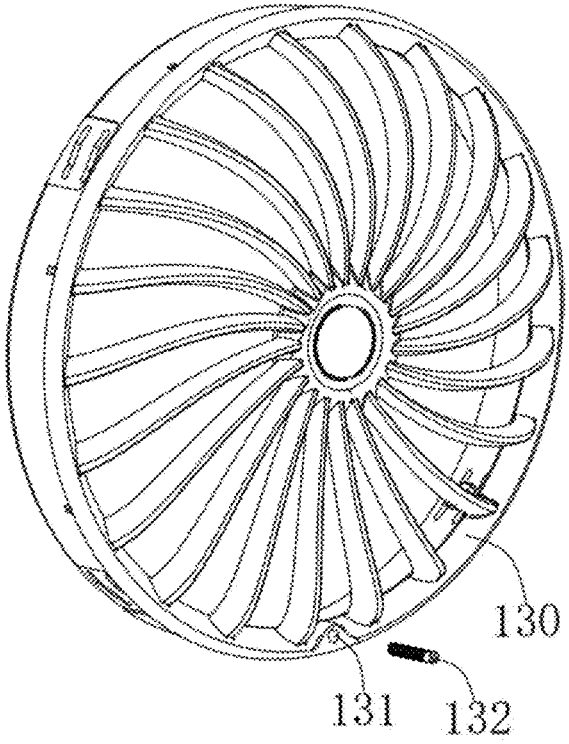
FIG. 38 is a schematic structural diagram of a rear guard in this embodiment.
Figure 39:
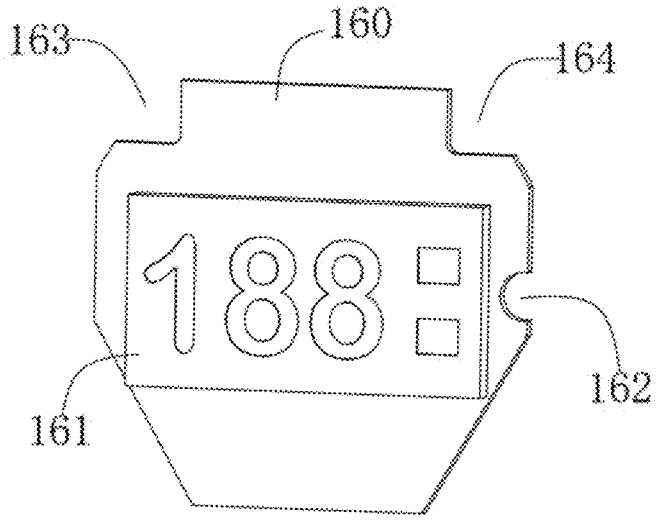
FIG. 39 is a schematic structural diagram of a first circuit board in this embodiment.
Figure 40:
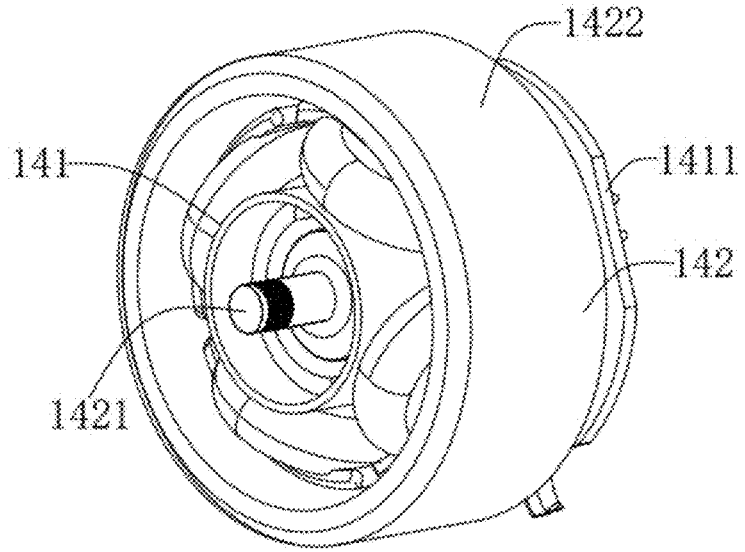
FIG. 40 is a schematic structural diagram of a driving motor in this embodiment.

Referring to FIG. 40, in one embodiment, a mounting channel 1201 is arranged on the mounting column 1222 in a penetrating manner in an axial direction (refer to FIG. 38). The fixed part of the driving motor 140 is a stator 141, and the rotating part is a rotor 142. In this embodiment, the stator 141 is fixedly sleeved with the mounting column 1222. The rotor 142 includes a rotating shaft 1421 and an annular magnet 1422. The rotating shaft 1421 is fixedly mounted in the mounting channel 1201 through a spring coil (not shown in the figure), and one side of the rotating shaft 1421 that is close to the fan blade 150 is fixedly assembled with the fan blades. A cylindrical groove 151 is provided in a center position of the fan blade 150, and the annular magnet 1422 is fixedly mounted inside the cylindrical groove 151. In this way, when the rotor 142 rotates, it can drive the fan blade 150 to rotate synchronously.

Referring to FIG. 33 to FIG. 38, in another embodiment, due to communication between the mounting channel 1201 and the mounting slot 122*a*, a dust-proof component 124 is arranged at the bottom of the mounting slot 122*a*. During use of the handheld fan, the arrangement of the dust-proof component 124 can effectively prevent dust from entering from the mounting slot 122*a* and effectively prolong the service life of the driving motor 140.

Figure 34:
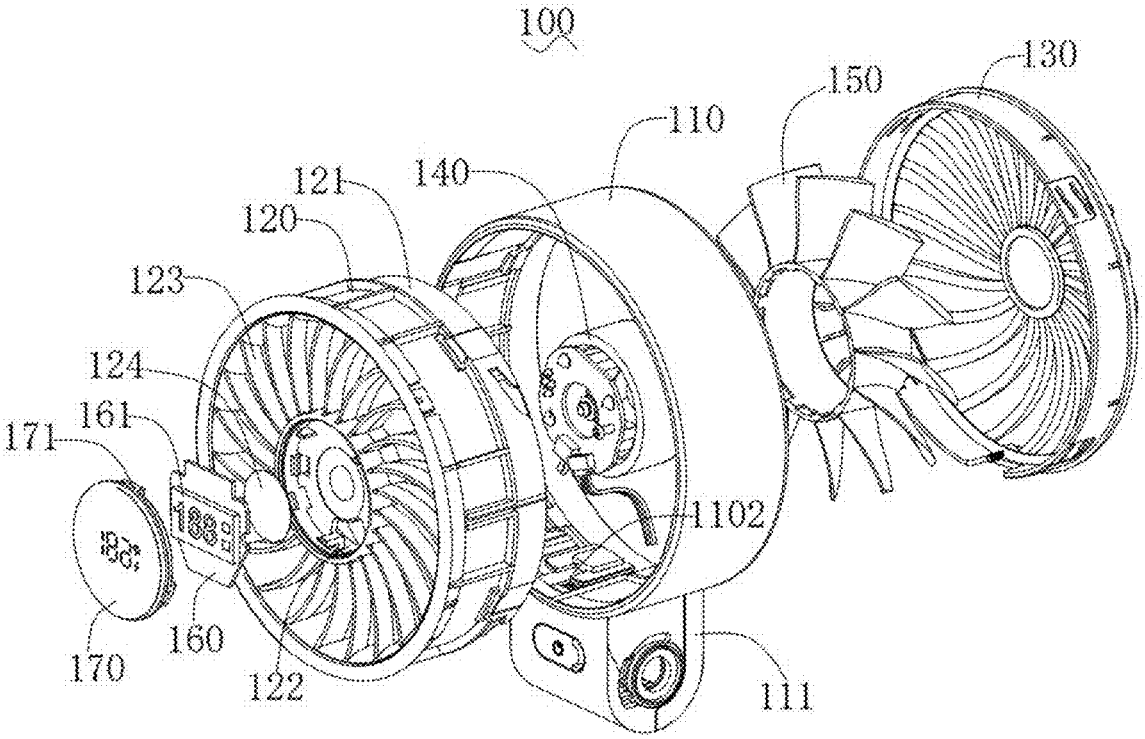
FIG. 34 is a first exploded diagram of a fan main body in this embodiment.
Figure 35:
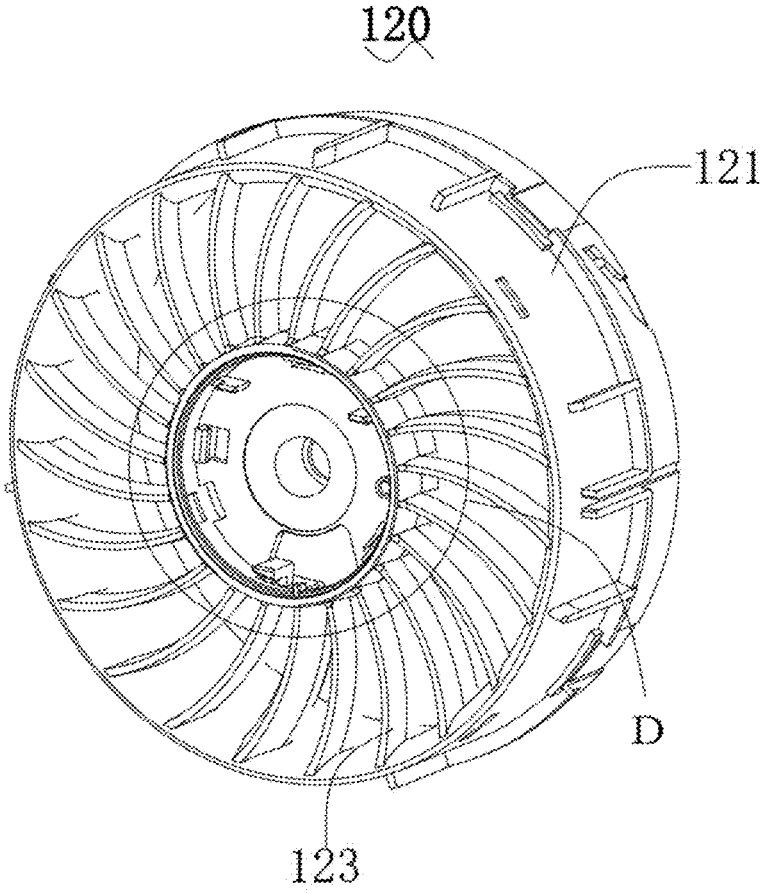
FIG. 35 is a first schematic structural diagram of a front guard in this embodiment.
Figure 36:
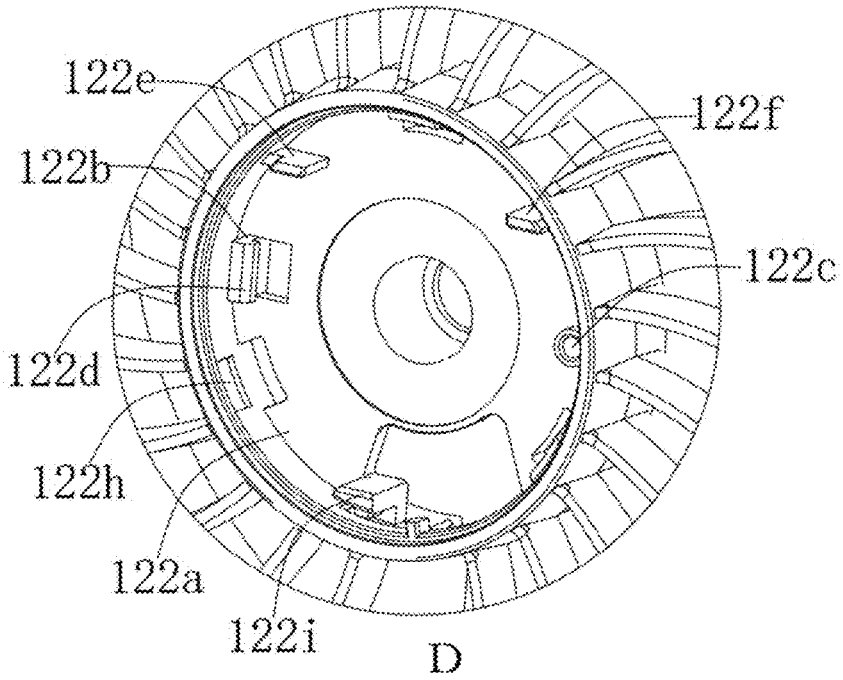
FIG. 36 is an enlarged view of corresponding part D in FIG. 35.
Figure 37:
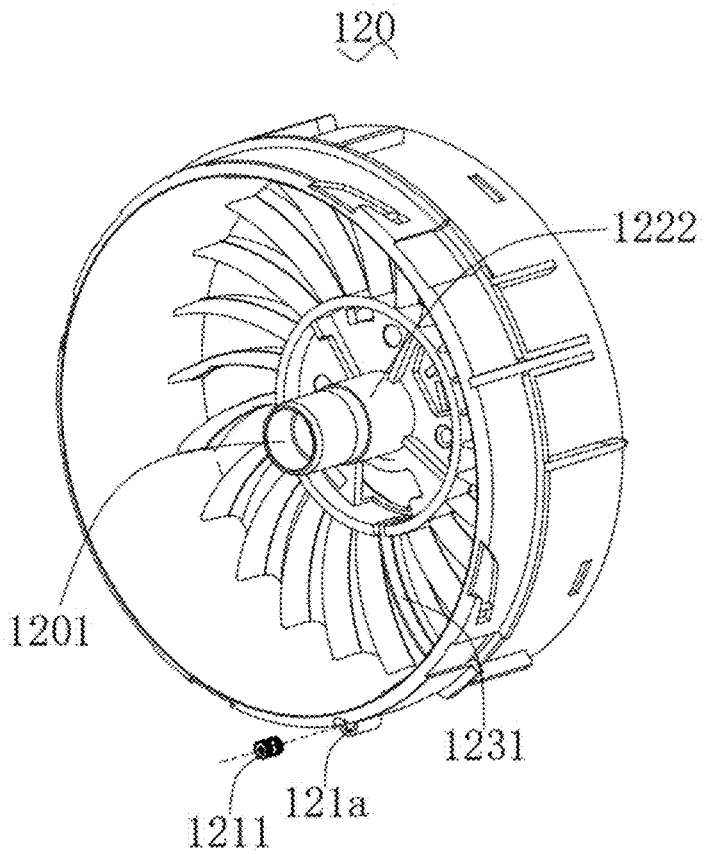
FIG. 37 is a second schematic structural diagram of a front guard in this embodiment.
Figure 41:
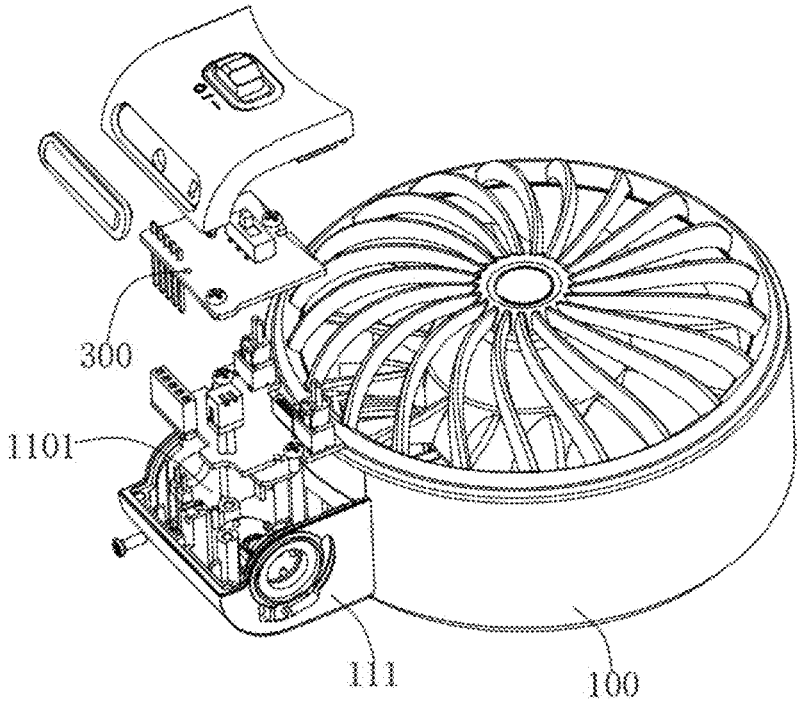
FIG. 41 is a third exploded diagram of a fan main body in this embodiment.

Referring to FIG. 41, in one embodiment, a mounting cavity 1101 is provided inside the connection part 111, and a through hole 1102 communicated to the mounting cavity 1101 is provided in a position, corresponding to the connection part 111, on the annular housing 110 (refer to FIG. 34). Among the plurality of air guide bars 123, one air guide bar 123 is provided with a wire trough 1231, and the wire trough 1231 is communicated to the through hole 1102 and the mounting slot 122*a*.

Referring to FIG. 34 and FIG. 41, in this embodiment, a second circuit board 300 with the handheld fan is mounted inside the mounting cavity 1101. A circuit portion 1411 is arranged on one side, close to the center mounting part 1221, on the stator 141 of the driving motor 140, and a connection terminal is arranged on the circuit portion 1411. The first circuit board 160 is also provided with a connection terminal. The two connection terminals are provided with connection wires. The connection wires are electrically connected to the second circuit board 300 through the wire trough 1231, thereby transmitting the gear position information to the display screen 161 and supplying power to the first circuit board 160.

Figure 42:
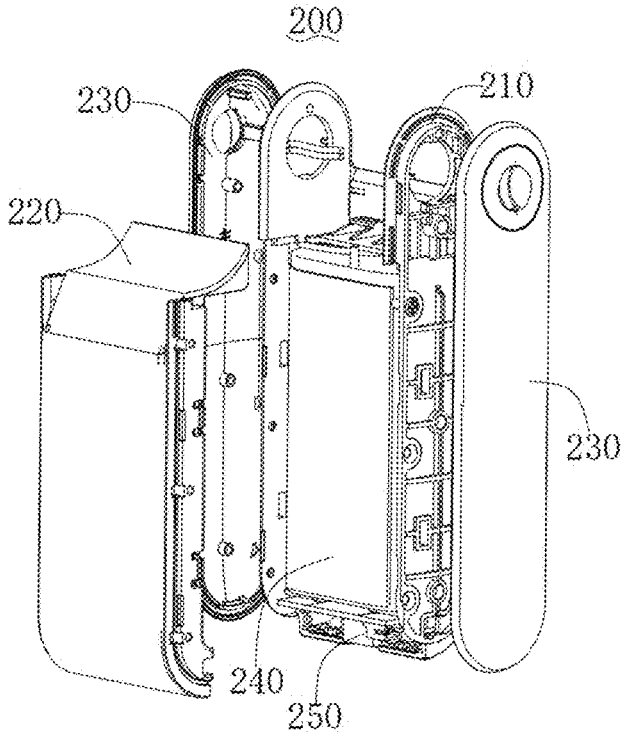
FIG. 42 is an exploded diagram of a handheld body in this embodiment.

Referring to FIG. 40 and FIG. 42, in one embodiment, the handheld handle 200 includes a bottom cover 210, a top cover 220, a side cover 230, and a rechargeable battery 240.

Specifically, one side of the bottom cover 210 that is close to the fan main body 100 is rotatably assembled with the connection part 111, and an accommodating slot (not shown in the figure) is arranged on the bottom cover 210. The rechargeable battery 240 is mounted inside the accommodating slot 201 and is electrically connected to the second circuit board 300 through a wire (not shown in the figure). The top cover 220 and the bottom cover 210 are detachably assembled to seal the accommodating slot. There are two side covers 230, both of which are in clamping fit with the bottom cover 210. It should be noted that the detachable assembling or clamping fit between the bottom cover 210, the top cover 220, and the side cover 230 is the prior art in this art and will not be elaborated in this embodiment.

In one embodiment, a charging module 250 is arranged at a bottom of the handheld handle 200, and the charging module 250 is configured to charge the rechargeable battery 240.

Solution V

Figure 43:
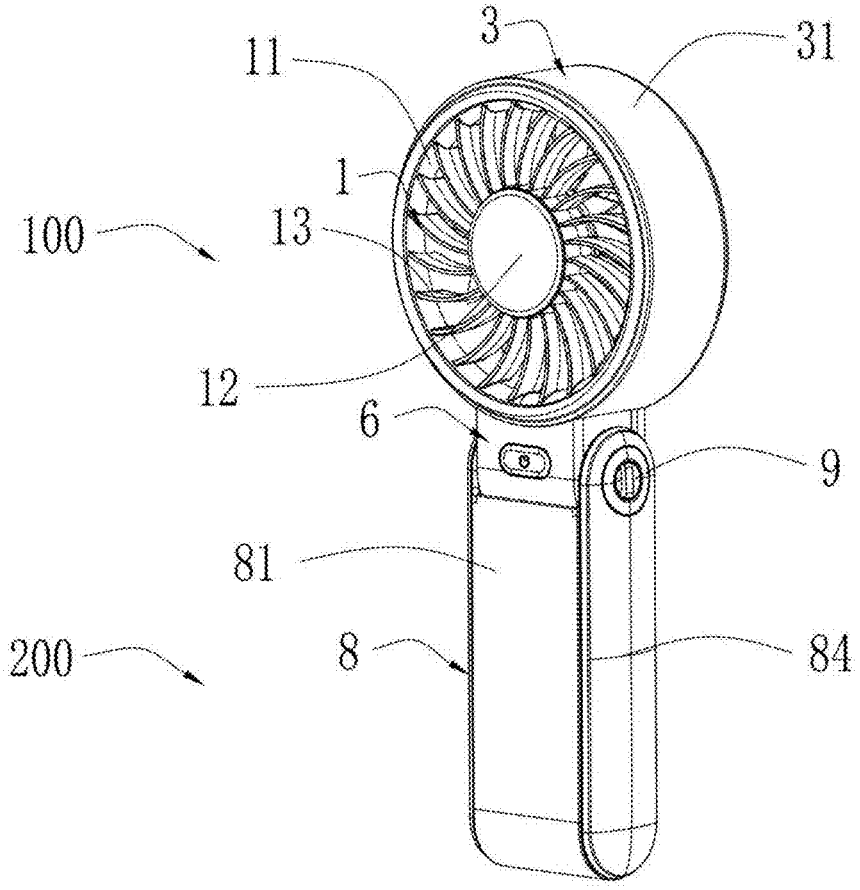
FIG. 43 is a schematic structural diagram of a portable fan provided by the present disclosure.
Figure 44:
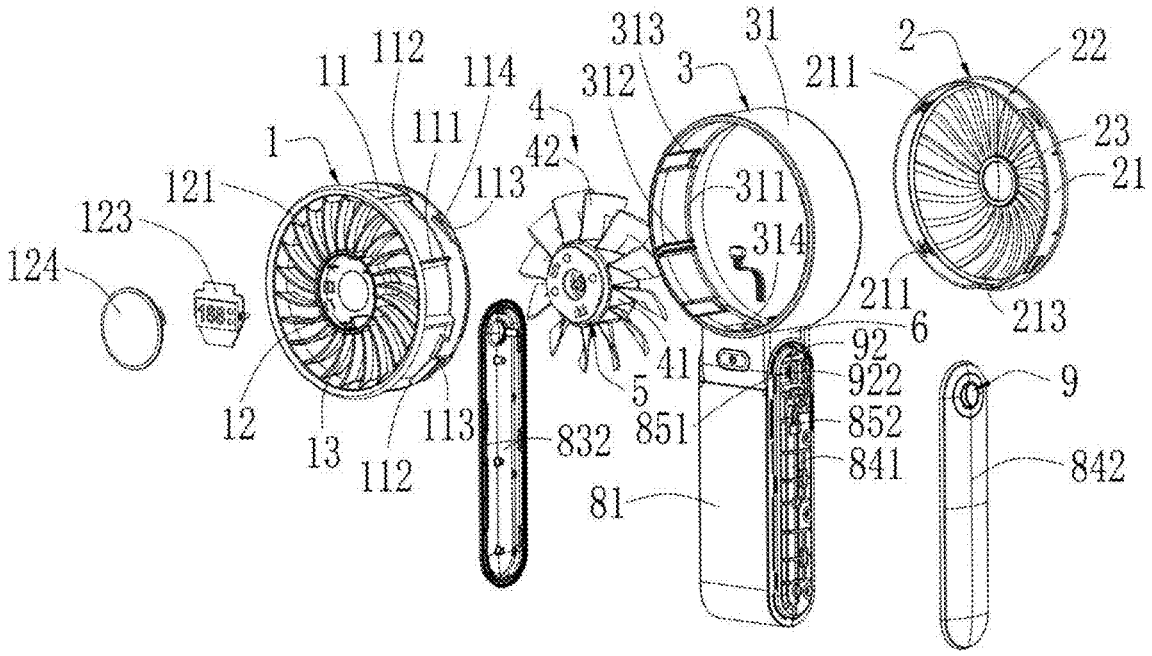
FIG. 44 is a schematic exploded diagram of a portable fan provided by the present disclosure.
Figure 45:
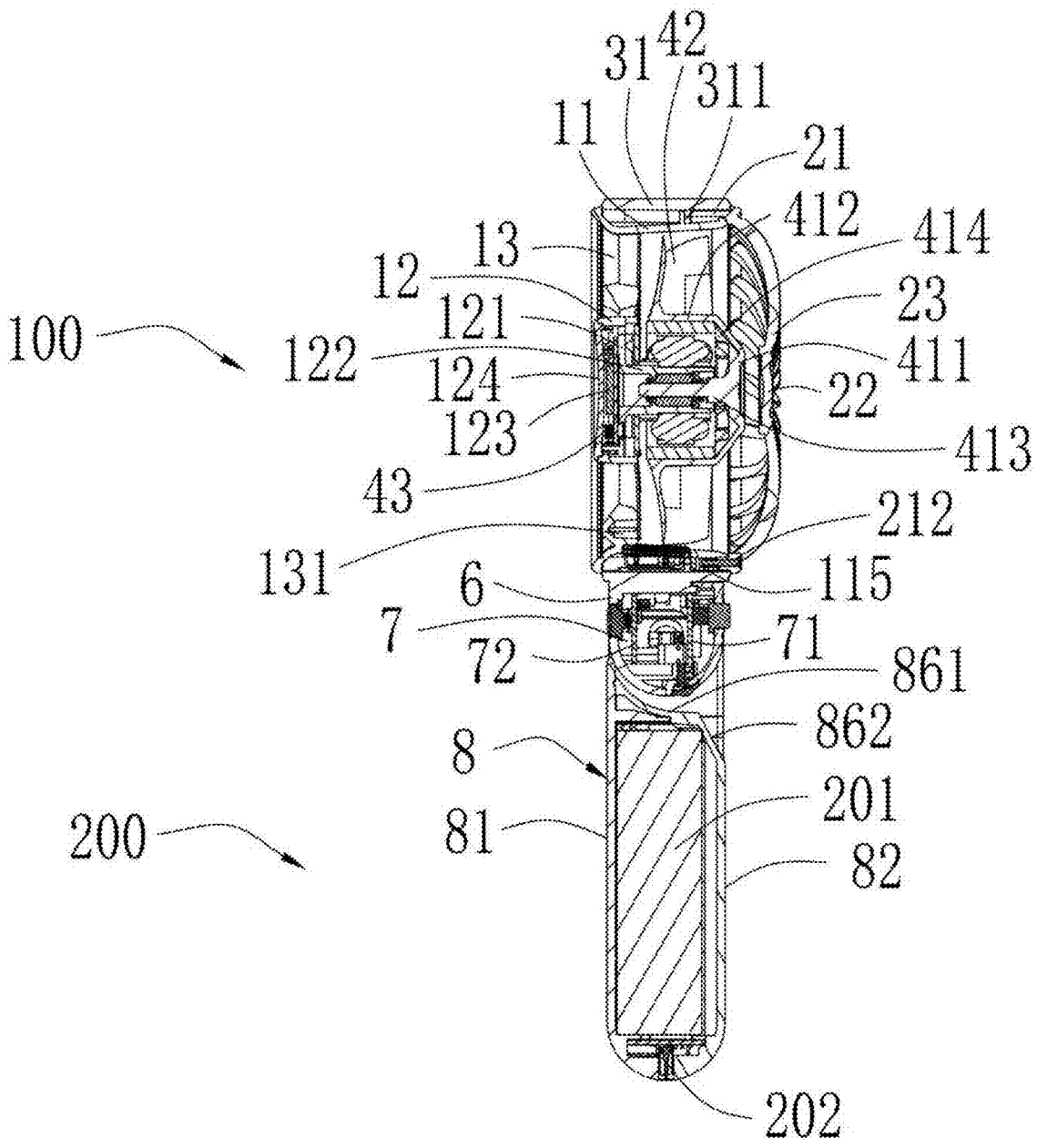
FIG. 45 is a cross-sectional view of a portable fan in a direction, which is provided by the present disclosure.

As shown in FIG. 43 to FIG. 45, a schematic diagram of a portable fan of the present disclosure is shown. The portable fan is a handheld fan. The portable fan includes an air outlet part 100 and a handheld part 200 that are connected to each other. Certainly, in other embodiments, the portable fan may be another type of fan that only has the air outlet part 100, or a combination of the air outlet part 100 and other structures, such as a desktop fan, a clip fan, and a versatile fan, and is not limited by these examples.

Figure 46:
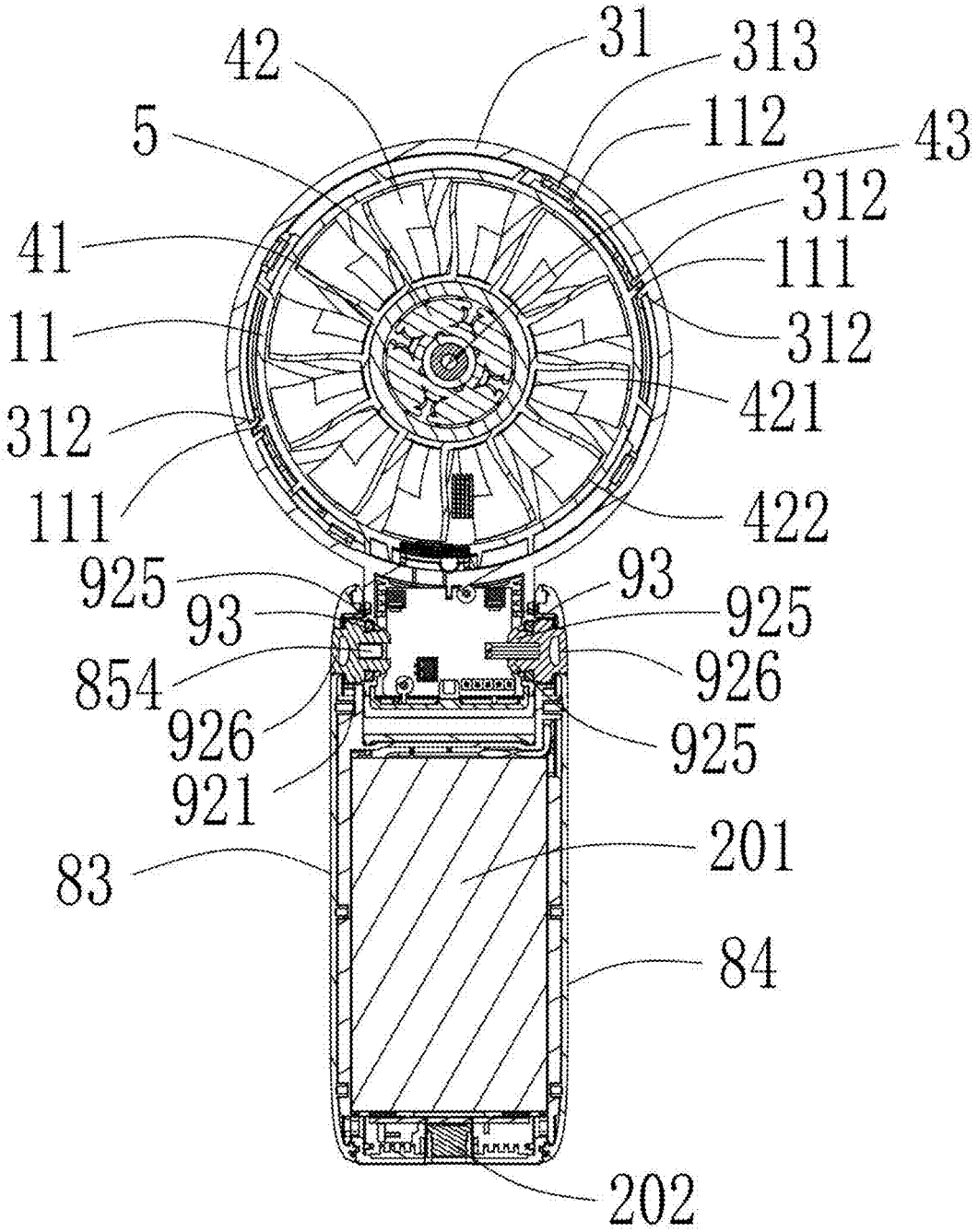
FIG. 46 is a cross-sectional view of a portable fan in another direction, which is provided by the present disclosure.

In one embodiment, as shown in FIG. 44 to FIG. 46, the air outlet part 100 includes a fan frame assembly, a fan blade 4 accommodated in the fan frame assembly, and a motor 5 accommodated in the fan blade 4. The fan frame assembly includes an air inlet frame 2, an air outlet frame 1, and a connection frame 3. The air outlet frame 1 is mounted on the connection frame 3 forwards, and the air inlet frame 2 is mounted on the connection frame 3 backwards. The air inlet frame 2 is fixed to the air outlet frame 1, and the connection frame 3 wraps around a position at which the air inlet frame 2 and the air outlet frame 1 are fixed. By the arrangement of the connection frame 3 for wrapping around the position at which the air inlet frame 2 and the air outlet frame 1 are fixed, the aesthetics of the air outlet frame 1 is ensured. In a case that the air inlet frame 2 and the air outlet frame 1 are fixed, adding the connection frame 3 reduces wind noise, improves safety of the fan frame assembly, and facilitates removal of the air inlet frame 2 and the air outlet frame 1. The fan blade 4 is configured to draw air from the air inlet frame 2 and blow the air out from the air outlet frame 1. The motor 5 is configured to drive the fan blade 4 to rotate.

In one embodiment, as shown in FIG. 44 and FIG. 45, the connection frame 3 includes a ring wall 31. An inner side of the ring wall 31 protrudes out to form a limiting part 311. The air outlet frame 1 includes a first side wall 11, and the air inlet frame 2 includes a second side wall 21. The first side wall 11 backwards crosses the limiting part 311, and the second side wall 21 is sandwiched between the ring wall 31 and the first side wall 11. A front end of the second side wall 21 is located behind the limiting part 311.

Figure 47:
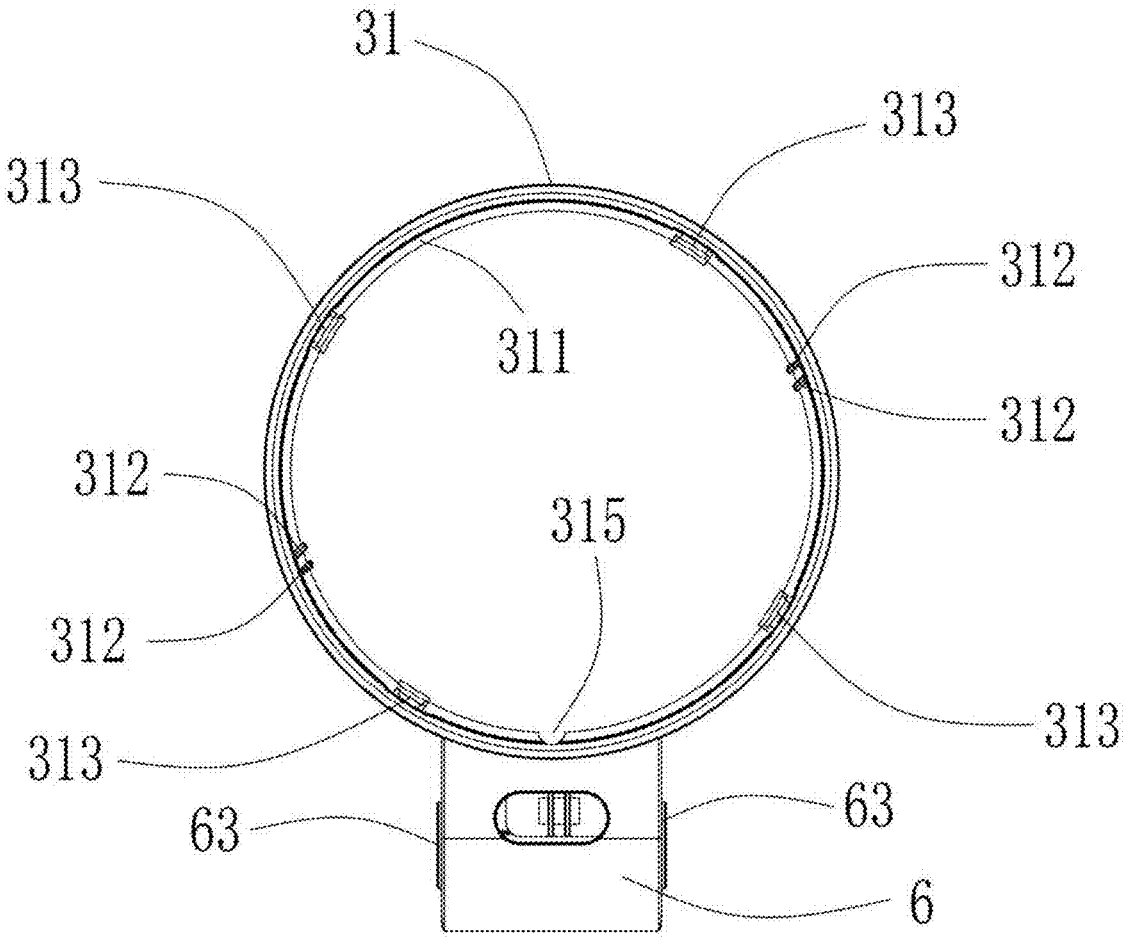
FIG. 47 is a front view of a connection frame and a first connection piece provided by the present disclosure.

In one embodiment, as shown in FIG. 44, FIG. 46, and FIG. 47, an inner side of the ring wall 31 protrudes towards the front of the limiting part 311 to form a plurality of guide ribs 312, and a buckle part 313 is formed forwards from the limiting part 311. A fitting strip 111 and a clamping block 112 are correspondingly arranged on an outer side of the first side wall 11 in a protruding manner. The fitting strip 111 slides into a slot between two adjacent guide ribs 312. The clamping block 112 is buckled and fixed with the buckle part 313 to fix the air outlet frame 1 to the connection frame 3. In this embodiment, there are four guide ribs 312, and there are two fitting strips 111. That is, the two fitting strips 111 respectively slide into slots between two groups of guide ribs 312, which has both a fitting guide effect and a fool-proofing effect. It is convenient for assembling. There are respectively four buckle parts 313 and four clamping blocks 112. It should be understood that quantities of the guide ribs 312, the fitting strips 111, the buckle parts 313, and the clamping blocks 112 are not limited to this.

Figure 49:
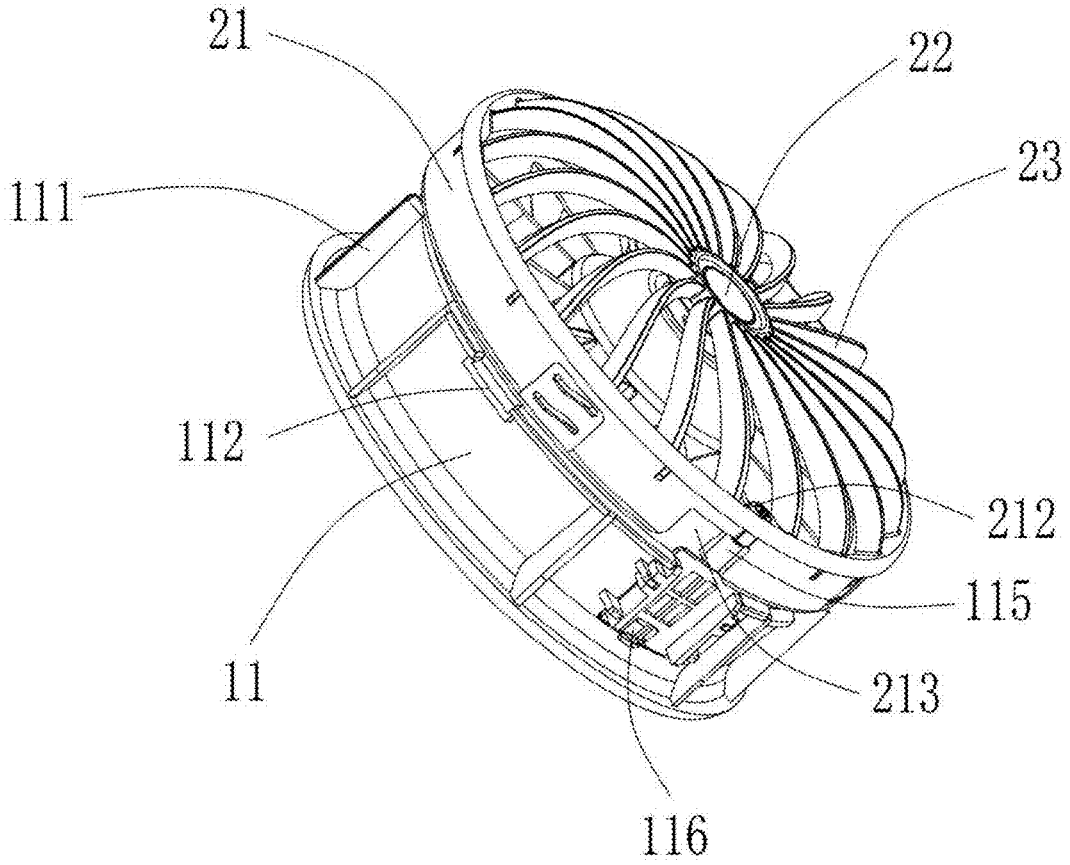
FIG. 49 is a schematic structural diagram of an air inlet frame, an air outlet frame, and a fan blade provided by the present disclosure.

In one embodiment, as shown in FIG. 44 and FIG. 49, a sliding chute 113 is formed on the outer side of the first side wall 11 in a protruding manner. The sliding chute 113 is located at the part of the first side wall 11 that crosses the limiting part 311. A positioning block 114 is arranged inside the sliding chute 113. A fixed block 211 is arranged on an inner side of the second side wall 21 in a protruding manner. A middle portion of the fixed block 211 is recessed, and the fixed block 211 slides into the sliding chute 113. The recess of the fixed block 211 is clamped with the positioning block 114 to fix the air inlet frame to the air outlet frame. It should be understood that quantities of the sliding chute 113 and the fixed block 211 can be set according to an actual need, as long as the sliding chute 113 and the fixed block 211 are in one-to-one correspondence.

In one embodiment, as shown in FIG. 44, FIG. 47, and FIG. 49, the limiting part 311 has a notch 315. A first fixing part 115 further protrudes out of the outer side of the first side wall 11. The first fixing part 115 passes through the notch 315. A second fixing part 212 is formed at a rear end of the second side wall 21. A fastener fixes the second fixing part 212 and the first fixing part 115 to further fix the air inlet frame 2 and the air outlet frame 1. In this embodiment, the sliding chute 113 extends diagonally from a rear end of the first side wall 11, and the second side wall 21 rotates radially to cause the fixed block 211 to slide into the sliding chute 113. The second side wall 21 is provided with an avoidance opening 213. In the process that the fixed block 211 slides into the sliding chute 113, the avoidance opening 213 avoids the first fixing part 115. Certainly, the sliding chute 113 can also extend axially from the rear end of the first side wall 11, and the second side wall 21 can move axially forward to cause the fixed block 211 to slide into the sliding chute 113. In this embodiment, there are one first fixing part 115 and one second fixing part 212. Quantities of the first fixing part 115 and the second fixing part 212 can be set according to an actual need.

In one embodiment, as shown in FIG. 44 and FIG. 45, the air outlet frame 1 further includes a first combination part 12, and a plurality of first guide vanes 13 connecting the first combination part 12 to the first side wall 11. A gap between the plurality of first guide vanes 13 is an air outlet. From front to back, the plurality of first guide vanes 13 bend and rotate clockwise. The air inlet frame 2 further includes a second combination part 22, and a plurality of second guide vanes 23 connecting the second combination part 22 to the second side wall 21. A gap between the plurality of second guide vanes 23 is an air inlet. From front to back, the plurality of second guide vanes 23 bend and rotate clockwise. The plurality of first guide vanes 13 and the plurality of second guide vanes 23 are arranged to bend and rotate in the same direction, which is beneficial for reducing resistance to forward movement of air and enhancing a wind effect. The first combination part 12 and the plurality of first guide vanes 13 do not protrude forwards out of a front end of the first side wall 11, thus enhancing an air outlet effect of the air outlet frame 1 at the front end. The second combination part 22 and the plurality of second guide vanes 23 protrude backwards out of the rear end of the second side wall 21, thus enhancing an air gathering effect of the air inlet frame 2 at the rear end. Moreover, the second combination part 22 and the plurality of second guide vanes 23 protrude backwards out of the rear end of the second side wall 21, thus enlarging an air inlet space and increasing an air inlet volume.

In one embodiment, as shown in FIG. 44 and FIG. 45, the first combination part 12 includes a substrate 121 and a shaft tube 122 protruding and extending backwards from the substrate 121. The shaft tube 122 is hollow. The first combination part 12 accommodates a display panel 123 in front of the substrate 121, and the display panel 123 is configured to display a working state. During use, the display panel 123 can be configured to display one or more of a battery level, a current wind speed, and a charging state. There is also a display cover 124. The display cover 124 is covered in front of the first combination part 12. A front surface of the display cover 124 is a concave surface that is recessed backwards, which has a flow gathering effect and is conducive to protecting the display panel 123. The display cover 124 can be transparent or opaque but light-transmittable, as long as content on the display panel 123 can be acquired by a user through the display cover 124.

In one embodiment, as shown in FIG. 44 and FIG. 45, a distance between a front end and a rear end of the ring wall 31 is 27.95 to 28.15 mm. A distance between a front end and a rear end of the first side wall 11 is 29.73 to 29.93 mm. A distance between a front end and a rear end of the second side wall 21 is 10.82 to 11.02 mm. The distance between the front end and the rear end of the first side wall 11 is greater than the distance between the front end and the rear end of the ring wall 31, to facilitate the first side wall 11 to be fixed with the second side wall 21 within the ring wall 31. A distance between a front end and a rear end of each first guide vane 13 is 6.87 to 7.27 mm. The first guide vane 13 does not protrudes forwards and has a long axial distance, so that the air outlet effect is good. A distance between a front end and a rear end of each second guide vane 23 is 7.91 to 10.49 mm. The second guide vane 23 protrudes backwards with a large axial span and a good air suction effect. The ring wall 31 remains unchanged radially from back to front. The inner diameter of the ring wall 31 is 78.80 to 79.04 mm and an outer diameter of the ring wall 31 is 83.6 to 83.8 mm. The ring wall 31 has a large radial space, which can ensure an internal air channel space to provide a large air volume.

In one embodiment, as shown in FIG. 44 and FIG. 45, the first side wall 11 has a minimum diameter, a first section bending and extending in a radial enlarging manner from the minimum diameter to the front, and a second section bending and extending in a radial enlarging manner from the minimum diameter to the back. A length of the first section in the axial direction is less than a length of the second section in the axial direction, and a maximum diameter of the first section is greater than a maximum diameter of the second section. The entire first side wall 11 bends and extends, namely, from back to front, first bending and extending in a radial narrowing manner and then bending and extending in a radial enlarging manner. The maximum diameter of the first section is 83.31 to 83.51 mm, which is between the inner diameter and the outer diameter of the ring wall 31. A front end of the first section bends upwards and resists against the front end of the ring wall 31. A maximum diameter of the second side wall 21 is located at a rear end of the second side wall 21. An inner side surface of the rear end of the second side wall 21 is connected to a curved surface of an inner side surface of the rear end of the first side wall 11, which is conducive to air suction and flow gathering and improving an air volume and a wind effect. The maximum diameter of the second side wall 21 is 80.23 to 80.43 mm, which is between the inner diameter and the outer diameter of the ring wall 31. The rear end of the second side wall 21 bends upwards and forwards resists against the rear end of the ring wall 31.

In one embodiment, as shown in FIG. 44 and FIG. 45, the fan blade 4 includes a hub 41 and a plurality of blades 42 arranged on an outer side of the hub 41. The second combination part 22 is arranged in a manner of being radially enlarged from back to front, which is conducive to air suction and flow gathering. A maximum diameter of the second combination part 22 is less than a maximum diameter of the hub 41, thus enlarging an area of the air inlet and increasing an air inlet volume. From back to front, the first combination part 12 is first enlarged radially and is then narrowed radially, which is conducive to first increasing a pressure and then guiding air. A maximum diameter of the first combination part 12 is less than the maximum diameter of the hub 41, thus enlarging an area of the air outlet and reducing air resistance. A distance between the second combination part 22 and the blades 42 is 9.84 to 10.04 mm, which is conducive to air suction and flow gathering and increasing the air inlet volume. A distance between the first combination part 12 and front ends of the blades 42 is 2.31 to 2.51 mm, which is conducive to rapid air guidance and enhancing the wind effect.

In one embodiment, as shown in FIG. 44, FIG. 45, FIG. 50, and FIG. 51, the hub 41 includes a rear portion 411 and a side portion 412 that are connected to each other. The rear portion 411 and the side portion 412 form an accommodating portion (not marked, the same below) with a forward opening. The accommodating portion is configured to accommodate the motor 5. The plurality of blades 42 are arranged outside the side portion 412 at an equidistant spacing in a surrounding manner. The fan blade 4 further includes a rotating shaft 43. The rotating shaft 43 is integrally formed with the hub 41. The rotating shaft 43 is fixed at a center of the rear portion 411 and is arranged in the accommodating portion. A front end of the rotating shaft 43 is inserted into the shaft tube 122 to fix the motor 5 and the fan blade 4 to the air outlet frame 1. A material of at least one of the hub 41 and the blades 42 contains a glass fiber The addition of the glass fiber material enhances the overall strength, rigidity, size stability, fatigue resistance, and resistance to low and high-temperature changes, so that the fan blade 4 can have a light mass, high strength, and good toughness. In addition, the glass fiber has a good dust isolation effect. The fan blade 4 can maintain high cleanliness.

Figure 50:
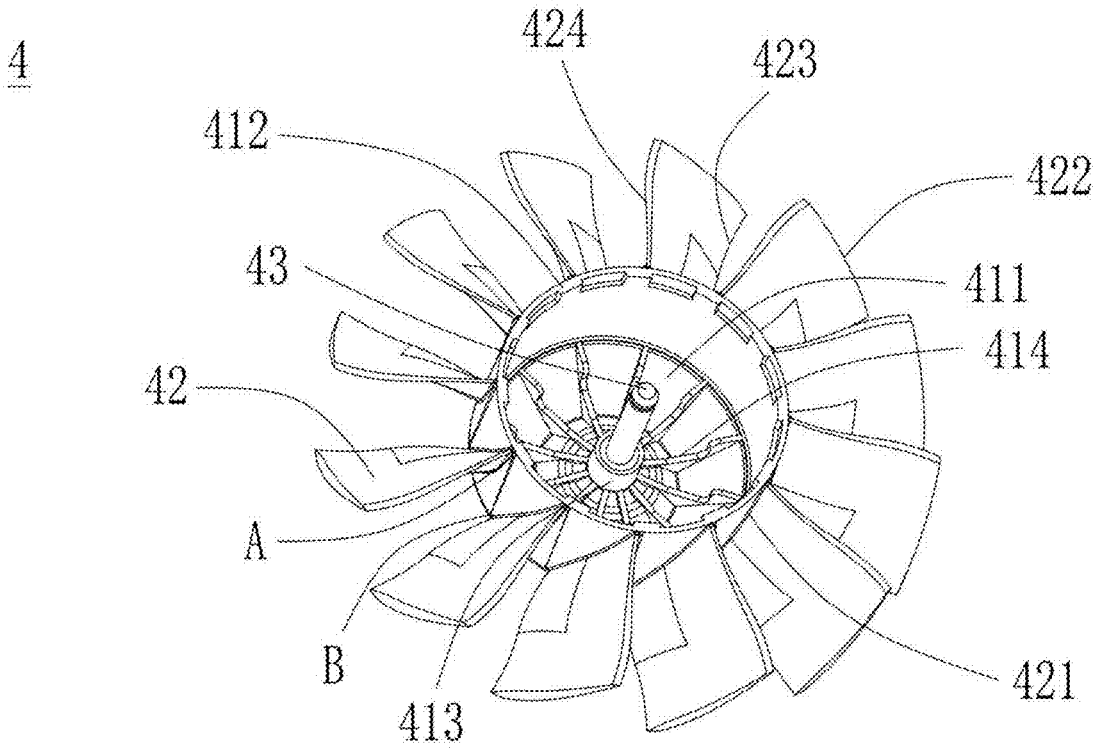
FIG. 50 is a three-dimensional diagram of a fan blade in a direction, which is provided by the present disclosure.
Figure 51:
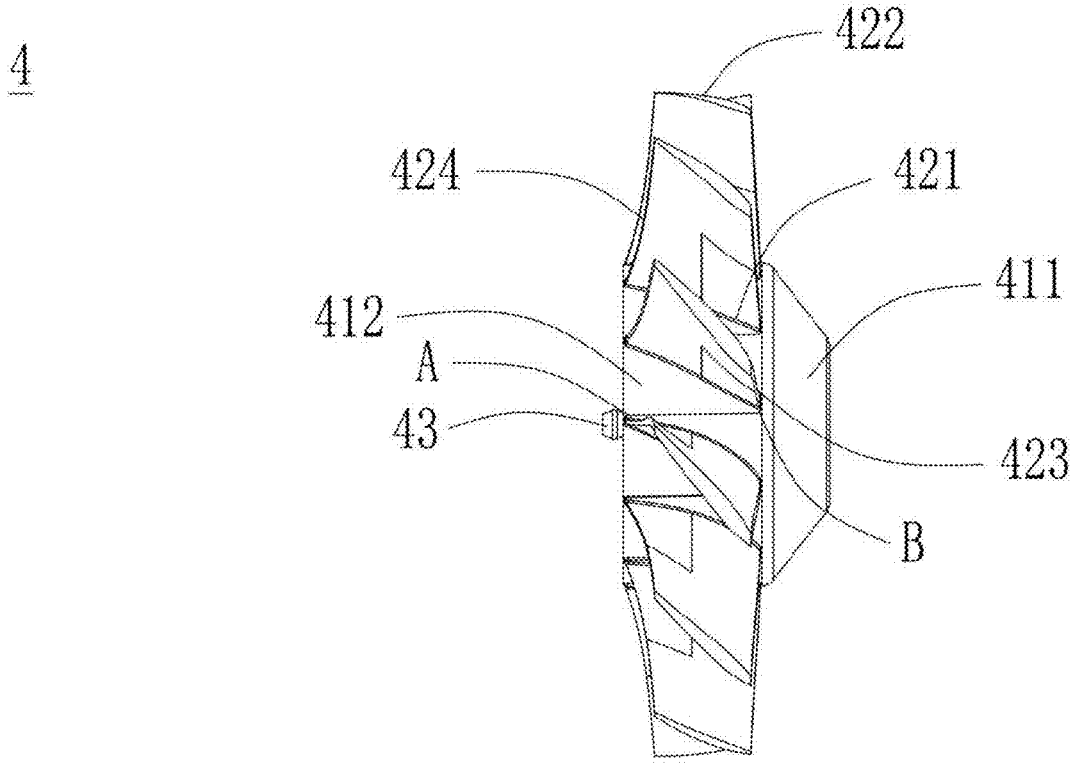
FIG. 51 is a right view of a fan blade provided by the present disclosure.

In one embodiment, as shown in FIG. 50 and FIG. 51, the hub 41 and the blades 42 are formed by integral injection molding, and a material of the hub 41 and a material of the blades 42 both contain glass fibers with a content percentage of 28% to 32%. Since a size of the fan blade 4 of the portable fan is much less than a size of a fan blade 4 of a large fan. In an injection molding process, an acrylonitrile butadiene styrene (ABS) material with good flowability is generally used to ensure filling. By the adding of 28% to 32% of the glass fiber, the fan blade 4 can still maintain good strength, rigidity, and structural stability during high-speed operation or long-term use. Certainly, in other embodiments, the blades 42 may be made of another material added with the glass fiber, and are not limited to this.

In one embodiment, as shown in FIG. 45, FIG. 50, and FIG. 51, the rear portion 411 includes an end portion and an inclined portion. The end portion is recessed from back to front. A center of the end portion protrudes forwards to form a shaft sleeve 413. The shaft sleeve 413 is configured to fix the rotating shaft 43. The rotating shaft 43 is not exposed backwards from the end portion. The fan blade 4 is more beautiful, and the rotating shaft 43 has better structural stability. The inclined portion connects the end portion with the side portion 412. The inclined portion expands radially from back to front, which is conducive to boosting and flow guidance.

In one embodiment, as shown in FIG. 45, FIG. 50, and FIG. 51, the fan blade 4 further includes a plurality of reinforcing ribs 414. The plurality of reinforcing ribs 414 are arranged inside the rear portion 411 at an equidistant spacing in a surrounding manner. Each reinforcing rib 414 extends from the shaft sleeve 413 at the center to the inclined portion. The reinforcing ribs 414 enhance the overall strength of the hub 41. Each reinforcing rib 414 includes a step portion that is arranged on the inclined portion and is close to the side portion 412. The step portion is configured to limit and support a magnetic ring of the motor 5. By the arrangement of the step portions of the reinforcing ribs 414, the magnetic ring of the motor 5 is limited and isolated from the rear portion 411, to reduce vibrations and noise and facilitate heat dissipation of the motor 5.

In one embodiment, as shown in FIG. 45, FIG. 50, and FIG. 51, a distance between a front end of the side portion 412 and a rear end of the rear portion 411 is 19.92 to 21.12 mm. A distance between a front end of the rotating shaft 43 and the rear portion 411 is 23.02 to 23.22 mm. The rotating shaft 43 extends forwards out of the front end of the side portion 412, making it convenient for the rotating shaft 43 to be fixed forwards to the shaft tube 122. An outer diameter of the side portion 412 is 33.04 to 33.24 mm, which, in conjunction with the first side wall 11, forms a portion of an air channel that has a larger cross-sectional area.

In one embodiment, as shown in FIG. 45, FIG. 50, and FIG. 51, a quantity of the blades 42 is 12. The blades 42 are radial. The radial blades 42 have the highest air suction capacity. Each blade 42 includes a blade root 421 connected to the hub 41, a blade tail 422 away from the hub 41, and a first side wing 423 and a second side wing 424 that are connected to the blade root 421 and the blade tail 422. The first side wing 423 is located on a front side of a rotation direction. The second side wing 424 is located on a rear side of the rotation direction. In the axial direction, the first side wing 423 is located behind the second side wing 424. A thickness of the first side wing 423 is greater than a thickness of the second side wing 424. The first side wing 423 cuts air, while the second side wing 424 guides air. The structure of the blade 42 is conducive to enhancing the wind effect. The quantity of the blades 42 is not limited to this and can be set to other values.

In one embodiment, as shown in FIG. 44, FIG. 50, and FIG. 51, an insertion surface between adjacent blades 42 is 1°. The fan blade 4 is usually made by injection molding after an upper mold and a lower mold are inserted in parallel. The hub 41 has point A and point B. Point A is close to a joint between the blade root 421 and the second side wing 424, and point B is close to a joint between the blade root 421 and the front side wing in the rotation direction. In adjacent blades 42, a surface on which a connection line between an A end of one blade 42 and a B end of the other closer blade 42 is a insertion surface. An angle between a projection of the insertion surface on the side portion 412 and an axis of the insertion surface is 1°, which facilitates the parallel insertion between the upper mold and the lower mold and ensures the air suction effect of the fan blade 4. In the axial direction, a diameter of a projection of the blade tail 422 is 67.90 to 68.10 mm. The blades 42 have a large radial coverage range and a good air suction and flow gathering effect, which is conducive to increasing the air volume and enhancing the wind effect. Furthermore, an inner diameter of the ring wall 31 is 78.80 to 79.04 mm. Most of the first side wall 11 is arranged on an inner side of the ring wall 31, which means that a gap between the blade tail 422 and the first side wall 11 is small, which is beneficial for air suction and pressure increase, to increase the air pressure and enhance the wind effect.

In one embodiment, as shown in FIG. 44, FIG. 50, and FIG. 51, an acute angle between a cross section and an axis of each blade 42 gradually increases in a direction from the blade root 421 to the blade tail 422. The second side wing 424 gradually moves towards the back, the first side wing 423 gradually moves towards the front. The blade 42 is twisted to enhance the air suction effect. In addition, a forward movement amplitude of the first side wing 423 is less than a backward movement amplitude of the second side wing 424. That is, in a radial direction, a distance between the second side wing 424 and the first guide vane 13 significantly increases, and a distance between the first side wing 423 and the second guide vane 23 slightly increases. This indicates that the fan blade 4 has a good air suction and flow guidance effect.

In one embodiment, as shown in FIG. 43 to FIG. 45 and FIG. 49, the air outlet part 100 further includes a first connection piece 6 connected to an outer side of the ring wall 31, and a control center 7 is arranged in the first connection piece 6. The handheld part 200 includes a housing 8 and a power supply component 201 arranged in the housing 8. The power supply component 201 is electrically connected to the control center 7. The handheld part 200 is correspondingly provided with a second connection piece 9, and the first connection piece 6 and the second connection piece 9 are connected and fixed. The first connection piece 6 and the fan frame assembly are provided with a wire passing structure. Specifically, the ring wall 31 is provided with an open slot 314 corresponding to the first connection piece 6. A through hole 116 is formed in the first side wall 11. One first guide vane 13 is formed with a wire passing slot 131. The fan blade 4 and the motor 5 are fixed to the air outlet frame 1. A wire passes through the first connection piece 6, the second connection piece 9, the open slot 314, the through hole 116, and the wire passing slot 131 to be electrically connected to the control center 7 and the motor 5. A sealing cover can also be provided. After the wire enters the wire passing slot 131 through the through hole 116, the sealing cover covers the through hole 116. On the one hand, it reduces an exposure area of the wire, and on the other hand, it can press and fix the wire, so that the wire will not easily move in the wire passing slot 131.

In one embodiment, as shown in FIG. 44 to FIG. 46, the first connection piece 6 is arranged on an outer side of the ring wall 31. The first connection piece 6 does not block the air inlet and the air outlet. Therefore, the first connection piece 6 will not affect air incoming and air outblowing of the portable fan.

In one embodiment, as shown in FIG. 44, FIG. 47, FIG. 48, and FIG. 52, the housing 8 includes a front cover 81, a rear cover 82, a left cover 83, a right cover 84, and a top cover 86. The left cover 83 and the right cover 84 are symmetrically arranged, and the left cover 83 and the right cover 84 are higher than the front cover 81, the rear cover 82, and the top cover 86. The first connection piece 6 includes two first connection holes 61 symmetrically formed in left and right sides, and the second connection piece 9 is arranged on the left cover 83 and the right cover 84. The second connection piece 9 includes two second connection holes 91 symmetrically formed in left and right sides. The two second connection holes 91 correspondingly cooperate with the two first connection holes 61.

In one embodiment, as shown in FIG. 44, FIG. 47, FIG. 48, and FIG. 52, a diameter of each first connection hole 61 is less than a diameter of each second connection hole 91. The first connection piece 6 further includes flanges 62 that are formed by outward protruding. The flanges 62 are located on radial outer sides of the first connection holes 61. A diameter of each flange 62 matches the diameter of each second connection hole 91. The flanges 62 are clamped and fixed to the second connection holes 91. The first connection holes 61 are rotatably pivoted to the second connection holes 91. The second connection piece 9 further includes hoops 92. Each hoop 92 includes a fitting portion 921, two clamping hooks 925 protruding out of one surface of the fitting portion 921, and a lug portion 926 protruding out of another surface of the fitting portion 921. A gap is reserved between the two clamping hooks 925, so that a space for inward compression deformation is provided between the two clamping hooks 925. The two clamping hooks 925 enter the first connection hole 61 from the second connection hole 91 and hook an inner edge of the first connection hole 61.

In one embodiment, as shown in FIG. 44, FIG. 46, FIG. 47, FIG. 48, and FIG. 52, each fitting portion 921 is provided with an insertion hole 922 and a fool-proof slot 923 on one side of the lug portion 926, and the fitting portion 921 is provided with a notch 924 in another side of the lug portion 926. The left cover 83 includes a left inner cover 831 and a left outer cover 832, and the right cover 84 includes a right inner cover 841 and a right outer cover 842. The second connection holes 91 are provided in the left inner cover 831 and the right inner cover 841. Both the left inner cover 831 and the right inner cover 841 are provided with fool-proof blocks 851. The fool-proof blocks 851 are located on the radial outer sides of the second connection holes 91. The fool-proof holes cooperate with the fool-proof blocks 851 to correctly mount the hoops 92. The second connection piece 9 further includes pads 93, and the pads 93 are arranged on radial outer sides of the two clamping hooks 925. The first connection piece 6 further includes recesses 63 that are inwards recessed. The recesses 63 are located between the first connection holes 61 and the flanges 62. The recesses 63 accommodate the pads 93, and the pads 93 is clamped and fixed between the fitting portions 921 and the first connection holes 61.

Figure 48:
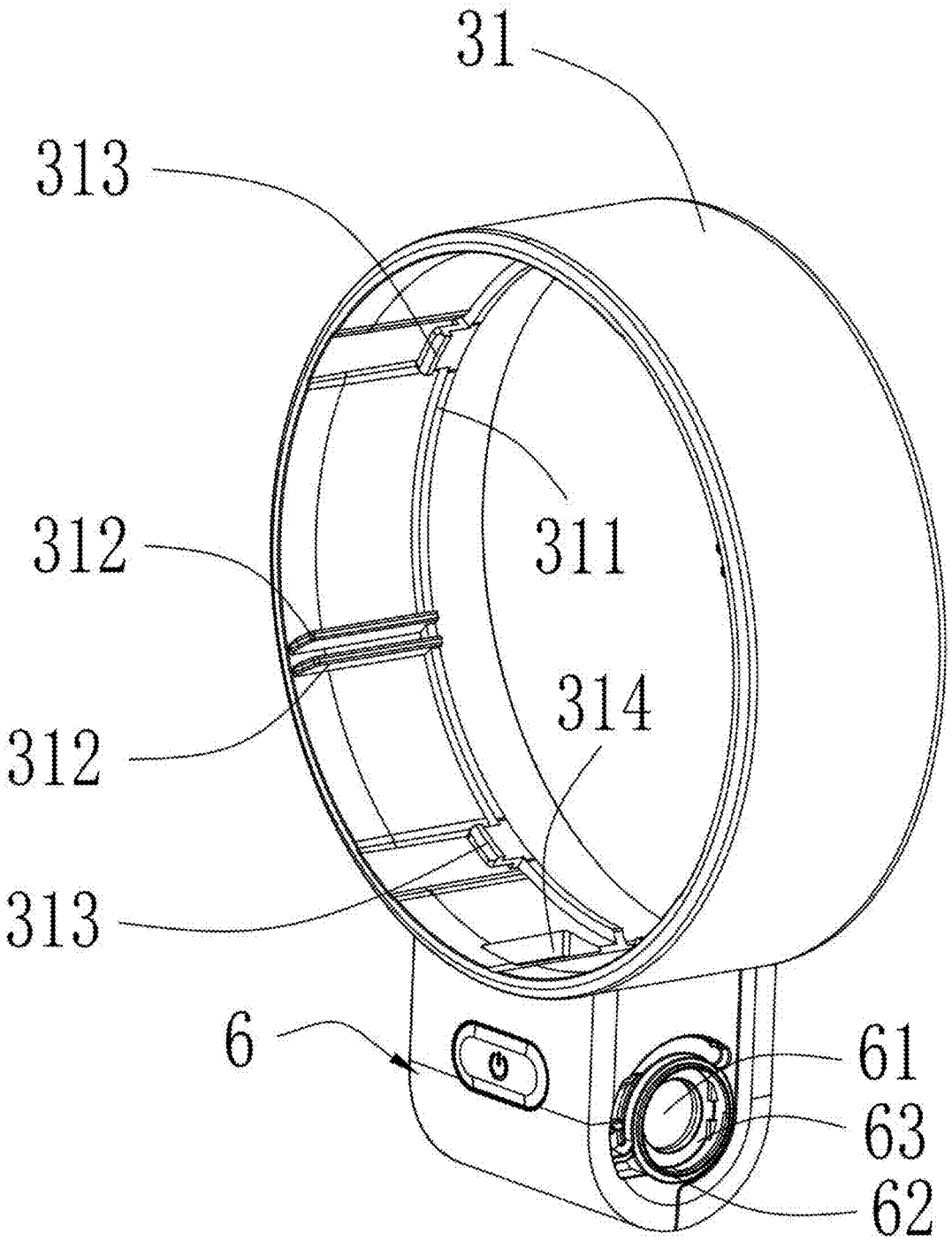
FIG. 48 is a schematic three-dimensional diagram of a connection frame and a first connection piece provided by the present disclosure.
Figure 52:
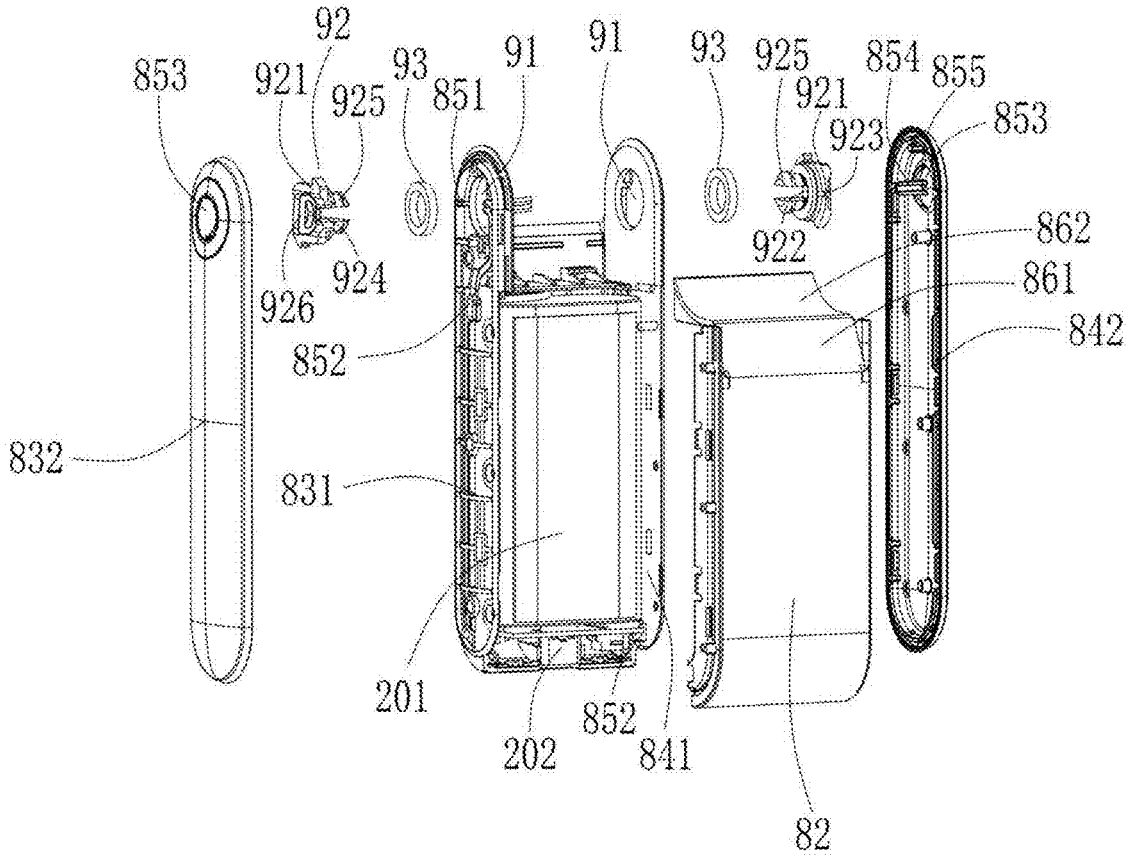
FIG. 52 is a schematic exploded diagram of a portable portion provided by the present disclosure.

In one embodiment, as shown in FIG. 44, FIG. 48, and FIG. 52, one of the left inner cover 831 and the right inner cover 841 is provided with a wire hole 852 corresponding to the power supply component 201. The wire is threaded out of the wire hole 852 and then enters the first connection piece 6 through the notches 924 and the first connection holes 61, to electrically connect the control center 7 with the power supply component 201. A charging component 202 is further arranged inside the handheld part 200. The other one of the left inner cover 831 and the right inner cover 841 is also provided with a wire hole 852 corresponding to the charging component 202. The wire is threaded out of the wire hole 852 and then enters the first connection piece 6 through the notches 924 and the first connection holes 61, to electrically connect the control center 7 with the charging component 202. The pads 93 and the notches 924 cooperate with each other to fix the wire. It should be understood that the charging component 202 is electrically connected to the control center 7, the power supply component 201 is electrically connected to the control center 7. The charging component 202 and the power supply component 201 can also be electrically connected to each other. When the charging component 202 is connected to an external power source, the charging component 202 can charge the power supply component 201, and the charging component 202 can also directly provide power to drive the motor 5 to rotate.

In one embodiment, as shown in FIG. 44 and FIG. 52, both the left inner cover 832 and the right inner cover 842 are provided with arc-shaped portions 853 that protrude inwards, and insertion blocks 854 that inwards protrude out of the arc-shaped portions 853. The arc-shaped portions 853 are provided with avoidance slots 855, and the lug portions 926 pass through the avoidance slots 855 and are exposed outwards. In this embodiment, the through hole 116 formed by hollowing the lug portions 926 can be used for threading a rope for a user to wear and carry. The insertion blocks 854 are inserted into the insertion holes 922 and limit the pads 93. By using the insertion blocks 854 to limit the insertion holes 922, the pads 93 are further fixed. Even after the portable fan falls or be collided, the pads do not easily move. The left outer cover 832 and the right outer cover 842 cover the wire, which is safer, more reliable, and more aesthetically pleasing.

In one embodiment, as shown in FIG. 45, the control center 7 includes a first control board 71 and a second control board 72 that are stacked in front and behind. The first control board 71 and the second control board 72 are electrically connected. The first control board 71 is configured for misoperation prevention control, and the second control board 72 is configured to control turning on, turning off, and a wind speed.

In one embodiment, as shown in FIG. 45 and FIG. 52, the front cover 81 is higher than the rear cover 82, and the top cover 86 includes a first slope 861 and a second slope 862. The first slope 861 extends forwards and diagonally upwards from the rear cover 82, and the second slope 862 extends forwards and diagonally upwards from the first slope 861. The second slope 862 is downwards recessed and bends. The downward recessing and bending just avoid the first connection piece 6, so that during the pivoting of the first connection piece 6 and the second connection piece 9, the first connection piece 6 and the second connection piece 9 will not collide with each other.

Figure 53:
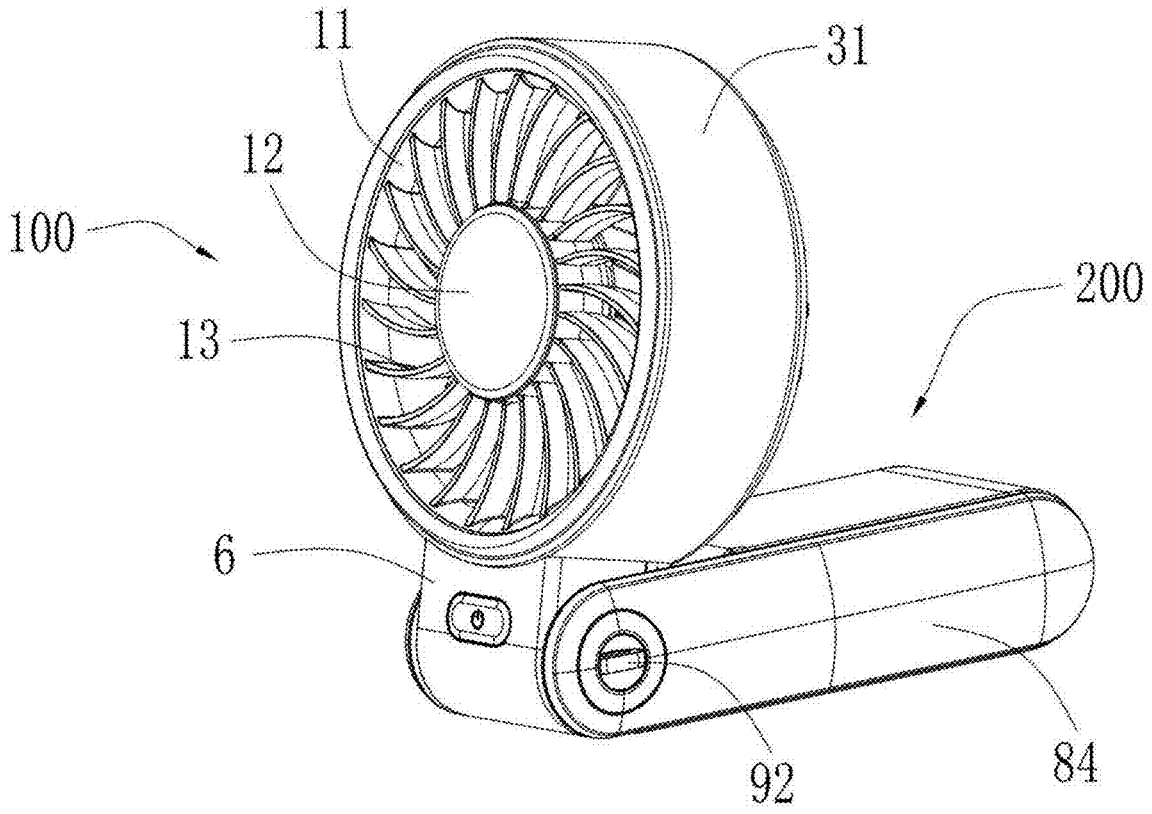
FIG. 53 is a schematic diagram of an air outlet part that rotates backwards in a maximum angle provided by the present disclosure.
Figure 54:
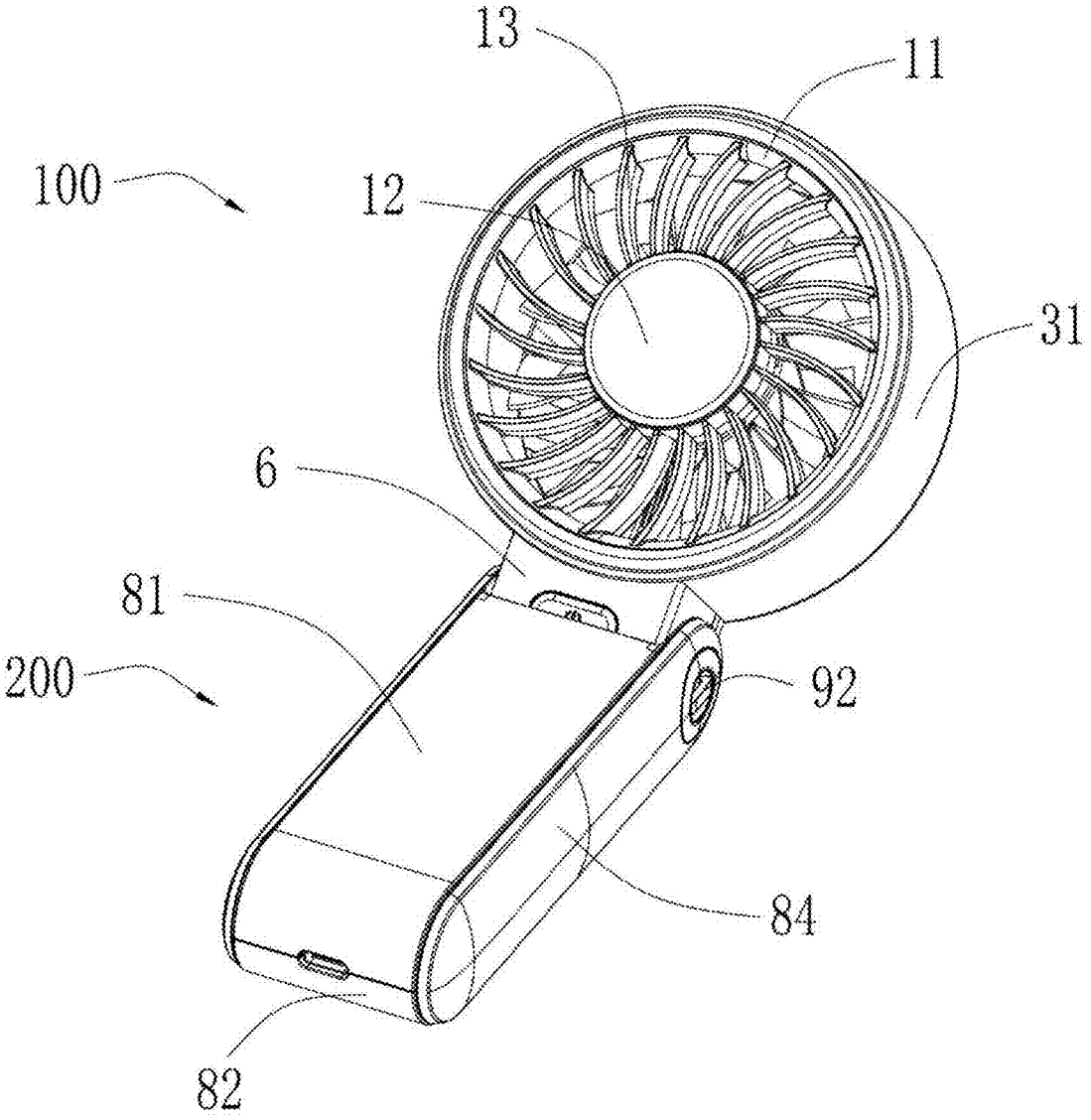
FIG. 54 is a schematic diagram of an air outlet part that rotates forwards in a maximum angle provided by the present disclosure.

In addition, as shown in FIG. 53 and FIG. 54, the air outlet part 100 can rotate backwards relative to the handheld part 200 until the ring wall 31 resists against the left cover 83 and the right cover 84. In this case, an angle between the air outlet part 100 and the handheld part 200 is 78°. Furthermore, in this case, the front cover 81 of the handheld part 200 can be placed flatly on a desktop, and the portable fan can be used as a small desktop fan. The air outlet part 100 can also rotate forwards relative to the handheld part 200 until the first connection piece 6 resists against the front cover 81. In this case, an angle between the air outlet part 100 and the handheld part 200 is 140°. Furthermore, in this case, the rear cover 82 of the handheld part 200 can be placed flatly on a desktop, and the portable fan can be used as a small desktop fan. Due to the pivoted connection between the air outlet part 100 and the handheld part 200, an air outlet angle of the air outlet part 100 can be adjusted, providing higher flexibility and variability.

Solution VI

Embodiment 1

Figure 55:
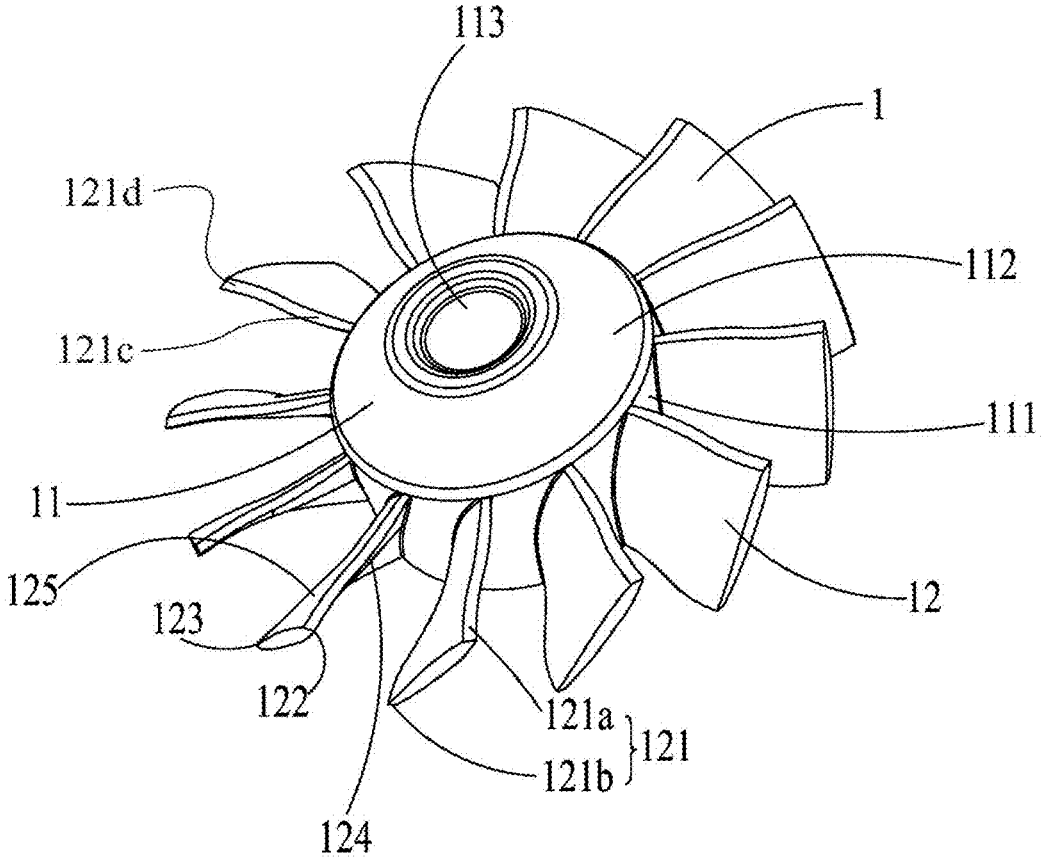
FIG. 55 is a schematic diagram of a three-dimensional structure of a fan blade according to a specific embodiment of the present disclosure.
Figure 56:
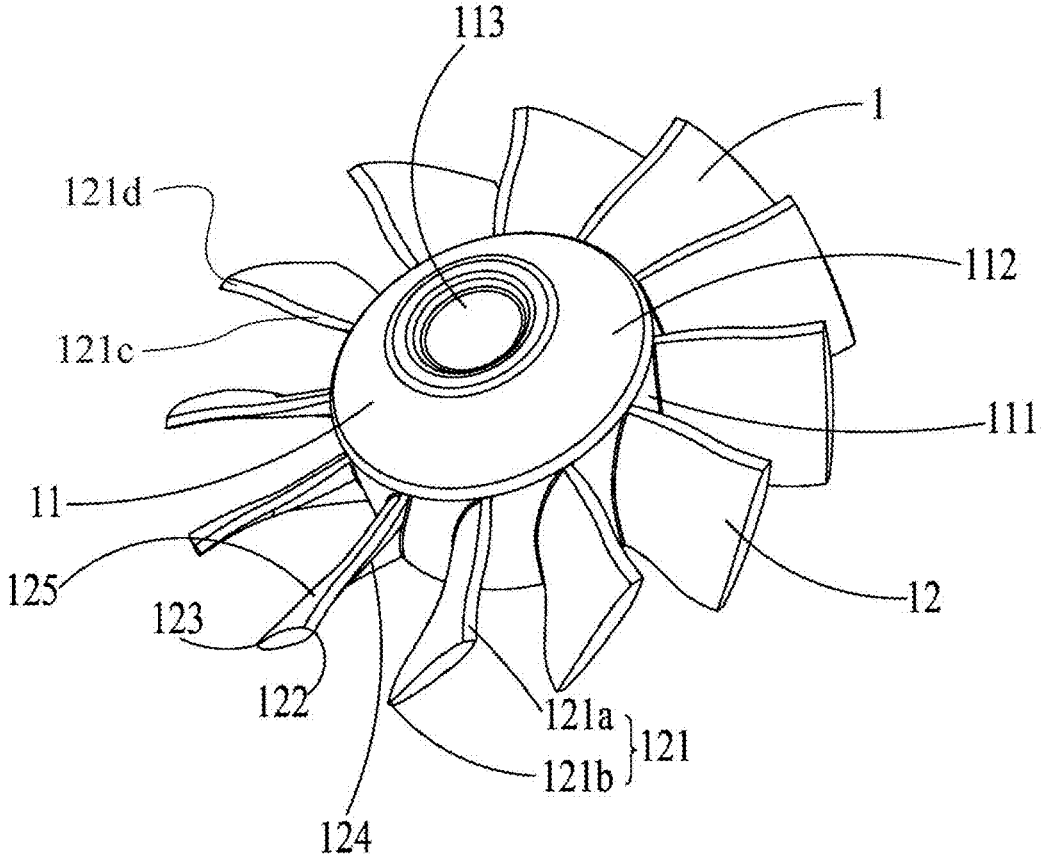
FIG. 56 is a schematic structural diagram of a first viewing angle according to a specific embodiment of the present disclosure.

Referring to FIG. 55 and FIG. 56. FIG. 55 is a schematic diagram of a three-dimensional structure of a fan blade in this embodiment, and FIG. 56 is a schematic structural diagram of a fan blade in a first viewing angle in this embodiment.

As shown in FIG. 55 and FIG. 56, a fan blade 1 includes a hub 11 and a plurality of blades 12. The hub 11 is constructed with an annular side wall 111. The plurality of blades 12 are distributed in a surrounding manner in a circumferential direction of the annular side wall 111 of the hub 11 and extend radially in a radial direction of the annular side wall 111. Each of the plurality of blades 12 is perpendicular to at least one side edge of an air inlet direction C2 of the fan blade 1, and is configured as an air cutting surface 121. The air cutting surface 121 extends in an opposite direction of a rotation direction C1 of the fan blade 1.

An end surface 112 of the hub 11 in this embodiment can be constructed as (but is not limited to): a circular plane, a hemispherical shape, a conical surface, or a truncated cone shape. After being connected, the end surface 112 and the annular side wall 111 form a complete hub 11.

In this implementation, a quantity of the blades 12 of the fan is 12. However, the quantity of the blades 12 is not limited to this. According to different specific application scenes, in some implementations, the quantity of the blades 12 can be (but is not limited to): 2, 3, 4, 5, 6, 7, 8, 9, 10, 11, 13, 14 or more.

In this implementation, there are two blades 12 perpendicular to a side edge of the air inlet direction C2 of the fan blade 1 and respectively distributed on an air inlet side and an air outlet side of the fan blade 1. The air cutting surface 121 is distributed on a side edge of the blade 12 that is located on the air inlet side. However, the distribution of the air cutting surface 121 is not limited to this. According to different specific application scenes, in some implementations, the air cutting surface 121 is arranged on a side edge of the blade 12 that is located on the air outlet side. In some implementations, the air cutting surface 121 is distributed on the side edge of the blade 12 that is located on the air inlet side and on the side edge located on the air outlet side.

In this implementation, extension in the opposite direction means that the air cutting surface 121 extends along one side of the blade 12 towards the opposite side until one side corner in an extension direction is raised. Or, the air cutting surface 121 extends along one side of the blade 12 towards the opposite side until one side corner in an opposite direction of the extension direction.

In the above implementation, at least one side edge of the fan blade 1 that is perpendicular to the air inlet direction C2 is constructed as the air cutting surface 121, and the air cutting surface 121 extends in the opposite direction of the rotation direction C1 of the fan blade 1. An end portion of the air cutting surface 121 is sharper, which can enable the fan blade 1 to better cut air when the fan blade 1 rotates, thereby reducing resistance of the fan blade 1 during rotation and implementing higher rotation efficiency of the fan blade 1. Meanwhile, since the air cutting surface 121 extends in the opposite direction of the rotation direction C1 of the fan blade 1, the blade 12 can have a better guide effect on the air flowing through a surface of the fan blade 1, so that the air can be detached from the blade 12 of the fan blade 1 at a larger angle, to reduce noise generated by the side edge and the air. Furthermore, since the air cutting surface 121 extends in the opposite direction of the rotation direction C1 of the fan blade 1, when the air cutting surface 121 is located on the air inlet side of the fan blade 1, the air can be guided into the fan blade 1, and air inlet efficiency of the fan blade 1 is improved. When the air cutting surface 121 is located on the air outlet side of the fan blade 1, guidance on the air flowing out of the fan blade 1 towards the inside of the fan blade 1 can be avoided, thereby avoiding convection between the outflow air and the air inside the fan blade 1 and greatly improving air outlet efficiency of the fan blade 1.

In some implementations, each blade 12 includes a first air cutting surface 121*a* and a second air cutting surface 121*b*. Two side edges of each blade 12 that are perpendicular to the air inlet direction C2 of the fan blade 1 are respectively constructed as the first air cutting surface 121*a* and the second air cutting surface 121*b*. The first air cutting surface 121*a* and the second air cutting surface 121*b* respectively extend in the opposite direction of the rotation direction C1 of the fan blade 1. In this implementation, two air cutting surfaces 121 are provided, namely the first air cutting surface 121*a* and the second air cutting surface 121*b*. The first air cutting surface 121*a* is arranged on a side edge of an air inlet side of the blade 12, and the second air cutting surface 121*b* is arranged on a side edge of an air outlet side of the blade 12.

The first air cutting surface 121*a* and the second air cutting surface 121*b*. An end portion of the first air cutting surface 121*a* is sharper, which can enable the fan blade 1 to better cut air when the fan blade 1 rotates, thus reducing resistance of the fan blade 1 during rotation and implementing higher rotation efficiency of the fan blade 1. Furthermore, the air can be guided into the fan blade 1, and the air inlet efficiency of the fan blade 1 is improved. The second air cutting surface 121*b* can enable the blade 12 to have a better guide effect on the air flowing through the surface of the fan blade 1, so that the air can be detached from the blade 12 of the fan blade 1 at a larger angle, to reduce noise generated by the side edge and the air. In addition, guidance on the air flowing out of the fan blade 1 towards the inside of the fan blade 1 can be avoided, thereby avoiding convection between the outflow air and the air inside the fan blade 1 and greatly improving the air outlet efficiency of the fan blade 1. Meanwhile, since both the first air cutting surface 121*a* and the second air cutting surface 121*b* extend in the opposite direction of the rotation direction C1 of the fan blade 1, the blade 12 can have a better guide effect on the air flowing through a surface of the fan blade 1, so that the air can be detached from the blade 12 of the fan blade 1 at a larger angle, to reduce noise generated by the side edge and the air.

Figure 57:
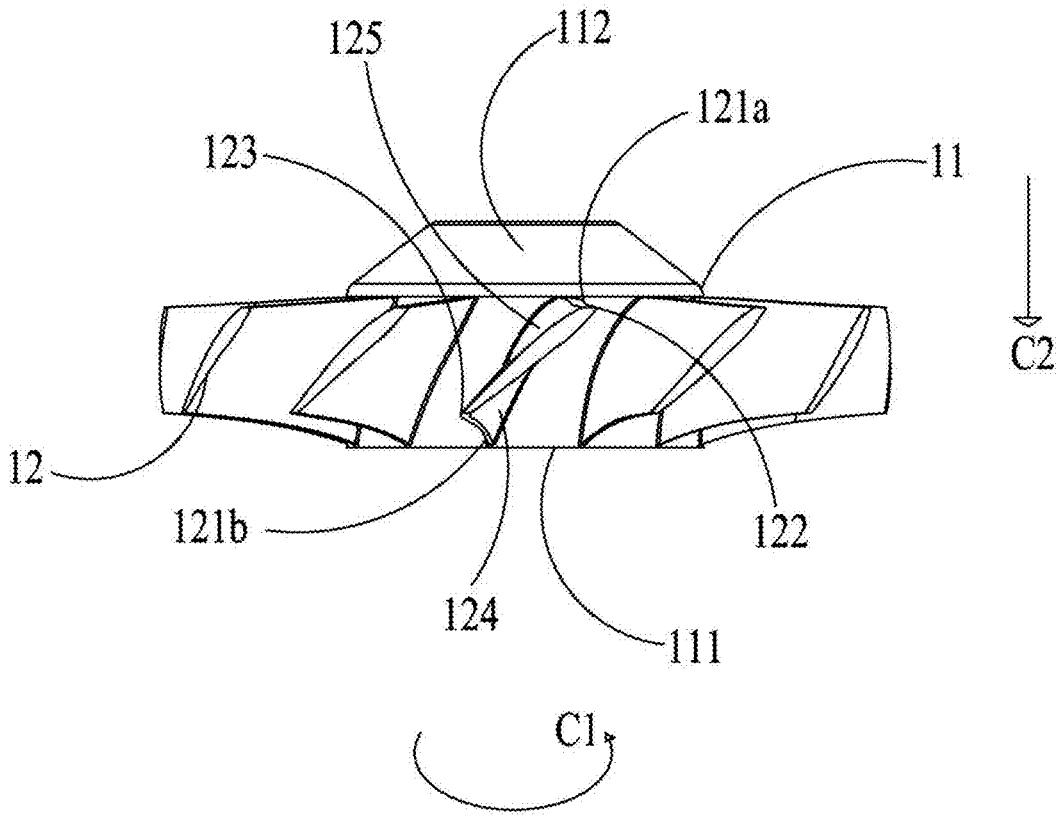
FIG. 57 is a schematic structural diagram of a fan blade in a second viewing angle according to a specific embodiment of the present disclosure.

Referring to FIG. 57, FIG. 57 is a schematic structural diagram of a fan blade in a second viewing angle in this embodiment.

As shown in FIG. 57, in some implementations, the first air cutting surface 121*a* includes a first bent portion 121*c* and a second bent portion 121*d*, and bending directions of the first bent portion 121*c* and the second bent portion 121*d* are opposite. By the arrangement of the first bent portion 121*c* and the second bent portion 121*d*, some surfaces of the first air cutting surface 121*a* is first in contact with the cut air when the fan blade 1 rotates, and then more surfaces are driven to cut the air, which can further reduce the resistance of the air. Meanwhile, cutting the air at low resistance can also reduce the noise generated during cutting. Due to the structure in which the bending directions of the first bent portion 121*c* and the second bent portion 121*d* are opposite, an air cutting area of the first bent portion 121*c* is gradually enlarged, and an air cutting area of the second bent portion 121*d* is gradually decreased; or, vice versa. This structure can keep the air cutting area of the first air cutting surface 121*a* consistent, thus avoiding vibrations, during resistance changing, of the blade 12 caused by a sharp change in the air cutting area, and further reducing rotation resistance and noise of the fan blade 1.

In some implementations, one end of the first bent portion 121*c* is connected to the annular side wall 111, and another end of the first bent portion 121*c* is connected to the second bent portion 121*d*. A connection position between the first bent portion 121*c* and the second bent portion 121*d* is smoothly transitioned. The smooth transition between the first bent portion 121*c* and the second bent portion 121*d* avoids a problem of a non-uniform force on the blade 12 due to non-smooth transition. This further reduces the wind resistance to the fan blade 1 and the noise.

However, a positional relationship between the first bent portion 121*c* and the second bent portion 121*d* is not limited. According to different specific application scenes, in some implementations, one end of the second bent portion 121*d* is connected to the annular side wall 111, while another end of the second bent portion 121*d* is connected to the first bent portion 121*c*. Another end of the first bent portion 121*c* is suspended.

In some implementations, the first bent portion 121*c* protrudes outwards to form an outer arc bent portion, and the second bent portion 121*d* is recessed inwards to form an inner arc bent portion. Based on the relative positional relationship between the first bent portion 121*c* and the second bent portion 121*d*, although they have the same angular velocity when rotating on the first curved surface 121*a*, a linear velocity of the second bent portion 121*d* is greater than a linear velocity of the first bent portion 121*c*. The second bent portion 121*d* employs an inwards recessed arc, so that a contact area at the beginning of the contact between the second bent portion 121*d* and the air is much smaller than a contact area of the first bent portion 121*c*, and the blade 12 can cut the air first by the first bent portion 121*c*. Since the linear velocity of the first bent portion 121*c* is lower, it is easier for cutting, and generated air cutting noise is smaller.

In some implementations, a width of the second air cutting surface 121*b* gradually increases in a radial extension direction of each blade 12. An area of the second air cutting surface 121*b* in an outwards extension direction of the blade 12 becomes larger. During the rotation of the fan blade 1, the linear velocity of motion of the first air cutting surface 121*a* becomes higher in its extension direction. The extension area of the second air cutting surface 121*b* corresponding to a position with a higher linear velocity is larger. This structure can make the second air cutting surface 121*b* have a larger guide area for the outflow air at a position at which the air flows faster. As a guide structure per area has lower air guide efficiency in case of a higher flow velocity of air, using a structure in which the second air cutting surface 121*b* is gradually widened can balance air guide effects at different linear velocities during the rotation and keep the air outlet directions of the air at different positions of the fan blade 1 consistent. While improving the air outlet efficiency of the fan blade 1, it can also reduce air collision noises caused by inconsistent air outlet directions.

In some implementations, each blade 12 includes a windward surface 124 and a leeward surface 125. The windward surface 124 and the leeward surface 125 are staggered from each other in the air inlet direction C2 of the fan blade 1. The first air cutting surface 121*a* and the second air cutting surface 121*b* are respectively connected to the windward surface 124 and the leeward surface 125. Both the first air cutting surface 121*a* and the second air cutting surface 121*b* are inclined planes.

The windward surface 124 is a surface of the blade 12 that is in head-on contact with the air during the rotation of the fan blade 1, while the leeward surface 125 is a surface of the blade 12 that is opposite to the windward surface 124. The windward surface 124 and the leeward surface 125 are staggered from each other, resulting in a positional difference between the windward surface 124 and the leeward surface 125. This positional difference causes the first air cutting surface 121*a* and the second air cutting surface 121*b* to have an inclination trend and finally causes the first air cutting surface 121*a* and the second air cutting surface 121*b* to be formed into the inclined planes. The inclined plane formed by the first air cutting surface 121*a* can make the first air cutting surface 121*a* sharper during air cutting and better cut the air. Meanwhile, the inclined plane can also have a good guide effect on the air entering the fan blade 1, so that the first air cutting surface 121*a* has a higher air guide capability. The inclined plane formed by the second air cutting surface 121*b* can make the second air cutting surface 121*b* have a larger contact area with the air flowing out of the fan blade 1, thereby improving the air guide capability of the second air cutting surface 121*b*.

In some implementations, in the air inlet direction C2 of each blade 12, a height of the leeward surface 125 is greater than a height of the windward surface 124. The height of the leeward surface 125 is greater than the height of the windward surface 124, so that a height of the leeward surface 125 on the air outlet side of the fan blade 1 is greater than a height of the windward surface 124 on this side, and a height of the leeward surface 125 on the air inlet side of the fan blade 1 is also greater than a height of the windward surface 124 on this side. This structure causes the first air cutting surface 121*a* to extend upwards from the windward surface 124 to the leeward surface 125. This structure can cause the first air cutting surface 121*a* to guide the air towards the inside of the fan blade 1, thereby improving the air inlet efficiency of the fan blade 1. Similarly, on the air outlet side of the fan blade 1, the height of the leeward surface 125 is still greater than the height of the windward surface 124. This structure also causes the second air cutting surface 121*b* to extend upwards. The upwards extending structure can cause the second air cutting surface 121*b* to play a role in slantways upwards guiding the air flowing out of the fan blade 1, thus reducing lateral rotation kinetic energy of the outflow air and enhancing kinetic energy in the air outlet direction of the fan blade 1. Thus, the air outlet efficiency of the fan blade 1 is higher; the wind force in the air outlet direction is well concentrated; and the air blowing effect is better.

Figure 58:
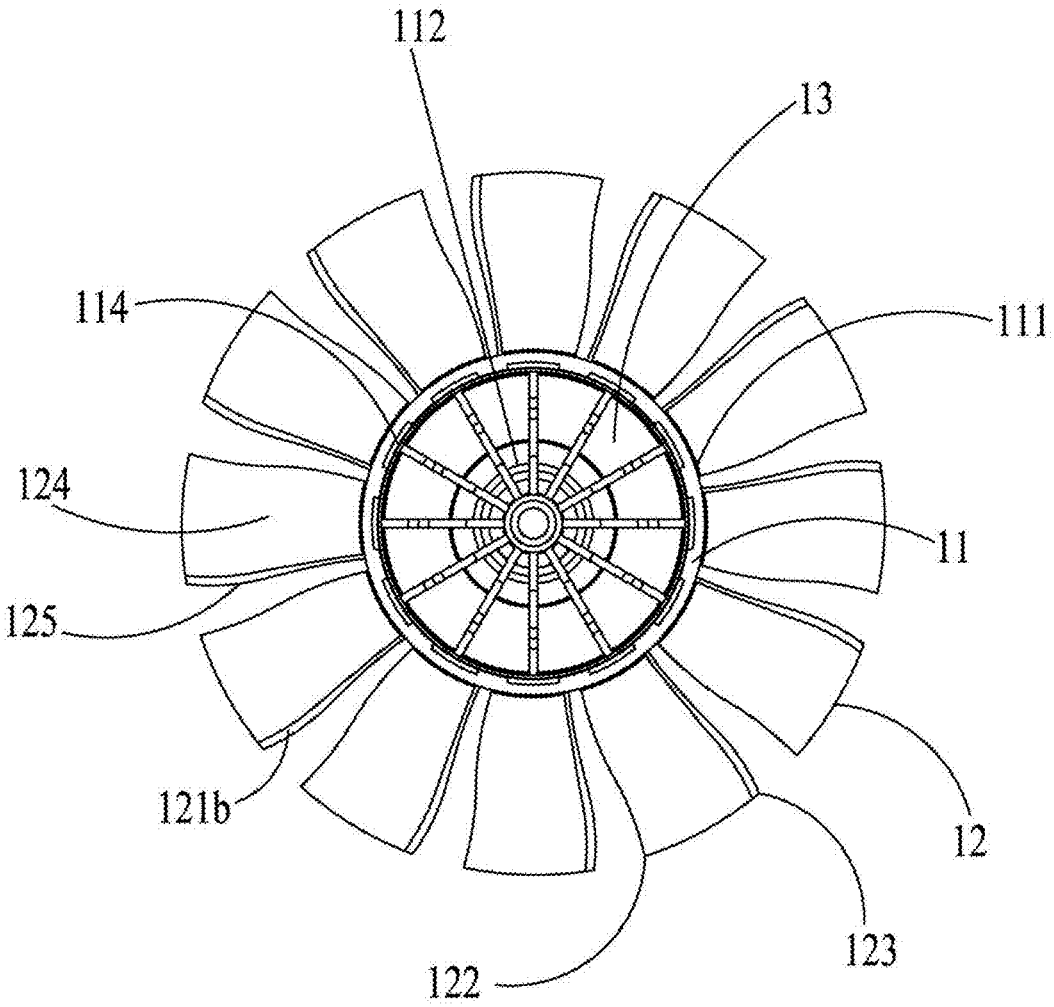
FIG. 58 is a schematic structural diagram of a cross section of a blade according to a specific embodiment of the present disclosure.

Referring to FIG. 58, FIG. 58 is a schematic structural diagram of a cross section of a blade in this embodiment.

As shown in FIG. 58, in some implementations, an angle θ1 between the leeward surface 125 and the first air cutting surface 121*a* is greater than 90°, and an angle θ2 between the windward surface 124 and a portion of the second air cutting surface 121*b* that is away from the annular side wall 111 is greater than 90°.

The angle θ1 between the leeward surface 125 and the first air cutting surface 121*a* is greater than 90°, so that the angle θ1 between the leeward surface 125 and the first air cutting surface 121*a* is an obtuse angle. This structure causes the first air cutting surface 121*a* to guide the air from the windward surface 124 to the leeward surface 125 at a smoother angle, so that the air guide effect is better, and the air inlet efficiency of the fan blade 1 is improved.

The angle θ2 between the windward surface 124 and a portion of the second air cutting surface 121*b* that is away from the annular side wall 111 is greater than 90°, so that the angle θ2 between the portion of the second air cutting surface 121*b* and the windward surface 124 is an obtuse angle. This structure causes the portion of the second air cutting surface 121*b* to guide, more smoothly, the air flowing out of the fan blade 1. This reduces the noise of the air outlet side of the fan blade 1, and the air outlet efficiency of the fan blade 1 is higher.

In some implementations, each blade 12 includes a tip 122 and a tail 123. The tip 122 is located at an end portion of a suspended end of the first air cutting surface 121*a*, and the tail 123 is located at an end portion of a suspended end of the second air cutting surface 121*b*. In a direction from the tip 122 to the tail 123, a cross section of each blade 12 is constructed in a shuttle shape. Along the direction from blade tip 122 to blade tail 123, the cross-section of each blade 12 is designed in a shuttle shape. A shuttle structure can make the blade 12 to better cut the air on the air inlet side. From small to large and from large to small, an air inlet channel formed by two adjacent blades 12 can pressurize and depressurize the air entering the air inlet channel, so that the flow velocity of the air is increased, and the wind pressure of the fan blade 1 is higher. Structurally speaking, the widening of a partial region of the blade 12 can make the physical structure of the blade 12 more stable and less prone to vibration under an external force, thus reducing the noise of the fan blade 1.

In some implementations, in the direction from the tip 122 to the tail 123, a bulging curvature of the leeward surface 125 in the cross section of each blade 12 is greater than a bulging curvature of the windward surface 124. From the perspective of a positional relationship, the windward surface 124 is located above the leeward surface 125. During the rotation of the fan blade, due to a curvature difference, the velocity of the air passing through the blade 12 is also different. According to the principle of aerodynamics, this curvature difference will cause the fan blade 1 to generate a lift force in the air outlet direction during the rotation. The generation of the lift force can counteract the gravity on the fan blade 1, thereby reducing an interaction force between the fan blade 1 and its associated connection structure (not shown in the figure), reducing a physical friction force during the rotation of the fan blade 1, and making the fan blade 1 have higher rotation efficiency.

In some implementations, each blade 12 extends obliquely along an outer surface of the annular side wall 111. Oblique extension can cause the blade 12 to better cut the air and also enable the air flowing through the fan blade 1 to flow more smoothly.

However, the extension of the blade 12 on the outer surface of the annular side wall 111 is not limited to this. According to different specific application scenes, in some implementations, the extension of the blade 12 on the outer surface of the annular side wall 111 can also be (but is not limited to): vertical extension, spiral extension, or bending extension.

In some implementations, the hub 11 further includes an end surface 112. The end surface 112 is connected to one end of the annular side wall 111, and the end surface 112 and the annular side wall 111 are enclosed to form an accommodating cavity 13 of the hub 11. The hub 11 with the end surface 112 can prevent a phenomenon that the air inlet efficiency of the fan blade 1 is affected because the air enters the annular side wall 111 and forms vortex along with the rotation of the annular side wall 111. Therefore, the arrangement of the end surface 112 can improve the air inlet efficiency of the fan blade 1.

The end surface 112 is constructed into a truncated cone shape. A top end of the end surface 112 is recessed into the accommodating cavity 13 to form a circular groove 113. The end surface 112 of the hub 11 is constructed into the truncated cone shape. Due to the top end of the truncated-cone-shaped structure has a large area, it is not easy to form an air vortex at the top end of the truncated cone during the rotation of the fan blade 1. The formation of air vortex will form a negative pressure region on the air inlet side of the fan blade 1. This negative pressure region can have an interference effect on the air entering the fan blade 1 and reduce the air inlet efficiency of the fan blade 1. Therefore, constructing the end surface 112 into the truncated cone shape can improve the air inlet efficiency of the fan blade 1.

The top end of the end surface 112 is inwards recessed to form a circular groove 113. The structure of the circular groove 113 can further interfere, during the rotation of the fan blade 1, with the air vortex generated at a corresponding position at a top end of the hub 11. Meanwhile, the structure of the circular groove 113 can be configured for adhesive injection during manufacturing of the fan blade 1. For the adhesive injection here, an adhesive injection opening formed by the adhesive injection can be hidden inside the circular groove 113, rather than being formed on a surface of the hub 11 or a surface of the blade 12. Therefore, this structure can make a surface of the fan blade 1 smoother and more in line with the principle of aerodynamics, and implement higher air blowing efficiency of the fan blade 1.

In this implementation, the end surface 112, the annular side wall 111, and the blade 12 are manufactured through an integrated molding technology. However, the connection way for them is not limited to this. According to different specific application scenes, in some implementations, the connection way between the annular side wall 111 and the end surface 112, as well as between the annular side wall 111 and the blade 12 is (but is not limited to): hot melt connection, adhesive connection, clamping connection, screw connection, and the like.

In some embodiments, a plurality of leveling slots 114 are formed in one side surface of the annular side wall 111 that faces the accommodating cavity 13, and the plurality of leveling slots 114 are arranged at an equal spacing in a surrounding manner. A quantity of the leveling slots 114 can be any integer greater than or equal to 2.

The leveling slots 114 are formed in an inner surface of the annular side wall 111, which makes proper use of a space resource inside the accommodating cavity 13 and does not expose the leveling slots 114 in an outer surface of the hub 11, thereby improving smoothness of the outer surface of the hub 11, reducing the resistance during the rotation of the fan blade 1, and implementing higher air outlet efficiency. Meanwhile, the leveling slots 114 are formed in the inner surface of the annular side wall 111. When the fan blade 1 rotates, balance packing (not shown in the figure) placed inside can be supported by the annular side wall 111 and will not be detached from the hub 11 under a centrifugal force generated by the rotation of the fan blade 1. This improves the stability of the rotation of the fan blade 1, avoids damage to the fan blade 1, which is possibly caused by detachment of the balance packing, and improves the safety of the fan blade 1.

In some implementations, the plurality of leveling slots 114 are communicated to the accommodating cavity 13. The plurality of leveling slots 114 are enclosed together with a motor accessory assembled in the accommodating cavity 13 to form a leveling space.

The motor accessory, such as a magnetic ring of a fan motor or a magnetic ring and a metal ring sleeving the magnetic ring, is mounted inside the accommodating cavity 13. The leveling slots 114 are communicated to an adjacent side wall of the annular side wall 111, so that side walls of the leveling slots 114 that are next to the motor accessory are missing. However, the motor accessory and the inner surface of the annular side wall 111 are usually in close interference fit. Therefore, the motor accessory can be used as a supplement to the missing side walls of the leveling slots 114 to complete the leveling slots 114. This structure cleverly uses a relative relationship between the accommodating cavity 13 and the motor accessory to simplify the structures of the leveling slots 114 and eliminate space loss caused by setting the complete leveling slots 114, so that the hub 11 has a smaller and more exquisite structure, and the space utilization efficiency of the fan blade 1 is improved.

It should be noted that any implementation in this embodiment can be implemented independently or in combination with one or more other implementations. When the implementation is implemented in combination, its combination way should not be limited to the combination way listed in this embodiment.

Embodiment 2

An air blowing device includes the fan blade 1 in Embodiment 1. The fan blade 1 is used as a core module assembly for assembling the air blowing device.

It should be pointed out that the air blowing device in this embodiment includes (but is not limited to): a bladeless fan, a desktop fan, a floor fan, a spherical fan, a neck fan, a handheld fan, an industrial fan, an air conditioner, an air blower, and another product that needs boosts air for circulation. The fan blade 1 in Embodiment 1 is assembled inside a shell of the above product.

In the air blowing device in this embodiment, at least one side edge of the fan blade 1 that is perpendicular to the air inlet direction C2 is constructed as the air cutting surface 121, and the air cutting surface 121 extends in the opposite direction of the rotation direction C1 of the fan blade 1. An end portion of the air cutting surface 121 is sharper, which can enable the fan blade 1 to better cut air when the fan blade 1 rotates, thereby reducing resistance of the fan blade 1 during rotation and implementing higher rotation efficiency of the fan blade 1. Meanwhile, since the air cutting surface 121 extends in the opposite direction of the rotation direction C1 of the fan blade 1, the blade 12 can have a better guide effect on the air flowing through a surface of the fan blade 1, so that the air can be detached from the blade 12 of the fan blade 1 at a larger angle, to reduce noise generated by the side edge and the air. Furthermore, since the air cutting surface 121 extends in the opposite direction of the rotation direction C1 of the fan blade 1, when the air cutting surface 121 is located on the air inlet side of the fan blade 1, the air can be guided into the fan blade 1, and air inlet efficiency of the fan blade 1 is improved. When the air cutting surface 121 is located on the air outlet side of the fan blade 1, guidance on the air flowing out of the fan blade 1 towards the inside of the fan blade 1 can be avoided, thereby avoiding convection between the outflow air and the air inside the fan blade 1 and greatly improving air outlet efficiency of the fan blade 1.

All the above are merely preferred embodiments of the present disclosure and are not intended to limit the scope of the patent. Any equivalent structural or process transformations made based on the description and drawings of the present disclosure, whether directly or indirectly applied in other related technical fields, shall likewise fall within the scope of the patent.

What is claimed is:

1. A fan blade, comprising a hub and a plurality of blades uniformly distributed in a circumferential direction of the hub, wherein each blade comprises a blade root and a blade tail; the blade tail is twisted relative to the blade root; and the blade roots of the plurality of blades are connected to the hub;

wherein the hub comprises an annular main body and an air guide cone connected to the annular main body; and the annular main body is connected to the air guide cone to form a cavity; and a circular recessed platform is arranged at a center of the air guide cone; the recessed platform comprises a bottom plate and an inner conical wall connected to the bottom plate; and the inner conical wall is connected to the annular main body through an outer conical wall.

2. The fan blade according to claim 1, wherein each blade further comprises a first side and a second side; a thickness of the first side of the blade is greater than a thickness of the second side of the blade; a distance from the first side of the blade root to the second side of the blade root is a first width; a range of the first width is greater than or equal to 16.0 mm and less than or equal to 16.5 mm; a distance from the first side of the blade tail to the second side of the blade tail is a second width; and a range of the second width is greater than or equal to 15.0 mm to less than or equal to 15.5 mm.

3. The fan blade according to claim 2, wherein an angle between a connection line from the first side of the blade root to the second side of the blade root and a radial plane direction of the hub is a first angle; a range of the first angle is greater than or equal to 25 degrees and less than or equal to 75 degrees; an angle between a connection line from the first side of the blade tail to the second side of the blade tail and the connection line from the first side of the blade root to the second side of the blade root is a second angle; and a range of the second angle is greater than or equal to 5 degrees and less than or equal to 10 degrees.

4. The fan blade according to claim 1, wherein a quantity of the blades is 9 to 15.

5. The fan blade according to claim 1, wherein the bottom plate is provided with an annular protrusion on one side facing the cavity, and a diameter of the annular protrusion is less than a diameter of the bottom plate.

6. The fan blade according to claim 5, wherein a plurality of connection plates are arranged on one side of the inner conical call that faces the cavity; and the connection plates are connected to the outer conical wall.

7. The fan blade according to claim 6, wherein a joint of the outer conical wall and the inner conical wall and a joint of the inner conical wall and the bottom plate are both arc-shaped chamfers; a width of a joint of each connection plate and the outer conical wall and a width of a joint of the connection plate and the inner conical wall are both greater than a width of the center of the connection plate; and the joint of the connection plate and the outer conical wall and the joint of the connection plate and the inner conical wall are both arc-shaped chamfers.

8. The fan blade according to claim 1, wherein:

the hub comprises a rear portion and a side portion that are connected to each other, wherein the rear portion and the side portion form an accommodating portion with a forward opening, and the accommodating portion is configured to accommodate a motor;

the plurality of blades are arranged outside the side portion at an equidistant spacing in a surrounding manner; and a rotating shaft is integrally formed with the hub, is fixed at a center of the rear portion, and is arranged in the accommodating portion.

9. The fan blade according to claim 8, wherein the hub and the blades are formed by integral injection molding, and a material of the hub and a material of the blades both contain glass fibers with a content percentage of 28% to 32%.

10. The fan blade according to claim 8, wherein the rear portion comprises an end portion and an inclined portion; the end portion is recessed from back to front; a center of the end portion protrudes forwards to form a shaft sleeve; the shaft sleeve is configured to fix the rotating shaft, and the rotating shaft is not exposed backwards out of the end portion; the inclined portion connects the end portion to the side portion; and the inclined portion expands and extends radially from back to front.

11. The fan blade according to claim 10, further comprising a plurality of reinforcing ribs, wherein the plurality of reinforcing ribs are arranged inside the rear portion at an equidistant spacing in a surrounding manner, and each reinforcing rib extends from the shaft sleeve at the center to the inclined portion.

12. The fan blade according to claim 11, wherein the reinforcing rib comprises a step portion arranged at the inclined portion and close to the side portion; and the step portion is configured to limit and support a magnetic ring of the motor.

13. The fan blade according to claim 8, wherein a distance between a front end of the side portion and a rear end of the rear portion is 19.92 to 21.12 mm; a distance between a front end of the rotating shaft and the rear end of the rear portion is 23.02 to 23.22 mm; the rotating shaft extends forwards beyond the front end of the side portion; and an outer diameter of the side portion is 33.04 to 33.24 mm.

14. The fan blade according to claim 8, wherein a quantity of the blades is 12, and each blade is radial; each blade comprises a blade root connected to the hub, a blade tail away from the hub, and a first side wing and a second side wing that connects the blade root to the blade tail; the first side wing is located on a front side in a rotation direction, and the second side wing is located on a rear side in the rotation direction; in an axial direction, the first side wing is located behind the second side wing; and a thickness of the first side wing is greater than a thickness of the second side wing.

15. The fan blade according to claim 14, wherein an insertion surface between two adjacent blades is 1°; and in the axial direction, a diameter of a projection of the blade tail is 67.90 to 68.10 mm.

16. The fan blade according to claim 14, wherein in a direction from the blade root to the blade tail, an acute angle between a cross section of the blade and an axis gradually increases; the second side wing gradually extends backwards; the first side wing gradually extends forwards; and a forward extension extent of the first side wing is less than a backward extension extent of the second side wing.

17. A fan, comprising a fan blade;

wherein the fan blade comprises a hub and a plurality of blades uniformly distributed in a circumferential direction of the hub, wherein each blade comprises a blade root and a blade tail; the blade tail is twisted relative to the blade root; and the blade roots of the plurality of blades are connected to the hub;

wherein the hub comprises an annular main body and an air guide cone connected to the annular main body; and the annular main body is connected to the air guide cone to form a cavity; and a circular recessed platform is arranged at a center of the air guide cone; the recessed platform comprises a bottom plate and an inner conical wall connected to the bottom plate; and the inner conical wall is connected to the annular main body through an outer conical wall.

18. The fan according to claim 17, wherein the hub comprises a rear portion and a side portion that are connected to each other, wherein the rear portion and the side portion form an accommodating portion with a forward opening, and the accommodating portion is configured to accommodate a motor;

the plurality of blades are arranged outside the side portion at an equidistant spacing in a surrounding manner; and a rotating shaft is integrally formed with the hub, is fixed at a center of the rear portion, and is arranged in the accommodating portion.

19. The fan according to claim 17, wherein the fan main body comprises an annular housing, a front guard and a rear guard respectively arranged on two opposite sides of the annular housing, wherein an end of the rear guard that is adjacent to the front guard is inserted into a gap formed between the front guard and an inner wall of the annular housing.

20. The fan according to claim 17, wherein the handheld fan comprises a fan main body, a handheld handle, a control circuit board, and a power source, wherein a connection part is arranged on the fan main body and defines a first mounting cavity inside; the handheld handle is connected to the connection part and a second mounting cavity is provided inside the handheld handle; the control circuit board is mounted inside the first mounting cavity and is electrically connected to the fan main body to control the fan main body; the power source is mounted inside the second mounting cavity and is electrically connected to the control circuit board through a wire.

* * * * *